US006646625B1

(12) United States Patent
Shigeta et al.

(10) Patent No.: US 6,646,625 B1
(45) Date of Patent: Nov. 11, 2003

(54) METHOD FOR DRIVING A PLASMA DISPLAY PANEL

(75) Inventors: Tetsuya Shigeta, Yamanashi (JP); Hitoshi Mochizuki, Yamanashi (JP); Masahiro Suzuki, Yamanashi (JP); Nobuhiko Saegusa, Yamanashi (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 09/482,925

(22) Filed: Jan. 14, 2000

(30) Foreign Application Priority Data

Jan. 18, 1999 (JP) ..... 11-009932
Mar. 12, 1999 (JP) ..... 11-066679
Aug. 20, 1999 (JP) ..... 11-234716

(51) Int. Cl.[7] ..... G09G 3/28

(52) U.S. Cl. ..... 345/63; 345/67; 345/60; 315/169.4

(58) Field of Search ..... 345/60–68, 690–692; 315/169.1–169.3, 169.4

(56) References Cited

U.S. PATENT DOCUMENTS 5,436,634 A 7/1995 Kanazawa ..... 345/67
6,088,012 A * 7/2000 Shigeta et al. ..... 345/63
6,297,788 B1 * 10/2001 Shigeta et al. ..... 345/63
6,369,782 B2 * 4/2002 Shigeta et al. ..... 345/63

FOREIGN PATENT DOCUMENTS

EP 0 653 740 A2 5/1995 ..... G09G/3/28
EP 0 831 449 A2 3/1998 ..... G09G/3/20
EP 0 831 450 A2 3/1998 ..... G09G/3/28
EP 0 833 299 A1 4/1998 ..... G09G/3/28
EP 0 834 856 A1 4/1998 ..... G09G/3/28
FR 2 740 253 4/1997 ..... G09G/3/28
JP 10 301533 11/1998 ..... G09G/3/28

OTHER PUBLICATIONS

Japan Abstract No. 07140922, dated Jun. 2, 1995.
Japan Abstract No. 07264515, dated Oct. 13, 1995.

* cited by examiner

*Primary Examiner*—Lun-Yi Lao
(74) *Attorney, Agent, or Firm*—Sughrue Mion, PLLC

(57) ABSTRACT

The object of the invention is to provide a method for driving a plasma display panel that provides an improved expression of levels of halftone as well as an improved display quality. In N sub-fields constituting a display period of one field, when a pixel data writing step for setting discharge cells to either one of non-light-emitting cells or light-emitting cells in response to pixel data and a light-emission sustaining step for allowing only the aforementioned light-emitting cells to emit light only during a light-emission period corresponding to weights assigned to the sub-fields respectively are executed, the light-emission period in the light-emission sustaining step of the respective sub-fields is changed field by field or frame by frame. According to another aspect, the invention allows for carrying out selectively a first drive pattern or a second drive pattern. The first drive pattern is carried out by alternating, field by field (frame by frame) in response to the type of input video signals, first and second light-emission drive sequences which have mutually different ratios of the number of times of light-emissions in the light-emission sustaining step during one field (one frame). The second drive pattern is carried out by alternating, field by field (frame by frame) in response to the type of input video signals, third and fourth light-emission drive sequences which have mutually different ratios of the number of times of light-emissions in the aforementioned light-emission sustaining step.

22 Claims, 54 Drawing Sheets

FIG. 4A DRIVE MODE (A)

FIG. 4B DRIVE MODE (B)

FIG. 9A

DRIVE MODE (A)

| LC | SF1 | SF2 | SF3 | SF4 | SF5 | SF6 | SF7 | SF8 |
|---|---|---|---|---|---|---|---|---|
| MODE 1 | 3 | 11 | 20 | 30 | 40 | 51 | 63 | 37 |
| MODE 2 | 6 | 22 | 40 | 60 | 80 | 102 | 126 | 74 |
| MODE 3 | 9 | 33 | 60 | 90 | 120 | 153 | 189 | 111 |
| MODE 4 | 12 | 44 | 80 | 120 | 160 | 204 | 252 | 148 |

FIG. 9B

DRIVE MODE (B)

| LC | SF1 | SF2 | SF3 | SF4 | SF5 | SF6 | SF7 | SF8 |
|---|---|---|---|---|---|---|---|---|
| MODE 1 | 1 | 6 | 16 | 24 | 35 | 46 | 57 | 70 |
| MODE 2 | 2 | 12 | 32 | 48 | 70 | 92 | 114 | 140 |
| MODE 3 | 3 | 18 | 48 | 72 | 105 | 138 | 171 | 210 |
| MODE 4 | 4 | 24 | 64 | 96 | 140 | 184 | 228 | 280 |

FIG. 13

| LEVEL | $D_{BL}$ | A | B | | $D_{BL}$ | A | B |
|---|---|---|---|---|---|---|---|
| 0 | 00000000 | 00000000 | 00000000 | 64 | 01000000 | 00100110 | 00011110 |
| 1 | 00000001 | 00000000 | 00000000 | 65 | 01000001 | 00100110 | 00011110 |
| 2 | 00000010 | 00000001 | 00000000 | 66 | 01000010 | 00100111 | 00011111 |
| 3 | 00000011 | 00000010 | 00000001 | 67 | 01000011 | 00100111 | 00011111 |
| 4 | 00000100 | 00000011 | 00000001 | 68 | 01000100 | 00101000 | 00100000 |
| 5 | 00000101 | 00000100 | 00000010 | 69 | 01000101 | 00101000 | 00100000 |
| 6 | 00000110 | 00000101 | 00000010 | 70 | 01000110 | 00101000 | 00100000 |
| 7 | 00000111 | 00000110 | 00000011 | 71 | 01000111 | 00101001 | 00100001 |
| 8 | 00001000 | 00000111 | 00000011 | 72 | 01001000 | 00101001 | 00100001 |
| 9 | 00001001 | 00001000 | 00000100 | 73 | 01001001 | 00101010 | 00100010 |
| 10 | 00001010 | 00001001 | 00000100 | 74 | 01001010 | 00101010 | 00100010 |
| 11 | 00001011 | 00001010 | 00000101 | 75 | 01001011 | 00101011 | 00100011 |
| 12 | 00001100 | 00001011 | 00000101 | 76 | 01001100 | 00101011 | 00100011 |
| 13 | 00001101 | 00001100 | 00000110 | 77 | 01001101 | 00101100 | 00100100 |
| 14 | 00001110 | 00001101 | 00000110 | 78 | 01001110 | 00101100 | 00100100 |
| 15 | 00001111 | 00001110 | 00000111 | 79 | 01001111 | 00101101 | 00100101 |
| 16 | 00010000 | 00001111 | 00000111 | 80 | 01010000 | 00101101 | 00100101 |
| 17 | 00010001 | 00010000 | 00001000 | 81 | 01010001 | 00101110 | 00100110 |
| 18 | 00010010 | 00010000 | 00001000 | 82 | 01010010 | 00101110 | 00100110 |
| 19 | 00010011 | 00010000 | 00001000 | 83 | 01010011 | 00101111 | 00100111 |
| 20 | 00010100 | 00010001 | 00001001 | 84 | 01010100 | 00101111 | 00100111 |
| 21 | 00010101 | 00010001 | 00001001 | 85 | 01010101 | 00110000 | 00101000 |
| 22 | 00010110 | 00010010 | 00001010 | 86 | 01010110 | 00110000 | 00101000 |
| 23 | 00010111 | 00010010 | 00001010 | 87 | 01010111 | 00110000 | 00101000 |
| 24 | 00011000 | 00010011 | 00001011 | 88 | 01011000 | 00110001 | 00101001 |
| 25 | 00011001 | 00010011 | 00001011 | 89 | 01011001 | 00110001 | 00101001 |
| 26 | 00011010 | 00010100 | 00001100 | 90 | 01011010 | 00110010 | 00101010 |
| 27 | 00011011 | 00010100 | 00001100 | 91 | 01011011 | 00110010 | 00101010 |
| 28 | 00011100 | 00010101 | 00001101 | 92 | 01011100 | 00110011 | 00101011 |
| 29 | 00011101 | 00010101 | 00001101 | 93 | 01011101 | 00110011 | 00101011 |
| 30 | 00011110 | 00010110 | 00001110 | 94 | 01011110 | 00110100 | 00101100 |
| 31 | 00011111 | 00010110 | 00001110 | 95 | 01011111 | 00110100 | 00101100 |
| 32 | 00100000 | 00010111 | 00001111 | 96 | 01100000 | 00110101 | 00101101 |
| 33 | 00100001 | 00010111 | 00001111 | 97 | 01100001 | 00110101 | 00101101 |
| 34 | 00100010 | 00011000 | 00010000 | 98 | 01100010 | 00110110 | 00101110 |
| 35 | 00100011 | 00011000 | 00010000 | 99 | 01100011 | 00110110 | 00101110 |
| 36 | 00100100 | 00011000 | 00010000 | 100 | 01100100 | 00110111 | 00101111 |
| 37 | 00100101 | 00011001 | 00010001 | 101 | 01100101 | 00110111 | 00101111 |
| 38 | 00100110 | 00011001 | 00010001 | 102 | 01100110 | 00111000 | 00110000 |
| 39 | 00100111 | 00011010 | 00010010 | 103 | 01100111 | 00111000 | 00110000 |
| 40 | 00101000 | 00011010 | 00010010 | 104 | 01101000 | 00111000 | 00110000 |
| 41 | 00101001 | 00011011 | 00010011 | 105 | 01101001 | 00111001 | 00110001 |
| 42 | 00101010 | 00011011 | 00010011 | 106 | 01101010 | 00111001 | 00110001 |
| 43 | 00101011 | 00011100 | 00010100 | 107 | 01101011 | 00111010 | 00110010 |
| 44 | 00101100 | 00011100 | 00010100 | 108 | 01101100 | 00111010 | 00110010 |
| 45 | 00101101 | 00011101 | 00010101 | 109 | 01101101 | 00111011 | 00110011 |
| 46 | 00101110 | 00011101 | 00010101 | 110 | 01101110 | 00111011 | 00110011 |
| 47 | 00101111 | 00011110 | 00010110 | 111 | 01101111 | 00111100 | 00110100 |
| 48 | 00110000 | 00011110 | 00010110 | 112 | 01110000 | 00111100 | 00110100 |
| 49 | 00110001 | 00011111 | 00010111 | 113 | 01110001 | 00111101 | 00110101 |
| 50 | 00110010 | 00011111 | 00010111 | 114 | 01110010 | 00111101 | 00110101 |
| 51 | 00110011 | 00100000 | 00011000 | 115 | 01110011 | 00111110 | 00110110 |
| 52 | 00110100 | 00100000 | 00011000 | 116 | 01110100 | 00111110 | 00110110 |
| 53 | 00110101 | 00100000 | 00011000 | 117 | 01110101 | 00111111 | 00110111 |
| 54 | 00110110 | 00100001 | 00011001 | 118 | 01110110 | 00111111 | 00110111 |
| 55 | 00110111 | 00100001 | 00011001 | 119 | 01110111 | 01000000 | 00111000 |
| 56 | 00111000 | 00100010 | 00011010 | 120 | 01111000 | 01000000 | 00111000 |
| 57 | 00111001 | 00100010 | 00011010 | 121 | 01111001 | 01000000 | 00111000 |
| 58 | 00111010 | 00100011 | 00011011 | 122 | 01111010 | 01000001 | 00111001 |
| 59 | 00111011 | 00100011 | 00011011 | 123 | 01111011 | 01000001 | 00111001 |
| 60 | 00111100 | 00100100 | 00011100 | 124 | 01111100 | 01000010 | 00111010 |
| 61 | 00111101 | 00100100 | 00011100 | 125 | 01111101 | 01000010 | 00111010 |
| 62 | 00111110 | 00100101 | 00011101 | 126 | 01111110 | 01000011 | 00111011 |
| 63 | 00111111 | 00100101 | 00011101 | 127 | 01111111 | 01000011 | 00111011 |

FIG. 14

| LEVEL | $D_{BL}$ | A | B | | $D_{BL}$ | A | B |
|---|---|---|---|---|---|---|---|
| 128 | 10000000 | 01000100 | 00111100 | 192 | 11000000 | 01100010 | 01011010 |
| 129 | 10000001 | 01000100 | 00111100 | 193 | 11000001 | 01100010 | 01011010 |
| 130 | 10000010 | 01000101 | 00111101 | 194 | 11000010 | 01100011 | 01011011 |
| 131 | 10000011 | 01000101 | 00111101 | 195 | 11000011 | 01100011 | 01011011 |
| 132 | 10000100 | 01000110 | 00111110 | 196 | 11000100 | 01100100 | 01011100 |
| 133 | 10000101 | 01000110 | 00111110 | 197 | 11000101 | 01100100 | 01011100 |
| 134 | 10000110 | 01000111 | 00111111 | 198 | 11000110 | 01100101 | 01011101 |
| 135 | 10000111 | 01000111 | 00111111 | 199 | 11000111 | 01100101 | 01011101 |
| 136 | 10001000 | 01001000 | 01000000 | 200 | 11001000 | 01100110 | 01011110 |
| 137 | 10001001 | 01001000 | 01000000 | 201 | 11001001 | 01100110 | 01011110 |
| 138 | 10001010 | 01001000 | 01000000 | 202 | 11001010 | 01100111 | 01011111 |
| 139 | 10001011 | 01001001 | 01000001 | 203 | 11001011 | 01100111 | 01011111 |
| 140 | 10001100 | 01001001 | 01000001 | 204 | 11001100 | 01101000 | 01100000 |
| 141 | 10001101 | 01001010 | 01000010 | 205 | 11001101 | 01101000 | 01100000 |
| 142 | 10001110 | 01001010 | 01000010 | 206 | 11001110 | 01101000 | 01100000 |
| 143 | 10001111 | 01001011 | 01000011 | 207 | 11001111 | 01101001 | 01100001 |
| 144 | 10010000 | 01001011 | 01000011 | 208 | 11010000 | 01101001 | 01100001 |
| 145 | 10010001 | 01001100 | 01000100 | 209 | 11010001 | 01101010 | 01100010 |
| 146 | 10010010 | 01001100 | 01000100 | 210 | 11010010 | 01101010 | 01100010 |
| 147 | 10010011 | 01001101 | 01000101 | 211 | 11010011 | 01101011 | 01100011 |
| 148 | 10010100 | 01001101 | 01000101 | 212 | 11010100 | 01101011 | 01100011 |
| 149 | 10010101 | 01001110 | 01000110 | 213 | 11010101 | 01101100 | 01100100 |
| 150 | 10010110 | 01001110 | 01000110 | 214 | 11010110 | 01101100 | 01100100 |
| 151 | 10010111 | 01001111 | 01000111 | 215 | 11010111 | 01101101 | 01100101 |
| 152 | 10011000 | 01001111 | 01000111 | 216 | 11011000 | 01101101 | 01100101 |
| 153 | 10011001 | 01010000 | 01001000 | 217 | 11011001 | 01101110 | 01100110 |
| 154 | 10011010 | 01010000 | 01001000 | 218 | 11011010 | 01101110 | 01100110 |
| 155 | 10011011 | 01010000 | 01001000 | 219 | 11011011 | 01101111 | 01100111 |
| 156 | 10011100 | 01010001 | 01001001 | 220 | 11011100 | 01101111 | 01100111 |
| 157 | 10011101 | 01001001 | 01001001 | 221 | 11011101 | 01110000 | 01101000 |
| 158 | 10011110 | 01001010 | 01001010 | 222 | 11011110 | 01110000 | 01101000 |
| 159 | 10011111 | 01001010 | 01001010 | 223 | 11011111 | 01110000 | 01101000 |
| 160 | 10100000 | 01001011 | 01001011 | 224 | 11100000 | 01110001 | 01101001 |
| 161 | 10100001 | 01001011 | 01001011 | 225 | 11100001 | 01110001 | 01101001 |
| 162 | 10100010 | 01001100 | 01001100 | 226 | 11100010 | 01110010 | 01101010 |
| 163 | 10100011 | 01001100 | 01001100 | 227 | 11100011 | 01110010 | 01101010 |
| 164 | 10100100 | 01001101 | 01001101 | 228 | 11100100 | 01110011 | 01101011 |
| 165 | 10100101 | 01001101 | 01001101 | 229 | 11100101 | 01110011 | 01101011 |
| 166 | 10100110 | 01001110 | 01001110 | 230 | 11100110 | 01110100 | 01101100 |
| 167 | 10100111 | 01010110 | 01001110 | 231 | 11100111 | 01110100 | 01101100 |
| 168 | 10101000 | 01010111 | 01001111 | 232 | 11101000 | 01110101 | 01101101 |
| 169 | 10101001 | 01010111 | 01001111 | 233 | 11101001 | 01110110 | 01101101 |
| 170 | 10101010 | 01011000 | 01010000 | 234 | 11101010 | 01110110 | 01101110 |
| 171 | 10101011 | 01011000 | 01010000 | 235 | 11101011 | 01110111 | 01101110 |
| 172 | 10101100 | 01011000 | 01010000 | 236 | 11101100 | 01110111 | 01101111 |
| 173 | 10101101 | 01011001 | 01010001 | 237 | 11101101 | 01111000 | 01101111 |
| 174 | 10101110 | 01011001 | 01010001 | 238 | 11101110 | 01111000 | 01110000 |
| 175 | 10101111 | 01011010 | 01010010 | 239 | 11101111 | 01111000 | 01110000 |
| 176 | 10110000 | 01011010 | 01010010 | 240 | 11110000 | 01111000 | 01110001 |
| 177 | 10110001 | 01011011 | 01010011 | 241 | 11110001 | 01111001 | 01110010 |
| 178 | 10110010 | 01011011 | 01010011 | 242 | 11110010 | 01111001 | 01110011 |
| 179 | 10110011 | 01011100 | 01010100 | 243 | 11110011 | 01111010 | 01110100 |
| 180 | 10110100 | 01011100 | 01010100 | 244 | 11110100 | 01111010 | 01110101 |
| 181 | 10110101 | 01011101 | 01010101 | 245 | 11110101 | 01111011 | 01110110 |
| 182 | 10110110 | 01011101 | 01010101 | 246 | 11110110 | 01111011 | 01110111 |
| 183 | 10110111 | 01011110 | 01010110 | 247 | 11110111 | 01111100 | 01111000 |
| 184 | 10111000 | 01011110 | 01010110 | 248 | 11111000 | 01111100 | 01111001 |
| 185 | 10111001 | 01011111 | 01010111 | 249 | 11111001 | 01111101 | 01111010 |
| 186 | 10111010 | 01011111 | 01010111 | 250 | 11111010 | 01111101 | 01111011 |
| 187 | 10111011 | 01100000 | 01011000 | 251 | 11111011 | 01111110 | 01111100 |
| 188 | 10111100 | 01100000 | 01011000 | 252 | 11111100 | 01111110 | 01111101 |
| 189 | 10111101 | 01100000 | 01011000 | 253 | 11111101 | 01111111 | 01111110 |
| 190 | 10111110 | 01100001 | 01011001 | 254 | 11111110 | 01111111 | 01111111 |
| 191 | 10111111 | 01100001 | 01011001 | 255 | 11111111 | 10000000 | 10000000 |

SELECTIVE ERASING

| GRAY SCALE | Ds | HD 1 | HD 2 | HD 3 | HD 4 | HD 5 | HD 6 | HD 7 | HD 8 | LIGHT-EMISSION DRIVE PATTERN SF 1 | SF 2 | SF 3 | SF 4 | SF 5 | SF 6 | SF 7 | SF 8 | LIGHT-EMISSION BRIGHTNESS $L_A$ | $L_B$ |
|---|---|---|---|---|---|---|---|---|---|---|---|---|---|---|---|---|---|---|---|
| 1 | 0000 | 1 | 0 | 0 | 0 | 0 | 0 | 0 | 0 | ● | | | | | | | | 0 | 0 |
| 2 | 0001 | 0 | 1 | 0 | 0 | 0 | 0 | 0 | 0 | ○ | ● | | | | | | | 3 | 1 |
| 3 | 0010 | 0 | 0 | 1 | 0 | 0 | 0 | 0 | 0 | ○ | ○ | ● | | | | | | 14 | 7 |
| 4 | 0011 | 0 | 0 | 0 | 1 | 0 | 0 | 0 | 0 | ○ | ○ | ○ | ● | | | | | 34 | 23 |
| 5 | 0100 | 0 | 0 | 0 | 0 | 1 | 0 | 0 | 0 | ○ | ○ | ○ | ○ | ● | | | | 64 | 47 |
| 6 | 0101 | 0 | 0 | 0 | 0 | 0 | 1 | 0 | 0 | ○ | ○ | ○ | ○ | ○ | ● | | | 104 | 82 |
| 7 | 0110 | 0 | 0 | 0 | 0 | 0 | 0 | 1 | 0 | ○ | ○ | ○ | ○ | ○ | ○ | ● | | 155 | 128 |
| 8 | 0111 | 0 | 0 | 0 | 0 | 0 | 0 | 0 | 1 | ○ | ○ | ○ | ○ | ○ | ○ | ○ | ● | 218 | 185 |
| 9 | 1000 | 0 | 0 | 0 | 0 | 0 | 0 | 0 | 0 | ○ | ○ | ○ | ○ | ○ | ○ | ○ | ○ | 255 | 255 |

BLACK CIRCLES:SELECTIVE ERASE DISCHARGE STATE
WHITE CIRCLES:LIGHT-EMITTING STATE

FIG. 19

DIRVE MODE (A)

DRIVE MODE (B)

SELECTIVE WRITING

GRAY SCALE

LIGHT-EMISSION BRIGHTNESS

| | Ds | HD | | | | | | | | LIGHT-EMISSION DRIVE PATTERN | | | | | | | | | |
|---|---|---|---|---|---|---|---|---|---|---|---|---|---|---|---|---|---|---|---|
| | | 8 | 7 | 6 | 5 | 4 | 3 | 2 | 1 | SF 8 | SF 7 | SF 6 | SF 5 | SF 4 | SF 3 | SF 2 | SF 1 | $L_A$ | $L_B$ |
| 1 | 0000 | 0 | 0 | 0 | 0 | 0 | 0 | 0 | 0 | | | | | | | | | 0 | 0 |
| 2 | 0001 | 0 | 0 | 0 | 0 | 0 | 0 | 0 | 1 | | | | | | | | ● | 3 | 1 |
| 3 | 0010 | 0 | 0 | 0 | 0 | 0 | 0 | 1 | 0 | | | | | | | ● | ○ | 14 | 7 |
| 4 | 0011 | 0 | 0 | 0 | 0 | 0 | 1 | 0 | 0 | | | | | | ● | ○ | ○ | 34 | 23 |
| 5 | 0100 | 0 | 0 | 0 | 0 | 1 | 0 | 0 | 0 | | | | | ● | ○ | ○ | ○ | 64 | 47 |
| 6 | 0101 | 0 | 0 | 0 | 1 | 0 | 0 | 0 | 0 | | | | ● | ○ | ○ | ○ | ○ | 104 | 82 |
| 7 | 0110 | 0 | 0 | 1 | 0 | 0 | 0 | 0 | 0 | | | ● | ○ | ○ | ○ | ○ | ○ | 155 | 128 |
| 8 | 0111 | 0 | 1 | 0 | 0 | 0 | 0 | 0 | 0 | | ● | ○ | ○ | ○ | ○ | ○ | ○ | 218 | 185 |
| 9 | 1000 | 1 | 0 | 0 | 0 | 0 | 0 | 0 | 0 | ● | ○ | ○ | ○ | ○ | ○ | ○ | ○ | 255 | 255 |

BLACK CIRCLES:SELECTIVE ERASE DISCHARGE STATE
WHITE CIRCLES:LIGHT-EMITTING STATE

FIG. 23

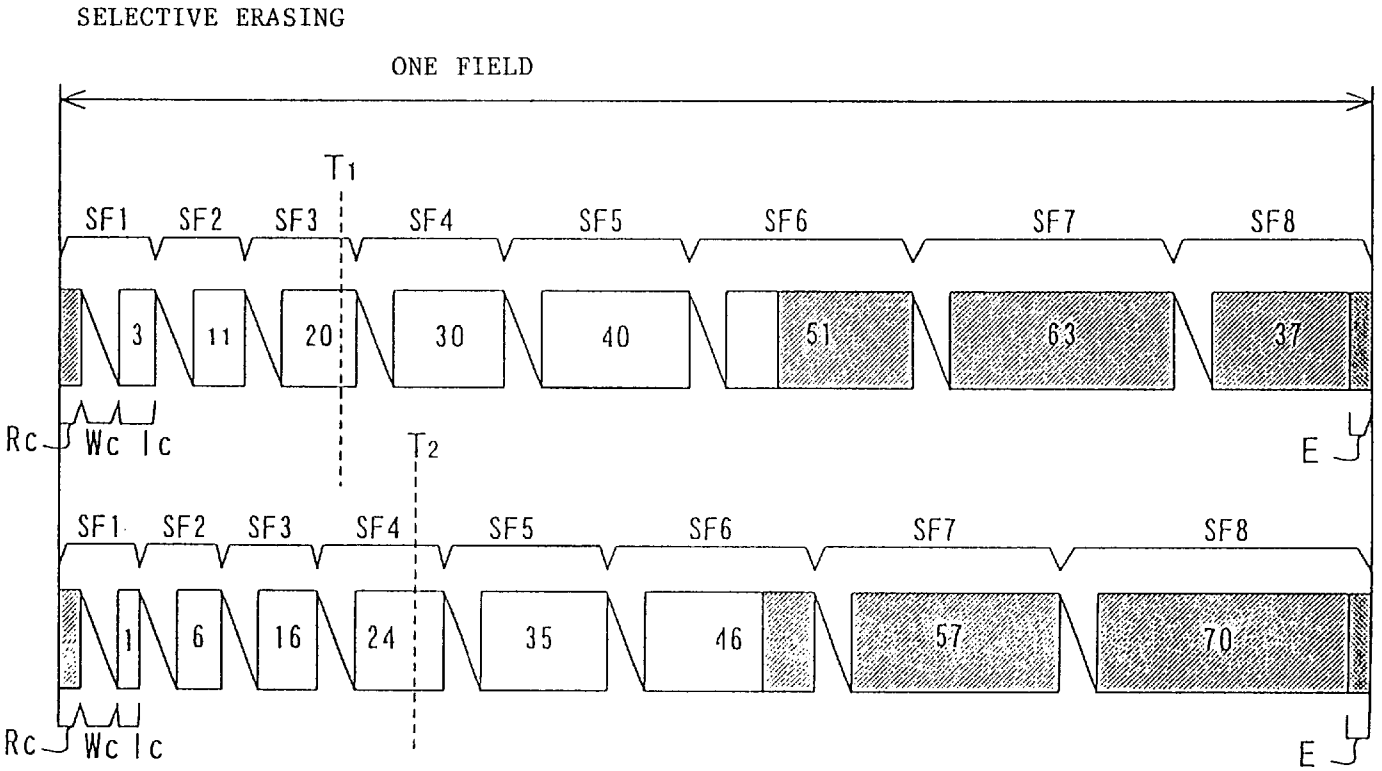
FIG. 25A DRIVE MODE (A)
FIG. 25B DRIVE MODE (B)

DRIVE MODE (A)

DRIVE MODE (B)

DRIVE MODE (A)

DRIVE MODE (B)

DRIVE MODE (A)

DRIVE MODE (B)

SELECTIVE ERASING

| Ds | HD 1 | HD 2 | HD 3 | HD 4 | HD 5 | HD 6 | HD 7 | HD 8 | LIGHT-EMISSION DRIVE PATTERN SF 1 | SF 2 | SF 3 | SF 4 | SF 5 | SF 6 | SF 7 | SF 8 | LIGHT-EMISSION BRIGHTNESS $L_A$ | $L_B$ |
|---|---|---|---|---|---|---|---|---|---|---|---|---|---|---|---|---|---|---|
| 0000 | 1 | 1 | * | * | * | * | * | * | ● | ● | △ | △ | △ | △ | △ | △ | 0 | 0 |
| 0001 | 0 | 1 | 1 | * | * | * | * | * | ○ | ● | ● | △ | △ | △ | △ | △ | 3 | 1 |
| 0010 | 0 | 0 | 1 | 1 | * | * | * | * | ○ | ○ | ● | ● | △ | △ | △ | △ | 14 | 7 |
| 0011 | 0 | 0 | 0 | 1 | 1 | * | * | * | ○ | ○ | ○ | ● | ● | △ | △ | △ | 34 | 23 |
| 0100 | 0 | 0 | 0 | 0 | 1 | 1 | * | * | ○ | ○ | ○ | ○ | ● | ● | △ | △ | 64 | 47 |
| 0101 | 0 | 0 | 0 | 0 | 0 | 1 | 1 | * | ○ | ○ | ○ | ○ | ○ | ● | ● | △ | 104 | 82 |
| 0110 | 0 | 0 | 0 | 0 | 0 | 0 | 1 | 1 | ○ | ○ | ○ | ○ | ○ | ○ | ● | ● | 155 | 128 |
| 0111 | 0 | 0 | 0 | 0 | 0 | 0 | 0 | 1 | ○ | ○ | ○ | ○ | ○ | ○ | ○ | ● | 218 | 185 |
| 1000 | 0 | 0 | 0 | 0 | 0 | 0 | 0 | 0 | ○ | ○ | ○ | ○ | ○ | ○ | ○ | ○ | 255 | 255 |

BLACK CIRCLES:SELECTIVE ERASE DISCHARGE STATE
WHITE CIRCLES:LIGHT-EMITTING STATE

FIG. 30

SELECTIVE WRITING

| Ds | HD 8 | HD 7 | HD 6 | HD 5 | HD 4 | HD 3 | HD 2 | HD 1 | LIGHT-EMISSION DRIVE PATTERN SF 8 | SF 7 | SF 6 | SF 5 | SF 4 | SF 3 | SF 2 | SF 1 | LIGHT-EMISSION BRIGHTNESS $I_A$ | $I_B$ |
|---|---|---|---|---|---|---|---|---|---|---|---|---|---|---|---|---|---|---|
| 0000 | 0 | 0 | 0 | 0 | 0 | 0 | 0 | 0 | | | | | | | | | 0 | 0 |
| 0001 | 0 | 0 | 0 | 0 | 0 | 0 | 0 | 1 | | | | | | | | ● | 3 | 1 |
| 0010 | 0 | 0 | 0 | 0 | 0 | 0 | 1 | 1 | | | | | | | ● | ● | 14 | 7 |
| 0011 | 0 | 0 | 0 | 0 | 0 | 1 | 1 | * | | | | | | ● | ● | ○ | 34 | 23 |
| 0100 | 0 | 0 | 0 | 0 | 1 | 1 | * | * | | | | | ● | ● | ○ | ○ | 64 | 47 |
| 0101 | 0 | 0 | 0 | 1 | 1 | * | * | * | | | | ● | ● | ○ | ○ | ○ | 104 | 82 |
| 0110 | 0 | 0 | 1 | 1 | * | * | * | * | | | ● | ● | ○ | ○ | ○ | ○ | 155 | 128 |
| 0111 | 0 | 1 | 1 | * | * | * | * | * | | ● | ● | ○ | ○ | ○ | ○ | ○ | 218 | 185 |
| 1000 | 1 | 1 | * | * | * | * | * | * | ● | ● | ○ | ○ | ○ | ○ | ○ | ○ | 255 | 255 |

BLACK CIRCLES: SELECTIVE ERASE DISCHARGE STATE
WHITE CIRCLES: LIGHT-EMITTING STATE

FIG. 31

| INPUT VIDEO SIGNAL | DITHER COEFFICIENT | | | |
|---|---|---|---|---|
| | a | b | c | d |
| TV SIGNAL | 0 | 1 | 2 | 3 |
| PC VIDEO SIGNAL | 0 (1) | 2 (3) | 4 (5) | 6 (7) |

FIG. 41

SELECTIVE ERASING

| GRAY SCALE | CONVERSION TABLE OF THE SECOND DATA CONVERTER 34 | | | | | | | | | | | | | LIGHT-EMISSION DRIVE PATTERN | | | | | | | | | | | | DISPLAY BRIGHTNESS | | | |
|---|---|---|---|---|---|---|---|---|---|---|---|---|---|---|---|---|---|---|---|---|---|---|---|---|---|---|---|---|---|
| | Ds | GD | | | | | | | | | | | | SF | SF | SF | SF | SF | SF | SF | SF | SF | SF | SF | SF | TV SIGNAL | | PC-VIDEO SIGNAL | |
| | | 1 | 2 | 3 | 4 | 5 | 6 | 7 | 8 | 9 | 10 | 11 | 12 | 1 | 2 | 3 | 4 | 5 | 6 | 7 | 8 | 9 | 10 | 11 | 12 | ODD | EVEN | ODD | EVEN |
| 1 | 0000 | 1 | 0 | 0 | 0 | 0 | 0 | 0 | 0 | 0 | 0 | 0 | 0 | ● | | | | | | | | | | | | 0 | 0 | 0 | 0 |
| 2 | 0001 | 0 | 1 | 0 | 0 | 0 | 0 | 0 | 0 | 0 | 0 | 0 | 0 | ○ | ● | | | | | | | | | | | 2 | 1 | 1 | 1 |
| 3 | 0010 | 0 | 0 | 1 | 0 | 0 | 0 | 0 | 0 | 0 | 0 | 0 | 0 | ○ | ○ | ● | | | | | | | | | | 4 | 3 | 3 | 3 |
| 4 | 0011 | 0 | 0 | 0 | 1 | 0 | 0 | 0 | 0 | 0 | 0 | 0 | 0 | ○ | ○ | ○ | ● | | | | | | | | | 10 | 7 | 7 | 7 |
| 5 | 0100 | 0 | 0 | 0 | 0 | 1 | 0 | 0 | 0 | 0 | 0 | 0 | 0 | ○ | ○ | ○ | ○ | ● | | | | | | | | 18 | 13 | 14 | 13 |
| 6 | 0101 | 0 | 0 | 0 | 0 | 0 | 1 | 0 | 0 | 0 | 0 | 0 | 0 | ○ | ○ | ○ | ○ | ○ | ● | | | | | | | 29 | 23 | 25 | 23 |
| 7 | 0110 | 0 | 0 | 0 | 0 | 0 | 0 | 1 | 0 | 0 | 0 | 0 | 0 | ○ | ○ | ○ | ○ | ○ | ○ | ● | | | | | | 46 | 37 | 39 | 37 |
| 8 | 0111 | 0 | 0 | 0 | 0 | 0 | 0 | 0 | 1 | 0 | 0 | 0 | 0 | ○ | ○ | ○ | ○ | ○ | ○ | ○ | ● | | | | | 68 | 56 | 59 | 56 |
| 9 | 1000 | 0 | 0 | 0 | 0 | 0 | 0 | 0 | 0 | 1 | 0 | 0 | 0 | ○ | ○ | ○ | ○ | ○ | ○ | ○ | ○ | ● | | | | 96 | 81 | 84 | 81 |
| 10 | 1001 | 0 | 0 | 0 | 0 | 0 | 0 | 0 | 0 | 0 | 1 | 0 | 0 | ○ | ○ | ○ | ○ | ○ | ○ | ○ | ○ | ○ | ● | | | 131 | 112 | 117 | 112 |
| 11 | 1010 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ● | | 174 | 151 | 157 | 151 |
| 12 | 1011 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ● | 225 | 198 | 205 | 198 |
| 13 | 1100 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | 255 | 255 | 255 | 255 |

$L_A$ $L_B$

BLACK CIRCLES:SELECTIVE ERASE DISCHARGE STATE
WHITE CIRCLES:LIGHT-EMITTING SATE

FIG. 42

FIG. 44A

ODD FIELD (A)

| LC | SF1 | SF2 | SF3 | SF4 | SF5 | SF6 | SF7 | SF8 | SF9 | SF10 | SF11 | SF12 |
|---|---|---|---|---|---|---|---|---|---|---|---|---|
| MODE 1 | 2 | 2 | 6 | 8 | 11 | 17 | 22 | 28 | 35 | 43 | 51 | 30 |
| MODE 2 | 4 | 4 | 12 | 16 | 22 | 34 | 44 | 56 | 70 | 86 | 102 | 60 |
| MODE 3 | 6 | 6 | 18 | 24 | 33 | 51 | 66 | 84 | 105 | 129 | 153 | 90 |
| MODE 4 | 8 | 8 | 24 | 32 | 44 | 68 | 88 | 112 | 140 | 172 | 203 | 120 |

FIG. 44B

EVEN FIELD (B)

| LC | SF1 | SF2 | SF3 | SF4 | SF5 | SF6 | SF7 | SF8 | SF9 | SF10 | SF11 | SF12 |
|---|---|---|---|---|---|---|---|---|---|---|---|---|
| MODE 1 | 1 | 2 | 4 | 6 | 10 | 14 | 19 | 25 | 31 | 39 | 47 | 57 |
| MODE 2 | 2 | 4 | 8 | 12 | 20 | 28 | 38 | 50 | 62 | 78 | 94 | 114 |
| MODE 3 | 3 | 6 | 12 | 18 | 30 | 42 | 57 | 75 | 93 | 117 | 141 | 171 |
| MODE 4 | 4 | 8 | 16 | 24 | 40 | 56 | 76 | 100 | 124 | 156 | 187 | 228 |

FIG. 45A

ODD FIELD (A)

| LC | SF1 | SF2 | SF3 | SF4 | SF5 | SF6 | SF7 | SF8 | SF9 | SF10 | SF11 | SF12 |
|---|---|---|---|---|---|---|---|---|---|---|---|---|
| MODE 1 | 1 | 2 | 4 | 7 | 11 | 14 | 20 | 25 | 33 | 40 | 48 | 50 |
| MODE 2 | 2 | 4 | 8 | 14 | 22 | 28 | 40 | 50 | 66 | 80 | 96 | 100 |
| MODE 3 | 3 | 6 | 12 | 21 | 33 | 42 | 60 | 75 | 99 | 120 | 144 | 150 |
| MODE 4 | 4 | 8 | 16 | 28 | 44 | 56 | 80 | 100 | 132 | 160 | 192 | 200 |

FIG. 45B

EVEN FIELD (B)

| LC | SF1 | SF2 | SF3 | SF4 | SF5 | SF6 | SF7 | SF8 | SF9 | SF10 | SF11 | SF12 |
|---|---|---|---|---|---|---|---|---|---|---|---|---|
| MODE 1 | 1 | 2 | 4 | 6 | 10 | 14 | 19 | 25 | 31 | 39 | 47 | 57 |
| MODE 2 | 2 | 4 | 8 | 12 | 20 | 28 | 38 | 50 | 62 | 78 | 94 | 114 |
| MODE 3 | 3 | 6 | 12 | 18 | 30 | 42 | 57 | 75 | 93 | 117 | 141 | 171 |
| MODE 4 | 4 | 8 | 16 | 24 | 40 | 56 | 76 | 100 | 124 | 156 | 188 | 228 |

ODD FIELD (A)

EVEN FIELD (B)

ODD FIELD (A)

EVEN FIELD (B)

ODD FIELD (A)

EVEN FIELD (B)

ODD FILED (A)

EVEN FIELD (B)

SELECTIVE WRITING

GRAY SCALE

| | CONVERSION TABLE OF THE SECOND DATA CONVERTER 34 | | | | | | | | | | | | | LIGHT-EMISSION DRIVE PATTERN | | | | | | | | | | | | DISPLAY BRIGHTNESS | | | |
|---|---|---|---|---|---|---|---|---|---|---|---|---|---|---|---|---|---|---|---|---|---|---|---|---|---|---|---|---|---|
| | Ds | GD | | | | | | | | | | | | SF 12 | SF 11 | SF 10 | SF 9 | SF 8 | SF 7 | SF 6 | SF 5 | SF 4 | SF 3 | SF 2 | SF 1 | TV SIGNAL | | PC VIDEO SIGNAL | |
| | | 12 | 11 | 10 | 9 | 8 | 7 | 6 | 5 | 4 | 3 | 2 | 1 | | | | | | | | | | | | | ODD | EVEN | ODD | EVEN |
| 1 | 0000 | 0 | 0 | 0 | 0 | 0 | 0 | 0 | 0 | 0 | 0 | 0 | 0 | | | | | | | | | | | | | 0 | 0 | 0 | 0 |
| 2 | 0001 | 0 | 0 | 0 | 0 | 0 | 0 | 0 | 0 | 0 | 0 | 0 | 1 | | | | | | | | | | | | ● | 2 | 1 | 1 | 1 |
| 3 | 0010 | 0 | 0 | 0 | 0 | 0 | 0 | 0 | 0 | 0 | 0 | 1 | 0 | | | | | | | | | | | ● | ○ | 4 | 3 | 3 | 3 |
| 4 | 0011 | 0 | 0 | 0 | 0 | 0 | 0 | 0 | 0 | 0 | 1 | 0 | 0 | | | | | | | | | | ● | ○ | ○ | 10 | 7 | 7 | 7 |
| 5 | 0100 | 0 | 0 | 0 | 0 | 0 | 0 | 0 | 0 | 1 | 0 | 0 | 0 | | | | | | | | | ● | ○ | ○ | ○ | 18 | 13 | 14 | 13 |
| 6 | 0101 | 0 | 0 | 0 | 0 | 0 | 0 | 0 | 1 | 0 | 0 | 0 | 0 | | | | | | | | ● | ○ | ○ | ○ | ○ | 29 | 23 | 25 | 23 |
| 7 | 0110 | 0 | 0 | 0 | 0 | 0 | 0 | 1 | 0 | 0 | 0 | 0 | 0 | | | | | | | ● | ○ | ○ | ○ | ○ | ○ | 46 | 37 | 39 | 37 |
| 8 | 0111 | 0 | 0 | 0 | 0 | 0 | 1 | 0 | 0 | 0 | 0 | 0 | 0 | | | | | | ● | ○ | ○ | ○ | ○ | ○ | ○ | 68 | 56 | 59 | 56 |
| 9 | 1000 | 0 | 0 | 0 | 0 | 1 | 0 | 0 | 0 | 0 | 0 | 0 | 0 | | | | | ● | ○ | ○ | ○ | ○ | ○ | ○ | ○ | 96 | 81 | 84 | 81 |
| 10 | 1001 | 0 | 0 | 0 | 1 | 0 | 0 | 0 | 0 | 0 | 0 | 0 | 0 | | | | ● | ○ | ○ | ○ | ○ | ○ | ○ | ○ | ○ | 131 | 112 | 117 | 112 |
| 11 | 1010 | 0 | 0 | 1 | 0 | 0 | 0 | 0 | 0 | 0 | 0 | 0 | 0 | | | ● | ○ | ○ | ○ | ○ | ○ | ○ | ○ | ○ | ○ | 174 | 151 | 157 | 151 |
| 12 | 1011 | 0 | 1 | 0 | 0 | 0 | 0 | 0 | 0 | 0 | 0 | 0 | 0 | | ● | ○ | ○ | ○ | ○ | ○ | ○ | ○ | ○ | ○ | ○ | 225 | 198 | 205 | 198 |
| 13 | 1100 | 1 | 0 | 0 | 0 | 0 | 0 | 0 | 0 | 0 | 0 | 0 | 0 | ● | ○ | ○ | ○ | ○ | ○ | ○ | ○ | ○ | ○ | ○ | ○ | 255 | 255 | 255 | 255 |

$L_A$ $L_B$ $L_A$ $L_B$

BLACK CIRCLES: SELECTIVE WRITE DISCHARGE (LIGHT-EMITTING STATE)

WHITE CIRCLES: LIGHT-EMITTING SF

FIG. 55

SELECTIVE ERASING

| GRAY SCALE | CONVERSION TABLE OF THE SECOND DATA CONVERTER 34 | | | | | | | | | | | | | LIGHT-EMISSION DRIVE PATTERN | | | | | | | | | | | | DISPLAY BRIGHTNESS | | | |
|---|---|---|---|---|---|---|---|---|---|---|---|---|---|---|---|---|---|---|---|---|---|---|---|---|---|---|---|---|---|
| | Ds | GD | | | | | | | | | | | | SF | SF | SF | SF | SF | SF | SF | SF | SF | SF | SF | SF | TV SIGNAL | | PC VIDEO SIGNAL | |
| | | 1 | 2 | 3 | 4 | 5 | 6 | 7 | 8 | 9 | 10 | 11 | 12 | 1 | 2 | 3 | 4 | 5 | 6 | 7 | 8 | 9 | 10 | 11 | 12 | ODD | EVEN | ODD | EVEN |
| 1 | 0000 | 1 | 1 | * | * | * | * | * | * | * | * | * | * | ● | ● | △ | △ | △ | △ | △ | △ | △ | △ | △ | △ | 0 | 0 | 0 | 0 |
| 2 | 0001 | 0 | 1 | 1 | * | * | * | * | * | * | * | * | * | ○ | ● | ● | △ | △ | △ | △ | △ | △ | △ | △ | △ | 2 | 1 | 1 | 1 |
| 3 | 0010 | 0 | 0 | 1 | 1 | * | * | * | * | * | * | * | * | ○ | ○ | ● | ● | △ | △ | △ | △ | △ | △ | △ | △ | 4 | 3 | 3 | 3 |
| 4 | 0011 | 0 | 0 | 0 | 1 | 1 | * | * | * | * | * | * | * | ○ | ○ | ○ | ● | ● | △ | △ | △ | △ | △ | △ | △ | 10 | 7 | 7 | 7 |
| 5 | 0100 | 0 | 0 | 0 | 0 | 1 | 1 | * | * | * | * | * | * | ○ | ○ | ○ | ○ | ● | ● | △ | △ | △ | △ | △ | △ | 18 | 13 | 14 | 13 |
| 6 | 0101 | 0 | 0 | 0 | 0 | 0 | 1 | 1 | * | * | * | * | * | ○ | ○ | ○ | ○ | ○ | ● | ● | △ | △ | △ | △ | △ | 29 | 23 | 25 | 23 |
| 7 | 0110 | 0 | 0 | 0 | 0 | 0 | 0 | 1 | 1 | * | * | * | * | ○ | ○ | ○ | ○ | ○ | ○ | ● | ● | △ | △ | △ | △ | 46 | 37 | 39 | 37 |
| 8 | 0111 | 0 | 0 | 0 | 0 | 0 | 0 | 0 | 1 | 1 | * | * | * | ○ | ○ | ○ | ○ | ○ | ○ | ○ | ● | ● | △ | △ | △ | 68 | 56 | 59 | 56 |
| 9 | 1000 | 0 | 0 | 0 | 0 | 0 | 0 | 0 | 0 | 1 | 1 | * | * | ○ | ○ | ○ | ○ | ○ | ○ | ○ | ○ | ● | ● | △ | △ | 96 | 81 | 84 | 81 |
| 10 | 1001 | 0 | 0 | 0 | 0 | 0 | 0 | 0 | 0 | 0 | 1 | 1 | * | ○ | ○ | ○ | ○ | ○ | ○ | ○ | ○ | ○ | ● | ● | △ | 131 | 112 | 117 | 112 |
| 11 | 1010 | 0 | 0 | 0 | 0 | 0 | 0 | 0 | 0 | 0 | 0 | 1 | 1 | ○ | ○ | ○ | ○ | ○ | ○ | ○ | ○ | ○ | ○ | ● | ● | 174 | 151 | 157 | 151 |
| 12 | 1011 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ● | 225 | 198 | 205 | 198 |
| 13 | 1100 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | 255 | 255 | 255 | 255 |

$L_A$ $L_B$ $L_A$ $L_B$

BLACK CIRCLES:SELECTIVE ERASE DISCHARGE STATE
WHITE CIRCLES:LIGHT-EMITTING SF

FIG.56

SELECTIVE WRITING

GRAY SCALE

| | CONVERSION TABLE OF THE SECOND DATA CONVERTER 34 | | | | | | | | | | | | | LIGHT-EMISSION DRIVE PATTERN | | | | | | | | | | | | DISPLAY BRIGHTNESS | | | |
|---|---|---|---|---|---|---|---|---|---|---|---|---|---|---|---|---|---|---|---|---|---|---|---|---|---|---|---|---|---|
| | | | | | | | | | | | | | | | | | | | | | | | | | | TV SIGNAL | | PC VIDEO SIGNAL | |
| | Ds | GD | | | | | | | | | | | | SF | SF | SF | SF | SF | SF | SF | SF | SF | SF | SF | SF | ODD | EVEN | ODD | EVEN |
| | | 12 | 11 | 10 | 9 | 8 | 7 | 6 | 5 | 4 | 3 | 2 | 1 | 12 | 11 | 10 | 9 | 8 | 7 | 6 | 5 | 4 | 3 | 2 | 1 | | | | |
| 1 | 0000 | 0 | 0 | 0 | 0 | 0 | 0 | 0 | 0 | 0 | 0 | 0 | 0 | | | | | | | | | | | | | 0 | 0 | 0 | 0 |
| 2 | 0001 | 0 | 0 | 0 | 0 | 0 | 0 | 0 | 0 | 0 | 0 | 0 | 1 | | | | | | | | | | | | ● | 2 | 1 | 1 | 1 |
| 3 | 0010 | 0 | 0 | 0 | 0 | 0 | 0 | 0 | 0 | 0 | 0 | 1 | 1 | | | | | | | | | | | ● | ● | 4 | 3 | 3 | 3 |
| 4 | 0011 | 0 | 0 | 0 | 0 | 0 | 0 | 0 | 0 | 0 | 1 | 1 | * | | | | | | | | | | ● | ● | ▽ | 10 | 7 | 7 | 7 |
| 5 | 0100 | 0 | 0 | 0 | 0 | 0 | 0 | 0 | 0 | 1 | 1 | * | * | | | | | | | | | ● | ● | ▽ | ▽ | 18 | 13 | 14 | 13 |
| 6 | 0101 | 0 | 0 | 0 | 0 | 0 | 0 | 0 | 1 | 1 | * | * | * | | | | | | | | ● | ● | ▽ | ▽ | ▽ | 29 | 23 | 25 | 23 |
| 7 | 0110 | 0 | 0 | 0 | 0 | 0 | 0 | 1 | 1 | * | * | * | * | | | | | | | ● | ● | ▽ | ▽ | ▽ | ▽ | 46 | 37 | 39 | 37 |
| 8 | 0111 | 0 | 0 | 0 | 0 | 0 | 1 | 1 | * | * | * | * | * | | | | | | ● | ● | ▽ | ▽ | ▽ | ▽ | ▽ | 68 | 56 | 59 | 56 |
| 9 | 1000 | 0 | 0 | 0 | 0 | 1 | 1 | * | * | * | * | * | * | | | | | ● | ● | ▽ | ▽ | ▽ | ▽ | ▽ | ▽ | 96 | 81 | 84 | 81 |
| 10 | 1001 | 0 | 0 | 0 | 1 | 1 | * | * | * | * | * | * | * | | | | ● | ● | ▽ | ▽ | ▽ | ▽ | ▽ | ▽ | ▽ | 131 | 112 | 117 | 112 |
| 11 | 1010 | 0 | 0 | 1 | 1 | * | * | * | * | * | * | * | * | | | ● | ● | ▽ | ▽ | ▽ | ▽ | ▽ | ▽ | ▽ | ▽ | 174 | 151 | 157 | 151 |
| 12 | 1011 | 0 | 1 | 1 | * | * | * | * | * | * | * | * | * | | ● | ● | ▽ | ▽ | ▽ | ▽ | ▽ | ▽ | ▽ | ▽ | ▽ | 225 | 198 | 205 | 198 |
| 13 | 1100 | 1 | 1 | * | * | * | * | * | * | * | * | * | * | ● | ● | ▽ | ▽ | ▽ | ▽ | ▽ | ▽ | ▽ | ▽ | ▽ | ▽ | 255 | 255 | 255 | 255 |

$L_A$ $L_B$ $L_A$ $L_B$

BLACK CIRCLES:SELECTIVE WRITE DISCHARGE STATE
WHITE CIRCLES:LIGHT EMITTING SF

FIG.57

METHOD FOR DRIVING A PLASMA DISPLAY PANEL

BACKGROUND OF THE INVENTION

1. Field of the Invention

The present invention relates to a method for driving a plasma display panel (hereinafter designated "PDP") which employs a matrix display scheme.

2. Description of Related Art

As a type of PDP employing such a matrix display scheme, known is an AC (alternating current discharge) type PDP.

The AC type PDP comprises a plurality of column electrodes (address electrodes) and a plurality of row electrodes that are orthogonal to the column electrodes, and a pair of row electrodes form a scan line. Each of these row and column electrodes is coated with a dielectric layer exposed to a discharge space, and the intersection of a row electrode and a column electrode defines a discharge cell corresponding to one pixel.

With this construction, PDP operates by discharge phenomenon and thus the aforementioned discharge cell has only two states, that is, a "light-emitting" state and a "non-light-emitting" state. Accordingly, in order to implement a brightness display of a halftone with such PDP, a sub-field method is employed. According to the sub-field method, the display period of one field is divided into N sub-fields. Then, each of the sub-fields is assigned with a light emitting period (the number of light emissions) having a length of time corresponding to the weight assigned to each bit digit of pixel data (N bits) for light-emission.

For example, as shown in FIG. 1, in the case where one field period is divided into 6 sub-fields, SF1 to SF6, light is emitted by the following ratio of light emission periods. That is,

SF1: 1

SF2: 2

SF3: 4

SF4: 8

SF5: 16

SF6: 32

As shown in FIG. 1, when the discharge cell is to emit light at brightness "32" only SF6 of sub-fields SF1 to SF6 is allowed for emitting light. On the other hand, for light emission at brightness "31", sub-fields SF1 to SF5, except for sub-field SF6, are caused to emit light. This enables an expression of brightness with 64 levels of halftone.

As is evident from the sequence in FIG. 1, the number of sub-fields may be increased to increase the number of levels of halftone.

However, a pixel data writing step is required for selecting light-emitting cells within one sub-field. Thus, an increase in the number of sub-fields would lead to an increase in the number of repetitions of the pixel data writing step that should be performed in one field. This causes the time assigned to the light-emission period (the length of time of the light-emission sustaining step) in one field period to become relatively short, thereby causing a decrease in brightness.

Therefore, it is necessary to perform multi-level gray scale processing in a specified manner for a video signal itself in order to implement a video display such as a television video image display by means of PDP. For example, as a scheme for multi-level gray scale processing, error diffusion processing is well known. The error diffusion processing is a method that adds an error between the pixel data corresponding to a pixel (a discharge cell) and a predetermined threshold value to the pixel data corresponding to a peripheral pixel in order to increase the number of levels of halftone in an apparent manner.

However, the fewer the number of levels of halftone, the greater the patterns of error diffusion become conspicuous, thereby presenting a problem in reducing the S/N ratio.

OBJECT AND SUMMARY OF THE INVENTION

The present invention has been developed to solve the aforementioned problem. An object of the present invention is to provide a method for driving a plasma display panel that can provide an improved display quality and an improved gray scale expression.

The method for driving a plasma display panel, according to the present invention, is a method wherein discharge cells are formed corresponding to pixels at respective intersections between a plurality of row electrodes disposed in an array for respective scan lines and a plurality of column electrodes disposed in an array crossing said row electrodes. The method comprises the steps of executing, in each of N (N being a natural number) sub-fields constituting a display period of one field, a pixel data writing step for setting said discharge cells to either one of non-light-emitting cells or light-emitting cells in response to pixel data, and a light-emission sustaining step for allowing only said light-emitting cells to emit light only during a light-emission period corresponding to each of weights assigned to said sub-fields respectively, wherein the light-emission period in the light-emission sustaining step of each of the sub-fields is changed field by field or frame by frame.

The method for driving a plasma display panel, according to another aspect of the present invention, is a method wherein discharge cells are formed corresponding to pixels at respective intersections between a plurality of row electrodes disposed in an array for respective scan lines and a plurality of column electrodes disposed in an array crossing said row electrodes. The method has a light-emission drive sequence of executing a pixel data writing step for setting, in each of N (N bing a natural number) divided display periods constituting a unit display period, the respective discharge cells to either one of non-light-emitting cells or light-emitting cells in response to N-bit display drive pixel data obtained by applying the multi-level gray-scale processing to input video signal in the respective divided display periods, and executing a light-emission sustaining step for allowing only said light-emitting cells to emit light only by the number of times corresponding to weights assigned to said respective divided display periods. The light-emission drive sequence comprises a first drive pattern carried out by alternating, at intervals of the unit display period, first and second light-emission drive sequences which have the ratios of the number of times of light-emissions different from each other in the light-emission sustaining step of each of the N divided display periods, and a second drive pattern carried out by alternating, at intervals of the unit display period, third and fourth light-emission drive sequences which have said ratios of the number of times of light-emissions different from each other in the light-emission sustaining step of each of the N divided display periods. The first drive pattern and the second drive pattern are selectively executed in accordance with the type of said input video signal.

BRIEF DESCRIPTION OF THE DRAWINGS

FIGS. 9A and 9B are views showing the correspondence between the brightness mode and the period of light-emission performed at each sub-field.

FIG. 13 is a conversion table in accordance with the conversion characteristics shown in FIG. 11 and FIG. 12.

FIG. 14 is a conversion table in accordance with the conversion characteristics shown in FIG. 11 and FIG. 12.

FIG. 19 is a view showing all patterns of light-emission drive to be performed in accordance with the light-emission drive format shown in FIGS. 4A and 4B, and an example of a conversion table to be used by a second data converter 34 for performing this light-emission drive.

FIG. 23 is a view showing all patterns of light-emission drive to be performed when the selective write addressing method is employed, and an example of a conversion table to be used by a second data converter 34 for performing this light-emission drive.

FIGS. 25A and 25B are explanatory views showing a displacement of the center of gravity of light-emission caused by the light-emission drive in respective drive modes (A) and (B).

FIG. 30 is a view showing another example of a light-emission drive pattern when a selective erase addressing method is employed.

FIG. 31 is a view showing another example of a light-emission drive pattern when the selective write addressing method is employed.

FIG. 41 is a view showing respective values of dither coefficients a to d for each type of input video signal.

FIG. 42 shows a conversion table of a second data converter 304, and the light-emission drive pattern and display brightness which are provided by the display drive pixel data GD obtained by the conversion table.

FIGS. 44A and 44B are views showing the correspondence between each of the brightness modes and the number of times of application of sustain pulse IP at each of the light-emission sustaining stepes Ic in each of the sub-fields SF1 to SF12 when TV signals are designated as input.

FIGS. 45A and 45B are views showing the correspondence between each of the brightness modes and the number of times of application of sustain pulse IP at each of the light-emission sustaining stepes Ic in each of sub-fields SF1 to SF12 when PC video signals are designated as input.

FIG. 55 shows a conversion table of a second data converter 304 used when the selective write addressing method is employed, and the light-emission drive pattern and display brightness which are provided by the display drive pixel data GD obtained by the conversion table.

FIG. 56 shows an example of a conversion table of a second data converter 304 used when the selective erase addressing method is employed, and the light-emission drive pattern and display brightness which are provided by the display drive pixel data GD obtained by the conversion table.

FIG. 57 shows an example of a conversion table of a second data converter 304 used when the selective write addressing method is employed, and the light-emission drive pattern and display brightness which are provided by the display drive pixel data GD obtained by the conversion table.

DETAILED DESCRIPTION OF THE PREFERRED EMBODIMENTS

The embodiments of the present invention will be explained below with reference to the drawings.

Figure 1:
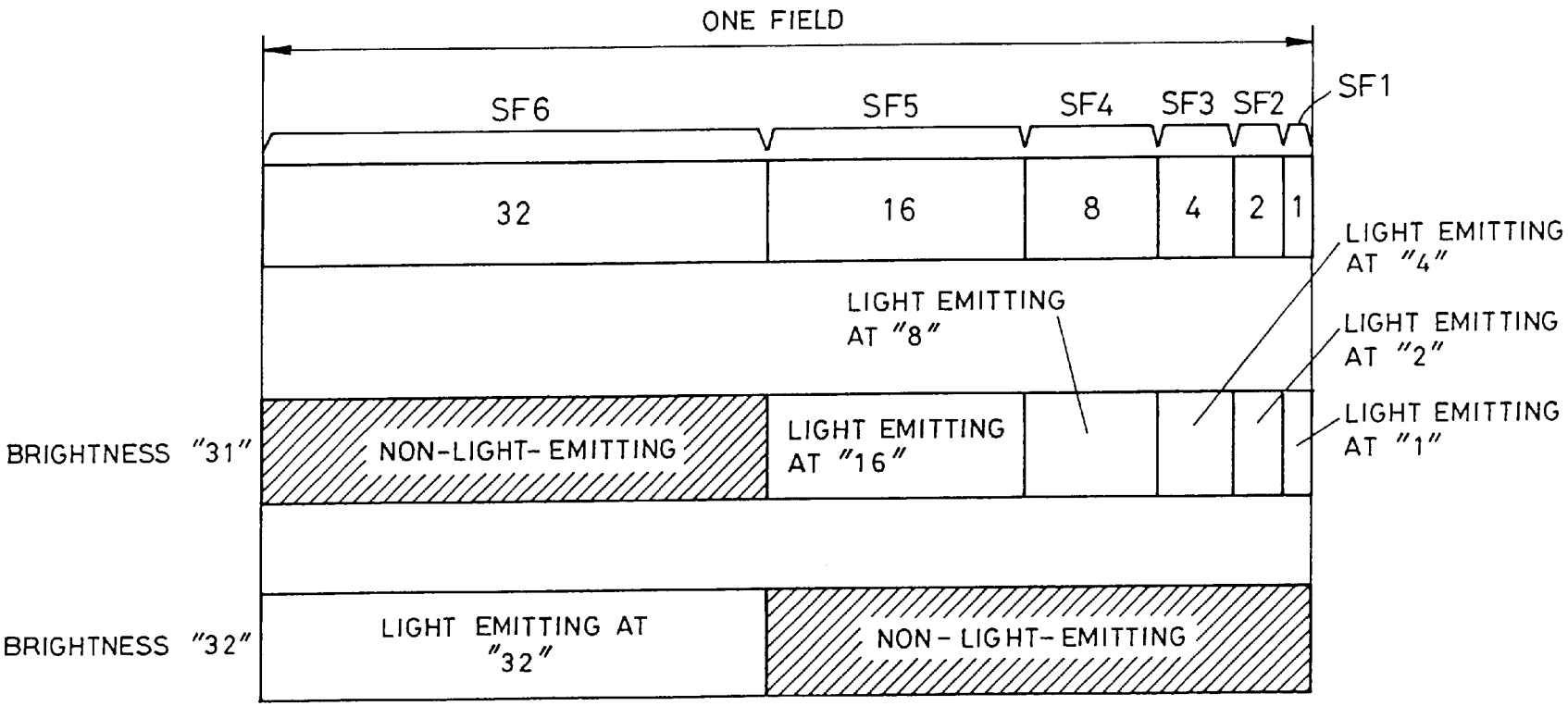
FIG. 1 PRIOR ART
FIG. 1 is a view showing a conventional light-emission drive format for implementing a display with 64 levels of halftone.
Figure 2:
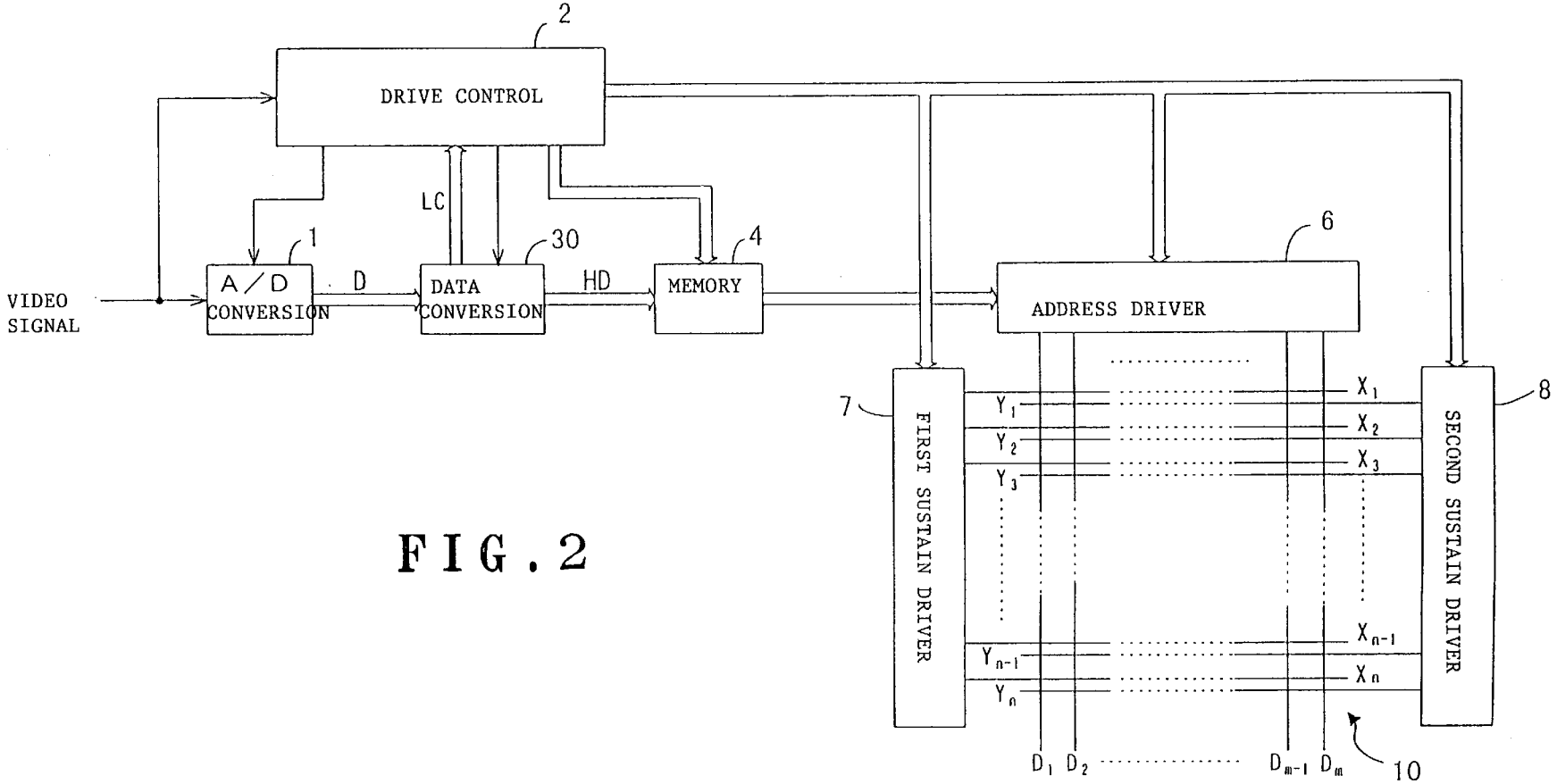
FIG. 2 is a view showing the general configuration of a plasma display device for driving a plasma display panel in accordance with the drive method of the present invention.

FIG. 2 is a view showing the general configuration of a plasma display device for driving a plasma display panel (hereinafter designated "PDP") to allow it to emit light in accordance with the drive method of the first embodiment of the present invention.

Referring to FIG. 2, an A/D converter 1 samples an analog input video signal in response to a clock signal supplied by the drive control circuit 2 to convert the video signal into, for example, 8-bit pixel data (input pixel data) D for each pixel. Then the data is supplied to the data converter 30.

The drive control circuit 2 generates clock signals for the aforementioned A/D converter 1 and write/read signals for the memory 4 in synchronization with the horizontal and vertical synchronizing signals included in the aforementioned input video signal. Furthermore, the drive control circuit 2 generates various timing signals for controllably driving each of an address driver 6, a first sustain driver 7, and a second sustain driver 8 in synchronization with the horizontal and vertical synchronizing signals.

The data converter 30 converts the 8-bit pixel data D into 8-bit converted pixel data (display pixel data) HD which is in turn supplied to the memory 4. Incidentally, the conversion operation of the data converter 30 is to be described later.

The memory 4 performs writing sequentially the converted pixel data HD mentioned above in accordance with write signals supplied by the drive control circuit 2. After data for one screen (n rows and m columns) has been written through the write operation, the memory 4 divides the converted pixel data $HD_{11\text{-}nm}$ for one screen into each bit digit for reading, which is in turn supplied sequentially to the addressing driver 6 for each one line.

The addressing driver 6 generates, in accordance with a timing signal supplied by the drive control circuit 2, m pulses of pixel data having voltages corresponding to respective logic levels of the converted pixel data bits for a line which are read from the memory 4. These pulses are applied to column electrodes $D_1$ to $D_m$ of PDP 10, respectively.

The PDP 10 comprises the aforementioned column electrodes $D_1$ to $D_m$ as address electrodes, and row electrodes $X_1$ to $X_n$ and row electrodes $Y_1$ to $Y_n$, which are disposed orthogonal to the column electrodes. The PDP 10 allows a pair of a row electrode X and a row electrode Y to form a row electrode corresponding to one line. That is, in the PDP 10, the row electrode pair of the first line consists of row electrodes $X_1$ and $Y_1$ and the row electrode pair of the nth line consists of row electrodes $X_n$ and $Y_n$. The aforementioned pairs of row electrodes and column electrodes are coated with a dielectric layer exposed to a discharge space, and each row electrode pair and column electrode are configured so as to form a discharge cell corresponding to one pixel at their intersection.

In accordance with a timing signal supplied by the drive control circuit 2, the first and second sustain drivers 7 and 8 generate the various drive pulses, respectively, which are to be explained below. These pulses are in turn applied to the row electrodes $X_1$ to $X_n$ and $Y_1$ to $Y_n$ of the PDP 10.

Figure 3:
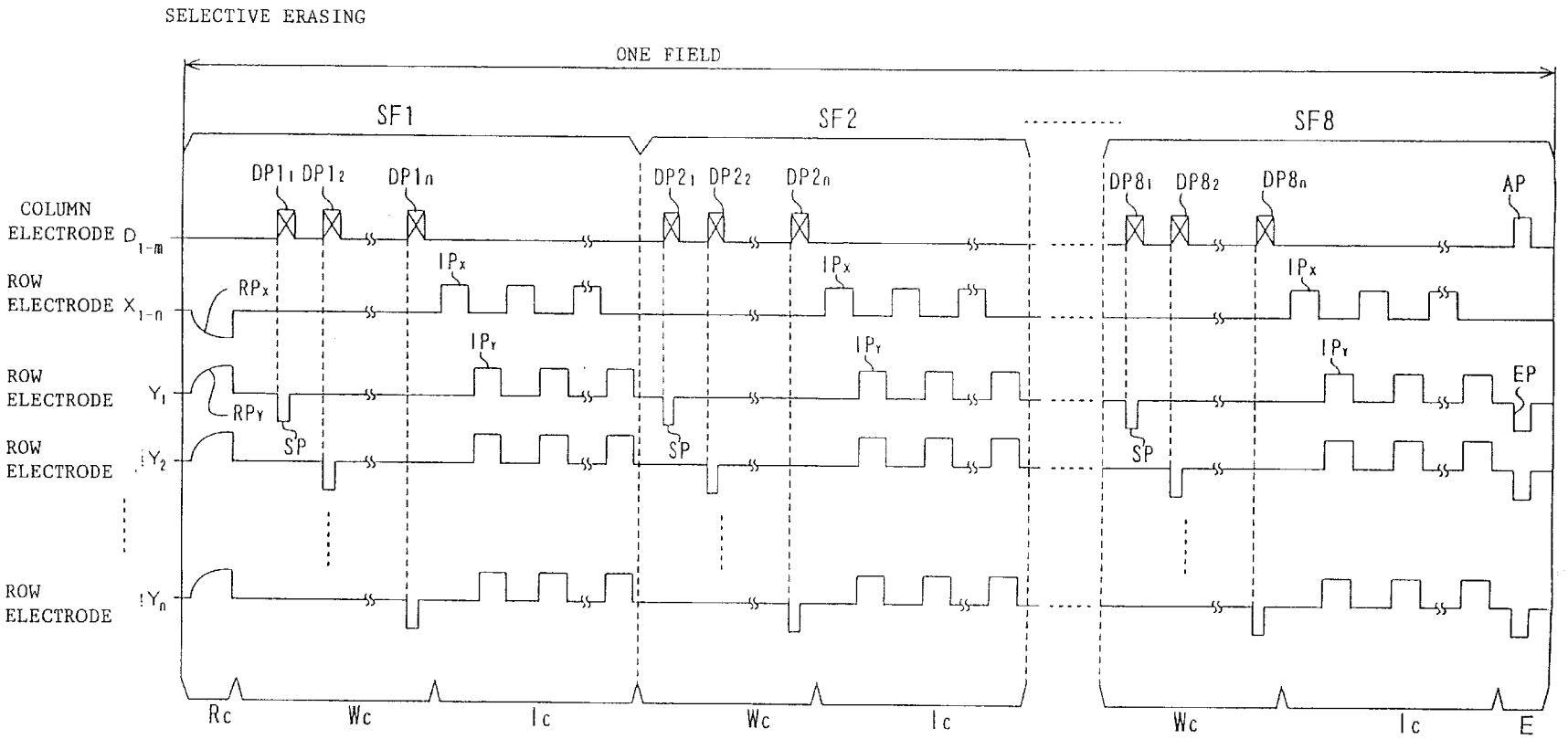
FIG. 3 is a view showing an example of an application timing of various drive pulses to be applied to PDP 10.

FIG. 3 is a view showing the application timing of various drive pulses which are applied to the column electrodes $D_1$ to $D_m$, and the row electrodes $X_1$ to $X_n$ and $Y_1$ to $Y_n$ by the aforementioned address driver 6, and the first and second sustain drivers 7 and 8, respectively.

In the example shown in FIG. 3, a display period of one field is divided into 8 sub-fields SF1 to SF8 to drive the PDP 10. In each of the sub-fields, the pixel data writing step Wc is performed to write pixel data to each discharge cell of the cells. The light-emission sustaining step Ic is also performed in each of the sub-fields to sustain light-emission of only light-emitting cells mentioned above for a period (the number of times) corresponding to the weight assigned to each sub-field. Additionally, only in the head sub-field SF1, the simultaneous reset process Rc for initializing all discharge cells of the PDP 10 is performed and the erase process E is executed only in the last sub-field SF8.

First, in the aforementioned simultaneous reset process Rc, the first and second sustain drivers 7 and 8 apply simultaneously the reset pulses $RP_X$ and $RP_Y$ shown in FIG. 3 to the row electrodes $X_1$ to $X_n$ and $Y_1$ to $Y_n$ of the PDP 10, respectively. The application of these reset pulses $RP_x$ and $RP_Y$ will cause all discharge cells of the PDP 10 to be reset and discharge, forming a predetermined uniform wall charge in each of the discharge cells. This will set all discharge cells of the PDP 10 to the aforementioned light-emitting cells.

Next, in each pixel data writing step Wc of FIG. 3, the address driver 6 applies sequentially pixel data pulse groups $DP1_{1-n}$, $DP2_{1-n}$, $DP3_{1-n}$, $DP1_{1-n}$ . . . $DP8_{1-n}$ for respective lines to the column electrodes $D_1$ to $D_m$ as shown in FIG. 3. That is, in the sub-field SF1, the address driver 6 applies sequentially a pixel data pulse group $DP1_{1-n}$ to the column electrodes $D_1$ to $D_m$ for each one of the lines to the column electrodes $D_1$ to $D_m$ as shown in FIG. 3. Said pixel data pulse group $DP1_{1-n}$ corresponds to each of the first to the nth line and is generated in accordance with the first bit of each of the aforementioned converted pixel data $HD_{11-n}$. Moreover, in the sub-field SF2, the address driver 6 applies sequentially a pixel data pulse group $DP2_{1-n}$ to the column electrodes $D_1$ to $D_m$ for each one of the lines to the column electrodes $D_1$ to $D_m$ as shown in FIG. 3, said pixel data pulse group $DP2_{1-n}$ being generated in accordance with the second bit of each of the aforementioned converted pixel data $HD_{11-nm}$. At this time, the address driver 6 generates high-tension pixel data pulses to apply them to the column electrodes D only when the bit logic of the converted pixel data is, for example, a logic level of "1". The second sustain driver 8 generates the scan pulses SP shown in FIG. 3 to apply them in sequence to the row electrodes $Y_1$ to $Y_n$ at the same time as the application timing of each of the pixel data pulse groups. At this time, discharge (selective erase discharge) is caused only at the discharge cells located at the intersections of the "lines" to which the scan pulse SP is applied and the "columns" to which a high-tension pixel data pulse is applied. The wall charges remaining within the discharge cells are selectively erased. The selective erasing discharge causes the discharge cells that have been initialized into the light-emitting status at the aforementioned simultaneous reset process Rc to change to the non-light-emitting state. Incidentally, no discharge is generated in the discharge cells that are formed in the "columns" to which the aforementioned high-tension pixel data pulse has not been applied but to the state of being initialized at the aforementioned simultaneous reset process Rc, that is, the light-emitting state is sustained.

That is, the pixel data writing step Wc is performed so that the light-emitting cells where the light-emitting state is sustained at the light-emitting sustain process to be described later and the non-light-emitting cells where an off state remains are set alternatively in accordance with pixel data. That is, pixel data is written to each of the discharge cells.

In each light-emission sustaining step Ic shown in FIG. 3, the first and second sustain drivers 7 and 8 apply the sustain pulses $IP_X$ and $IP_Y$ to the row electrodes $X_1$ to $X_n$ and $Y_1$ to $Y_n$ as shown in FIG. 3. At this time, the discharge cells where wall charges remain by the aforementioned pixel data writing step Wc, that is, the light-emitting cells repeat discharge and light-emission to sustain their light-emitting state over the period of application of the sustain pulses $IP_X$ and $IP_Y$ thereto. The light-emission sustaining period (the number of times) is set corresponding to the weight assigned to each sub-field.

Figure 4:
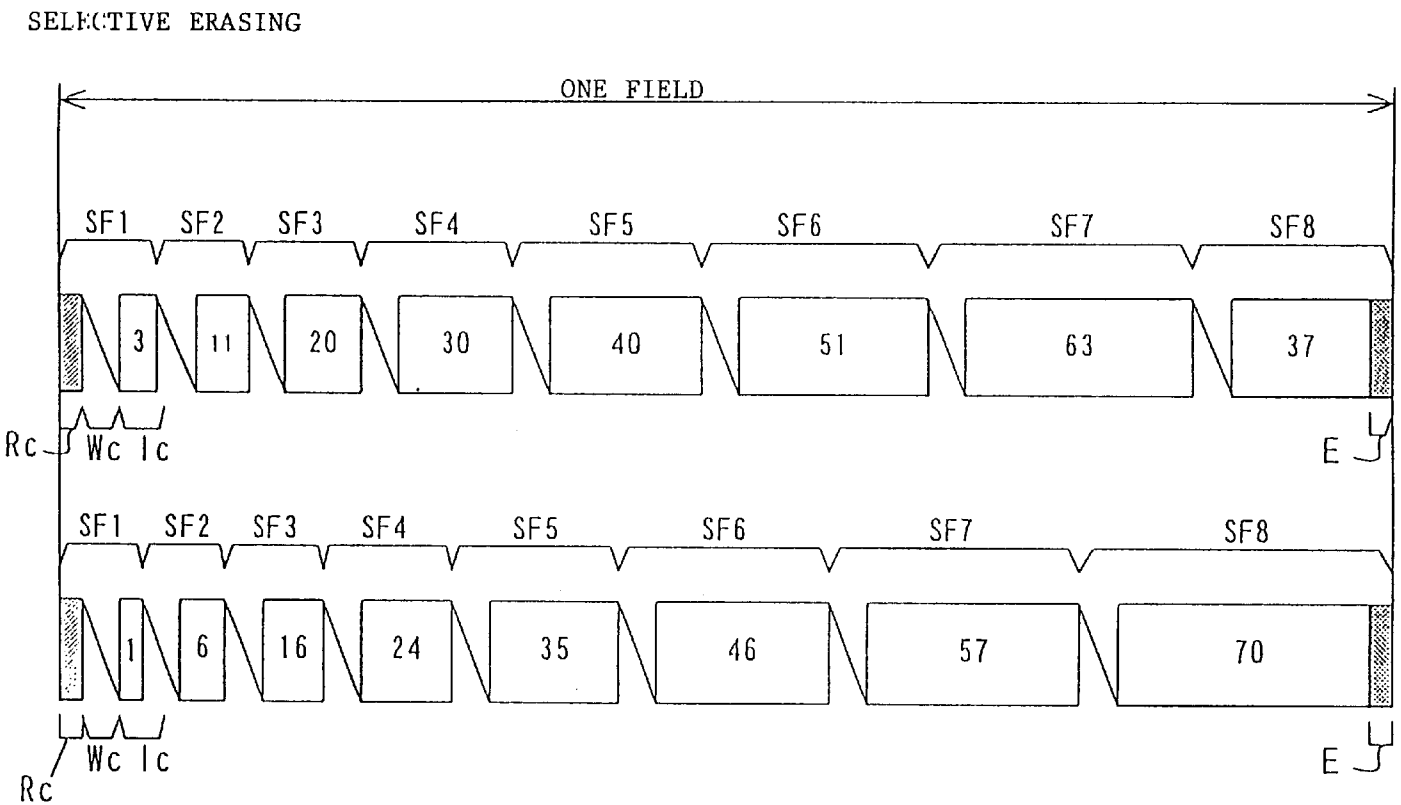
FIGS. 4A and 4B are views showing a light-emission drive format in accordance with the drive method of the present invention.

FIGS. 4A and 4B are views showing light-emission drive formats in which a light-emission sustaining period (the number of times) for each of the sub-fields is described.

Incidentally, the drive mode (A) of FIG. 4A is employed, for example, in light-emission drive of even fields (or even frames), while the drive mode (B) of FIG. 4B is employed in light-emission drive of odd fields (or odd frames). light-emission drive of odd fields (or odd frames).

That is, in the display period of an even field, the light-emitting period in the light-emission sustaining step Ic of each of the sub-fields SF1 to SF8 is set as follows as shown in the drive mode (A):

SF1: 3
SF2: 11
SF3: 20
SF4: 30
SF5: 40
SF6: 51
SF7: 63
SF8: 37

In the display period of an odd field, the light-emitting period in the light-emission sustaining step Ic of each of the sub-fields SF1 to SF8 is set as follows as shown in the drive mode (B):

SF1: 1
SF2: 6
SF3: 16
SF4: 24
SF5: 35
SF6: 46
SF7: 57
SF8: 70

In the foregoing, the ratio of the light-emission period in each of the sub-fields SF1 to SF8 is non-linear (i.e., inverse Gamma ratio, $Y=X^{2.2}$), thereby compensating for the non-linear characteristics (Gamma characteristics) of input pixel data D.

That is, in each light-emission sustaining step Ic, only those discharge cells that have been set to light-emitting cells in the pixel data writing step Wc performed immediately before the process Ic emit light over the light-emitting period shown in the drive mode (A) during the display period of an even field and in the drive mode (B) during the display period of an odd field.

Additionally, in the erase process E shown in FIG. 3, the address driver 6 generates an erase pulse AP to apply it to respective column electrodes $D_{1-m}$. Furthermore, the second sustain driver 8 generates the erase pulse EP simultaneously at the application timing of the erase pulse AP to apply it to respective row electrodes $Y_1$ to $Y_n$. This simultaneous application of the erase pulses AP and EP causes erase discharge to be generated in all discharge cells of the PDP 10, allowing wall charges remaining within all discharge cells to disappear.

That is, executing the erase process E causes all discharge cells of the PDP 10 to be turned to non-light-emitting cells.

Figure 5:
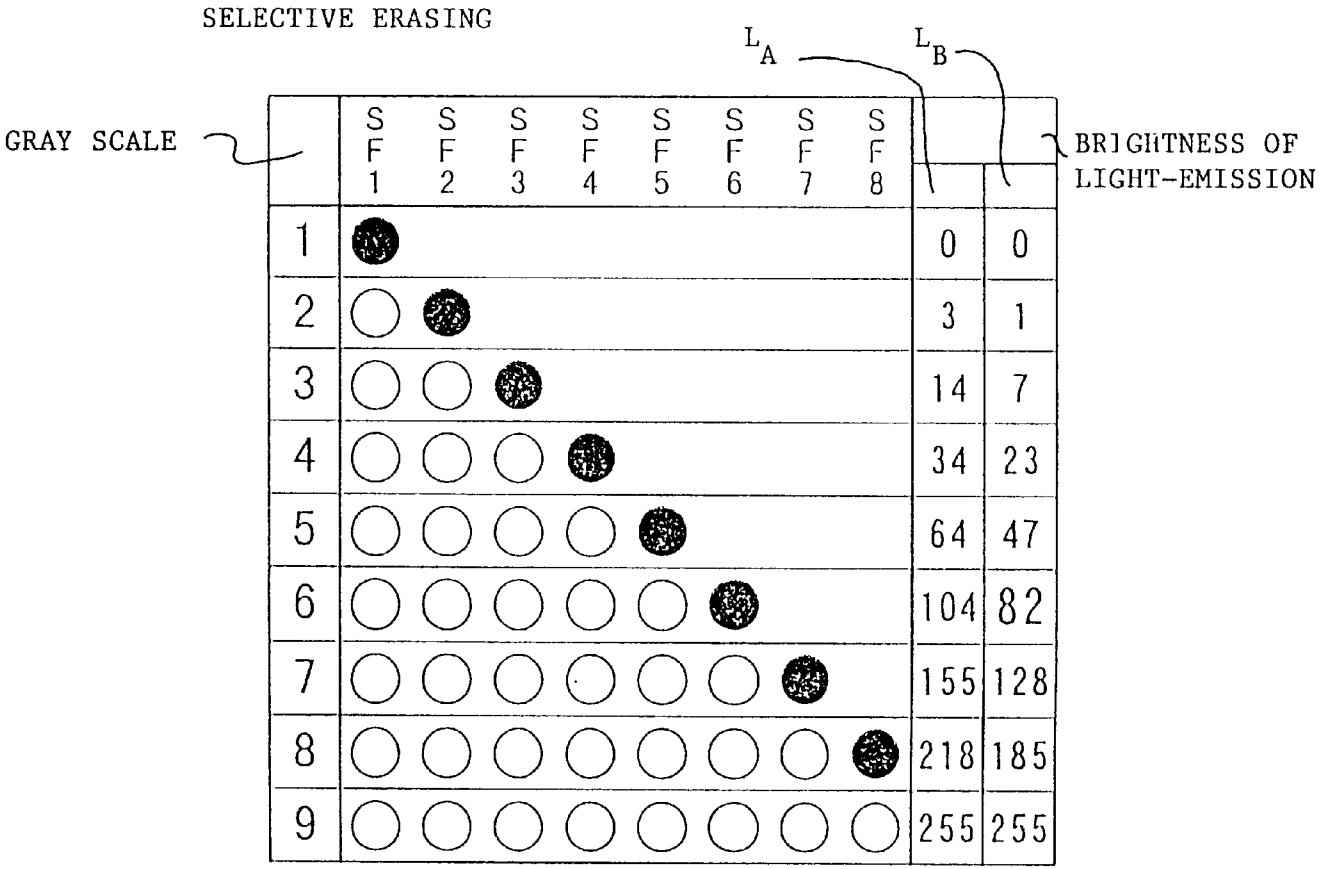
FIG. 5 is a view showing an example of a pattern of a light-emission drive to be performed in accordance with the light-emission drive format shown in FIGS. 4A and 4B.

FIG. 5 is a view showing all patterns of the light-emission drives to be performed in accordance with the light-emission drive formats shown in FIGS. 4A and 4B.

As shown in FIG. 5, the selective erase discharge is performed (shown by black circles) for respective discharge cells only at the pixel data writing step Wc in one sub-field of the sub-fields SF1 to SF8. That is, the wall charges formed within all discharge cells of the PDP 10 by the execution of the simultaneous reset process Rc remain until the aforementioned selective erase discharge is performed. The charges promote discharge light-emission (shown by white circles) at the light-emission sustaining step Ic present over that period in respective sub-fields SF. That is, each of the discharge cells acts as light-emitting cells in the sub-fields shown by the black circles in FIG. 5 until the aforementioned selective erase discharge is performed. The discharge cell continues light-emission at the ratio of the light-emission periods shown in FIGS. 4A and 4B at the light-emission sustaining step Ic in respective sub-fields present until then.

At this time, as shown in FIG. 5, the number of times at which respective discharge cells change from a light-emitting cell to a non-light-emitting cell is made equal to one or less in one field period without exception. That is, in one field period, such a light-emission drive pattern is prohibited that allows a discharge cell that has been set to a non-light-emitting cell to be restored to a light-emitting cell.

Accordingly, the aforementioned simultaneous reset operation that accompanies intense light-emission irrespective of whether no involvement in displaying picture images may be performed once in one field period as shown in FIG. 3, and FIGS. 4A and 4B, thereby allowing for preventing degradation in contrast.

Furthermore, the selective erase discharge is performed only once at most within one field period as shown by the black circles of FIG. 5, thereby allowing for reducing power consumption thereof.

Still furthermore, as shown in FIG. 5, no such light-emitting pattern exists that allows a period of the light-emitting state (shown by white circles) of a discharge cell and a period of a non-light-emitting state to be inverted to each other in one field period, so that a quasi-contour can be prevented.

In the foregoing, the light-emission drive pattern shown in FIG. 5 allows the light-emission drive to be performed to express a brightness of 9 levels of halftone at the following light-emission brightness ratio as shown by the light-emission brightness ($L_A$) during a display period of an even field. That is,

{0: 3: 14: 34: 64: 104: 155: 218: 255}.

On the other hand, during a display period of an odd field, the light-emission drive is performed to express brightness of 9 levels of halftone at the following light-emission brightness ratio as shown by the light-emission brightness ($L_B$). That is,

{0: 1: 7: 23: 47: 82: 128: 185: 255}.

That is, two types of 9-level gray-scale light-emission drives that are different from each other and should be carried out at each sub-field are performed alternately at each field (frame). According to the drive, the integral with respect to time allows the number of visual levels of halftone to increase. This prevents dither caused by the multi-level gray scale processing and the pattern of error diffusion processing to be described later from becoming conspicuous and thus provides an improved S/N ratio.

Figure 6:
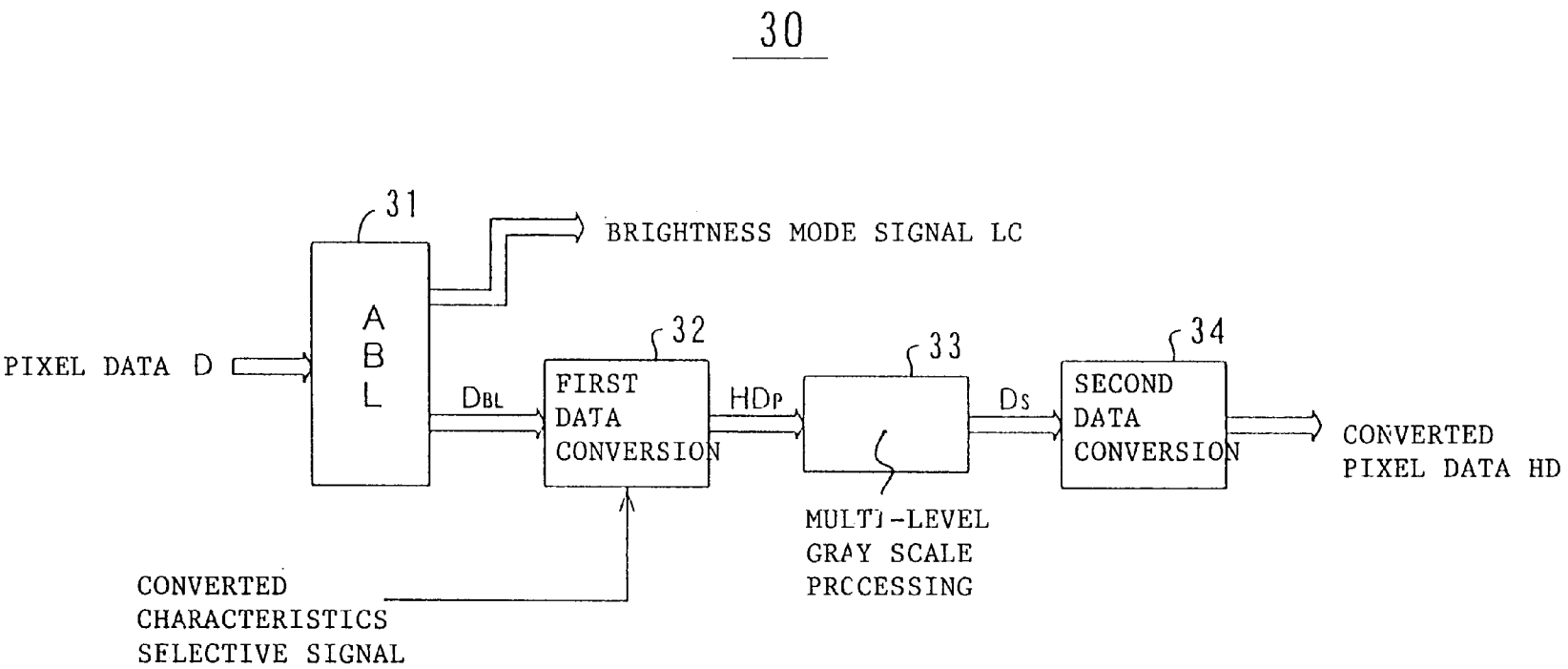
FIG. 6 is a view showing the internal configuration of a data converter 30.

FIG. 6 is a view showing the internal configuration of the data converter 30 shown in FIG. 2.

As shown in FIG. 6, the data converter 30 comprises an ABL circuit 31, a first data converter 32, a multi-level gray scale processing circuit 33, and a second data converter 34.

The ABL (automatic brightness control) circuit 31 tunes the brightness level of the pixel data D of respective pixels supplied sequentially by the AID converter 1 so that the average brightness of the pixels displayed on the screen of the PDP 10 falls within the predetermined range of brightness. Then, the ABL circuit 31 supplies the brightness tuning pixel data $D_{BL}$ obtained at this time to the first data converter 32.

The tuning of brightness levels is carried out by setting the ratio of the number of times of light-emissions of sub-fields non-linearly before the inverse Gamma compensation is performed. Thus, the ABL circuit 31 tunes automatically the brightness level of the aforementioned pixel data D in response to the average brightness of the inverse-Gamma-converted pixel data obtained by applying the inverse Gamma compensation to the pixel data D (input pixel data). This allows for preventing degradation of the display quality caused by the brightness adjustment.

Figure 7:
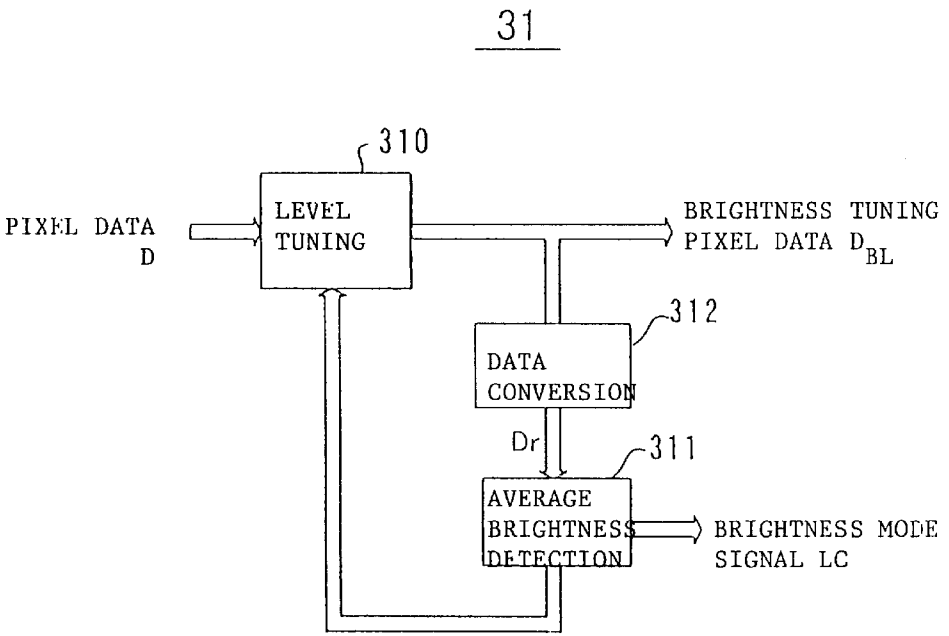
FIG. 7 is a view showing the internal configuration of an ABL circuit 31.

FIG. 7 is a view showing the internal configuration of the ABL circuit 31.

Figure 8:
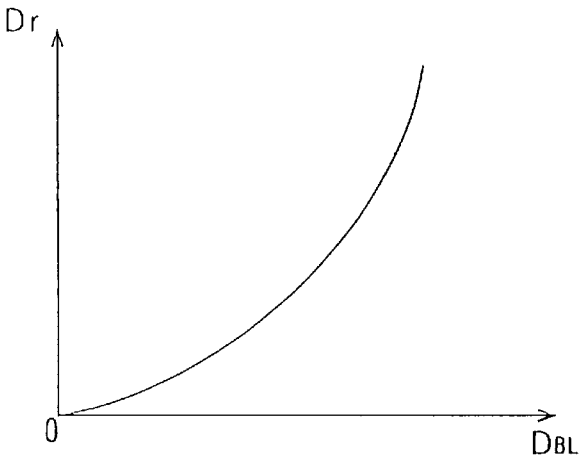
FIG. 8 is a view showing the conversion characteristics of the data converter 312.

Referring to FIG. 7, the level tuning circuit 310 outputs the brightness-tuning pixel data $D_{BL}$ obtained by tuning the level of the pixel data D in response to the average brightness determined by the average brightness detection circuit 311 which is to be described later. The data converter 312 converts the brightness-tuning pixel data $D_{BL}$ into inverse Gamma characteristics ($Y=X^{2.2}$) having non-linear characteristics shown in FIG. 8, which is in turn supplied as the inverse-Gamma-converted pixel data Dr to the average brightness detection circuit 311. That is, the data converter 312 applies the inverse Gamma compensation to the brightness-tuning pixel data $D_{BL}$. This allows for restoring the pixel data (the inverse-Gamma-converted pixel data Dr) corresponding to the original video signal of which Gamma compensation is undone. The average brightness detection circuit 311 determines the average brightness based on the inverse-Gamma-converted pixel data Dr and then supplies the average brightness to the aforementioned level tuning circuit 310.

Furthermore, the average brightness detection circuit 311 selects a brightness mode which causes the PDP 10 to emit light at an average brightness corresponding to the aforementioned average brightness, for example, from brightness modes 1 to 4 shown in FIG. 9A and 9B. Then, the average brightness detection circuit 311 supplies the brightness mode signal LC that shows the brightness mode selected to the drive control circuit 2. Incidentally, the average brightness detection circuit 311 selects use of the drive mode (A) of FIG. 9A for displaying even fields, while using the drive mode (B) of FIG. 9B for displaying odd fields. At this time, the drive control circuit 2 sets the period (i.e., the number of times of application of sustain pulses IP) during which light emission should be sustained in the light-emission sustaining step Ic of respective sub-fields SF1 to SF8 shown in FIGS. 4A and 4B in accordance with the brightness mode signal LC shown in FIGS. 9A and 9B.

At this time, the period of light-emission at each sub-field shown in FIGS. 4A and 9B shows the light-emission period when the brightness mode 1 is set. In the case where the brightness mode 2 is set, light-emission drive is performed at each sub-field for the following period of light emission.

That is, for even fields,

SF1: 6
SF2: 22
SF3: 40
SF4: 60
SF5: 80
SF6: 102
SF7: 126
SF8: 74

For even fields,

SF1: 2
SF2: 12
SF3: 32
SF4: 48
SF5: 70
SF6: 92
SF7: 114
SF8: 140

Incidentally, in the driving for emitting light, the ratio of the number of frequencies of light emissions at respective sub-fields SF1 to SF8 is set non-linearly (that is, to the inverse Gamma ratio, $Y=X^{2.2}$). This allows the non-linear characteristics (the Gamma characteristics) of the input pixel data D to be compensated for.

The first data converter 32 of FIG. 6 converts the brightness-tuning pixel data $D_{BL}$ of a 256-level gray scale and 8 bits, which is supplied by the aforementioned ABL circuit 31, into the converted pixel data $HD_P$ of 8 bits (0 to 128). Then, the data converted pixel data $HD_P$ is supplied to the multi-level gray scale processing circuit 33.

Figure 10:
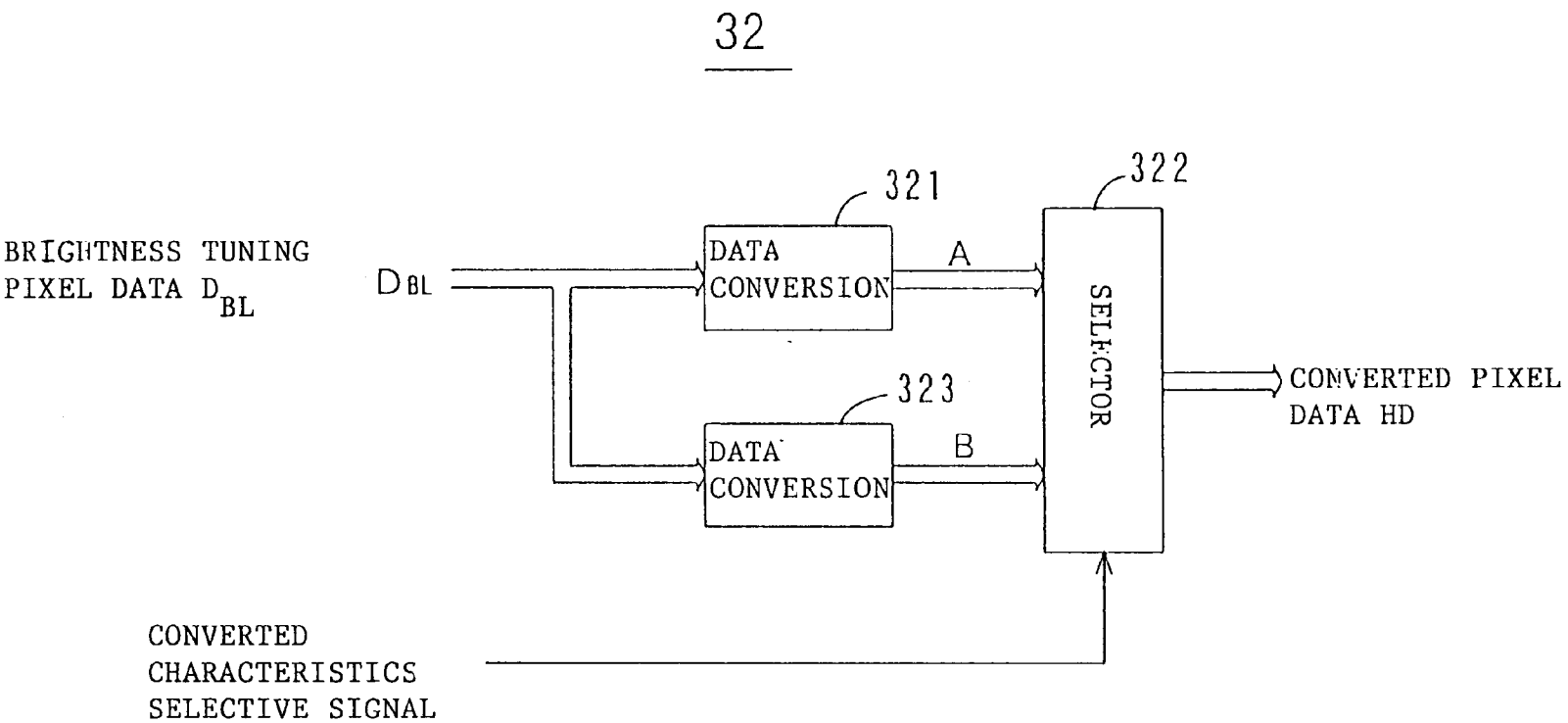
FIG. 10 is a view showing the internal configuration of a first data converter 32.

FIG. 10 is a view showing the internal configuration of the first data converter 32.

Figure 11:
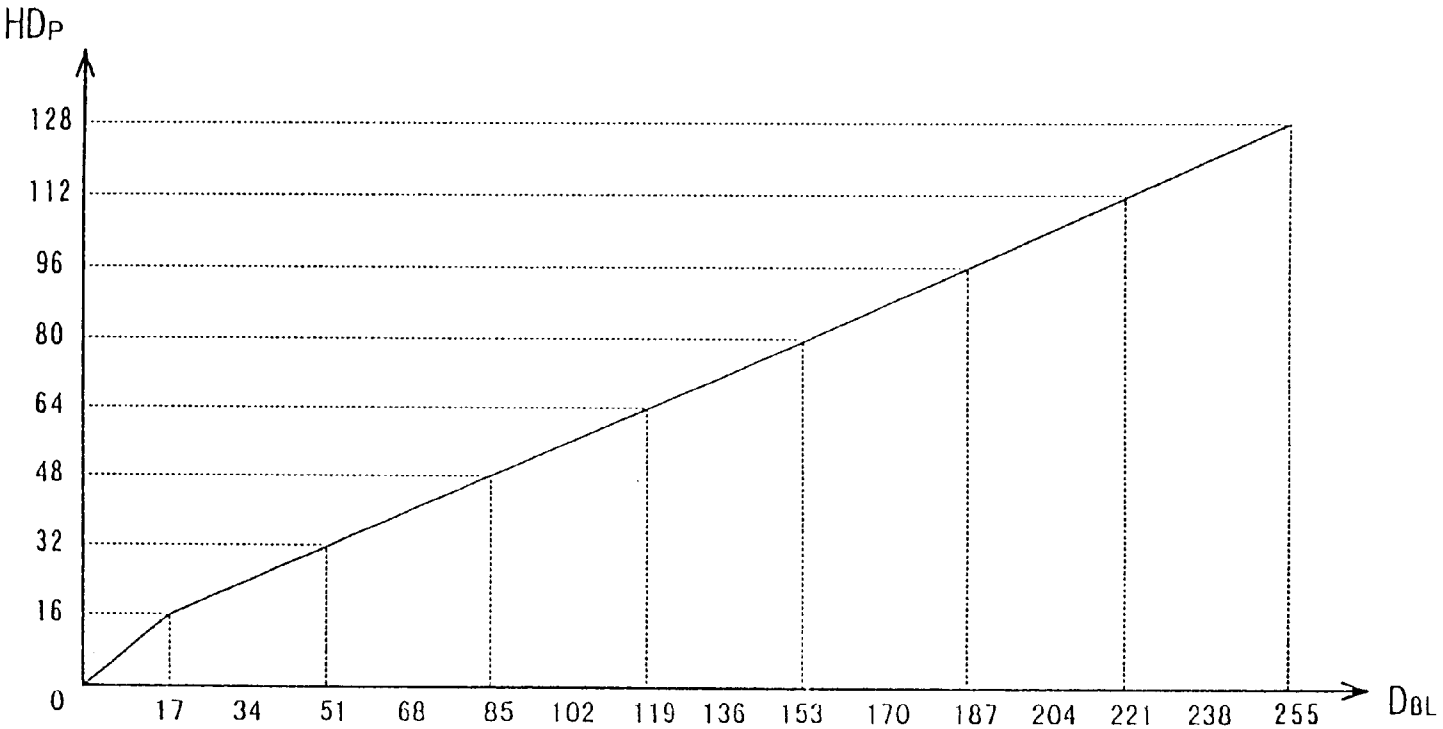
FIG. 11 is a view showing first conversion characteristics of a first data converter 32.
Figure 12:
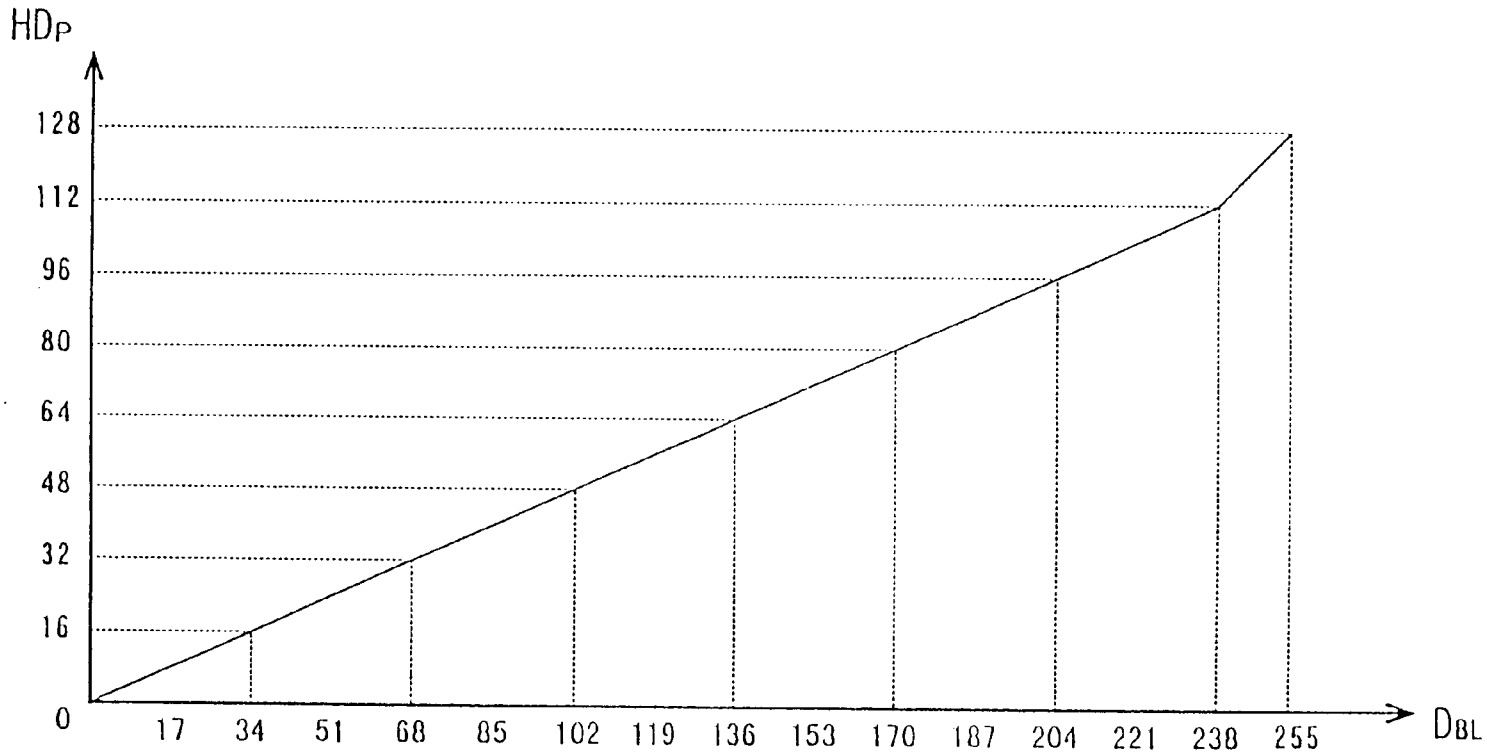
FIG. 12 is a view showing second conversion characteristics of a first data converter 32.

In FIG. 10, a data converter 321 converts the aforementioned brightness-tuning pixel data $D_{BL}$ into the converted pixel data A of 8 bits (0 to 128), in accordance with the conversion characteristics shown in FIG. 11, which is in turn supplied to a selector 322. A data converter 323 converts the aforementioned brightness-tuning pixel data $D_{BL}$ into the converted pixel data B of 8 bits (0 to 128), in accordance with the conversion characteristics shown in FIG. 12, which is in turn supplied to the selector 322. More specifically, the data converters 321 and 323 convert the brightness-tuning pixel data $D_{BL}$ into the converted pixel data A and B in accordance with the conversion tables shown in FIG. 13 and FIG. 14 based on the conversion characteristics shown above in FIG. 11 and FIG. 12, respectively. The selector 322 alternatively selects one of the converted pixel data A and B which corresponds to the logic level of a conversion characteristics selective signal and outputs one of the converted pixel data A or B as the converted pixel data $HD_P$. The conversion characteristics selective signal is a signal that is supplied by the drive control circuit 2 shown in FIG. 2 and shifts, in response to the vertical synchronization timing of the input pixel data D, from logic level "1" to "0" or "0" to "1". In the foregoing, the conversion characteristics of FIG. 11 are paired with the drive mode (B) of FIG. 4B and the conversion characteristics of FIG. 12 are paired with the drive mode (A) of FIG. 4A. That is, the selector 322 selects the converted pixel data B in a field (an even field) in which the drive mode (A) of FIG. 4A is set. On the other hand, the converted pixel data A is selected in a field (an odd field) to which the drive mode (B) of FIG. 4B is set. Then, the data A and B is outputted as converted pixel data $HD_P$. Incidentally, the aforementioned conversion characteristics are set in accordance with the number of bits of input pixel data, the number of compressed bits resulting from multi-level gray scale processing, and the number of gray scale levels for display. As such, the first data converter 32 is provided at the front stage of the multi-level gray-scale processing circuit 33 to be described later. This allows for performing conversion into the number of gray-scale levels for display and the number of compressed bits resulting from multi-level gray scale processing. This allows the brightness-tuning pixel data $D_{BL}$ to be divided at a bit boundary into an upper bit group (corresponding to multi-level gray scale pixel data) and a lower bit group (data to be discarded, error data). In accordance with this signal, the multi-level gray scale processing is to be performed. This allows for preventing the occurrence of flat portions, caused by the occurrence of brightness saturation resulting from the multi-level gray scale processing and the absence of display levels of gray scale at a bit boundary, in the display characteristics (that is, the occurrence of disorder in gray scale levels).

The configuration shown in FIG. 10 allows the first data converter 32 to switch the conversion characteristics (FIG. 11 and FIG. 12) of the brightness-tuning pixel data $D_{BL}$ of 8 bits (0 to 255) supplied by the aforementioned ABL circuit 31 at each one field (frame). At the same time, the first data converter 32 converts the brightness-tuning pixel data $D_{BL}$ into the converted pixel data $HD_P$ of 8 bits (0 to 128) which is in turn supplied to the multi-level gray-scale processing circuit 33.

Figure 15:
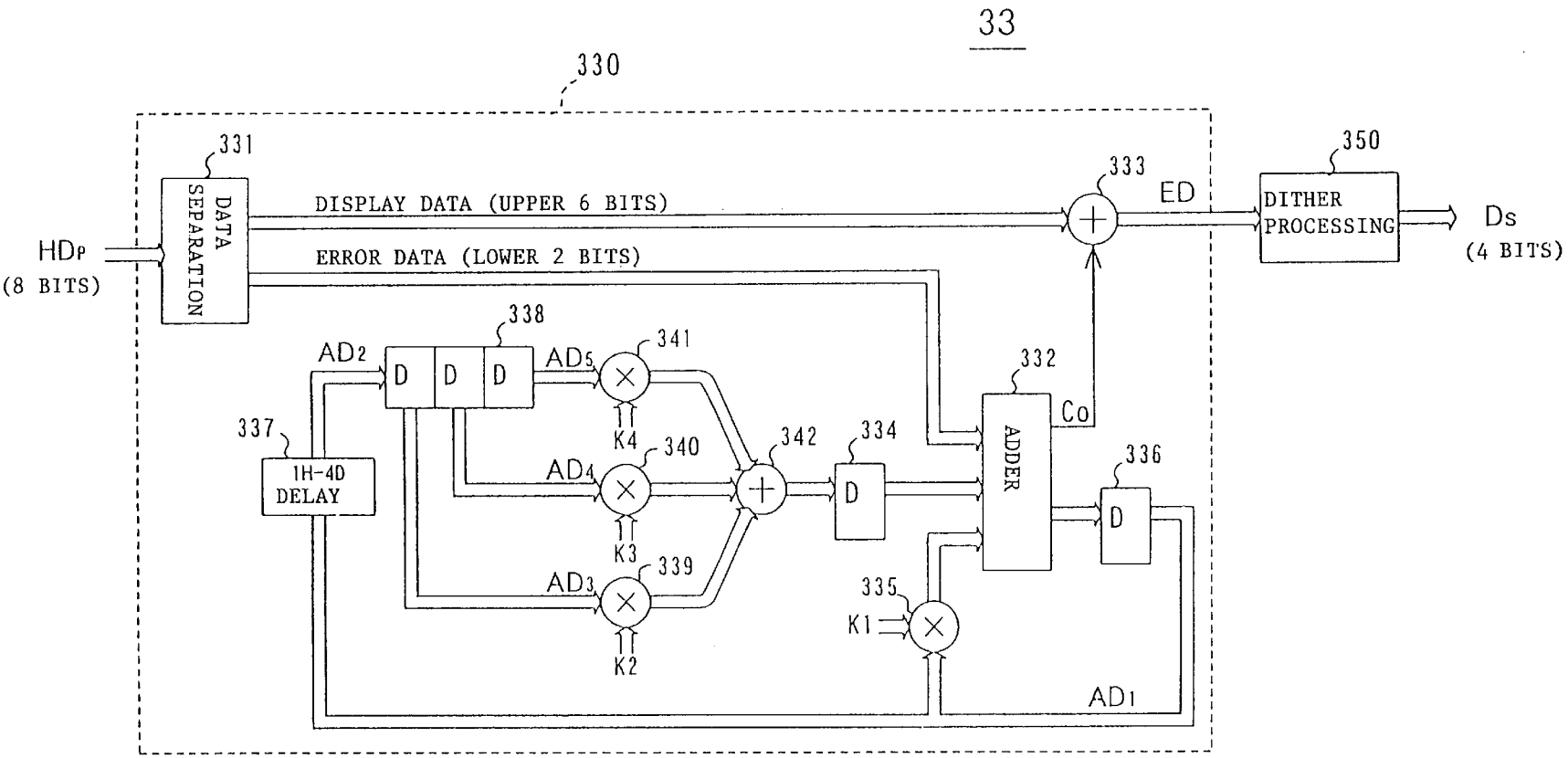
FIG. 15 is a view showing the internal configuration of multi-level gray scale processing circuit 33.

FIG. 15 is a view showing the internal configuration of the multi-level gray scale processing circuit 33.

As shown in FIG. 15, the multi-level gray scale processing circuit 33 comprises an error diffusion processing circuit 330 and dither processing circuit 350.

First, the data separation circuit 331 of the error diffusion processing circuit 330 separates the lower 2 bits of the 8-bit converted pixel data $HD_P$ supplied by the aforementioned first data converter 32 into error data and the upper 6 bits into display data.

The adder 332 supplies, to the delay circuit 336, an additional value obtained by adding the lower 2 bits as error data of the converted pixel data $HD_P$, the delay output from the delay circuit 334, and a multiplication output of the scale multiplier 335. The delay circuit 336 causes an additional value supplied by the adder 332 to be delayed by the delay time D of the same length of time as the clock period of the pixel data. Then, the delay circuit 336 supplies the additional value to the aforementioned scale multiplier 335 and the delay circuit 337 as the delay additional signal $AD_1$, respectively. The scale multiplier 335 multiplies the aforementioned delay additional signal $AD_1$ by the predetermined coefficient $K_1$ (for example, "7/16") and then supplies the result to the aforementioned adder 332. The delay circuit 337 causes further the aforementioned delay additional signal $AD_1$ to be delayed by the time (equal to one horizontal scan period—the aforementioned delay time D×4) and then supplies the result to a delay circuit 338 as the delay additional signal $AD_2$. The delay circuit 338 causes further the delay additional signal $AD_2$ to be delayed by the aforementioned delay time D and then supplies the resultant to a scale multiplier 339 as the delay additional signal $AD_3$. Moreover, the delay circuit 338 causes further the delay additional signal $AD_2$ to be delayed by the aforementioned delay time D×2 and then supplies the result to a scale multiplier 340 as the delay additional signal $AD_4$. Still moreover, the delay circuit 338 causes further the delay additional signal $AD_2$ to be delayed by the aforementioned delay time D×3 and then supplies the result to a scale multiplier 341 as the delay additional signal $AD_4$. The scale multiplier 339 multiplies the aforementioned delay additional signal $AD_3$ by the predetermined coefficient $K_2$ (for example, "3/16") and then supplies the result to an adder 342. The scale multiplier 340 multiplies the aforementioned delay additional signal $AD_4$ by the predetermined coefficient $K_3$ (for example, "5/16") and then supplies the result to the adder 342. The scale multiplier 341 multiplies the aforementioned delay additional signal $AD_5$ by the predetermined coefficient $K_4$ (for example, "1/16") and then supplies the result to the adder 342. The adder 342 supplies, to the aforementioned delay circuit 334, the additional signal that has been obtained by adding the results of multiplication supplied by the aforementioned respective scale multipliers 339, 340, and 341. The delay circuit 334 causes such additional signals to be delayed by the aforementioned delay time D and then supplies the resultant signal to the aforementioned adder 332. The adder 332 adds the aforementioned error data (lower two bits of the converted pixel data $HD_P$), the delay output from the delay circuit 334, and the output of multiplication of the scale multiplier 335. In this case, the adder 332 generates the carry-out signal $C_o$ which is equal to logic "0" in absence of carry and logic "1" in the presence of a carry and supplies the signal to an adder 333.

The adder 333 adds the aforementioned display data (upper 6 bits of the converted pixel data $HD_P$) to the aforementioned carry-out signal $C_o$ and outputs the result as 6-bit error diffusion processing pixel data ED.

The operation of the error diffusion processing circuit 330 comprising as such is to be explained below.

Figure 16:
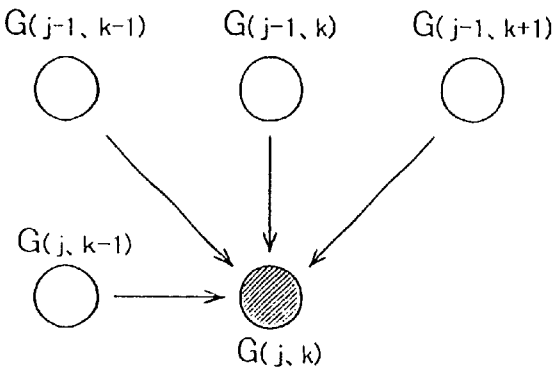
FIG. 16 is an explanatory view showing the operation of an error diffusion processing circuit 330.

For example, the error diffusion processing pixel data ED corresponding to pixel G (j, k) of the PDP 10 shown in FIG. 16 is determined. First, the respective error data corresponding to pixel G (j, k−1) on the left of the pixel G (j, k), pixel G (j−1, k−1) on the upper left, pixel G (j−1, k) on the immediate above, and pixel G (j−1, k+1) on the upper right, that is:

Error data corresponding to the pixel G (j, k−1), the additional delay signal $AD_1$;

Error data corresponding to the pixel G (j−1, k+1), the additional delay signal $AD_3$;

Error data corresponding to the pixel G (j−1, k), the additional delay signal $AD_4$; and Error data corresponding to the pixel G (j−1, k−1), the additional delay signal $AD_5$ are provided, respectively, with weights of the predetermined coefficients $K_1$ to $K_4$ for addition. Subsequently, the result of the addition is added by the error data corresponding to the lower two bits of the converted pixel data $HD_P$, that is, pixel G (j, k). Then, the carry-out signal $C_o$ for one bit thus obtained is added to the display data corresponding to the upper 6 bits of the converted pixel data $HD_P$, that is, the pixel G (j, k) and the resultant are the error diffusion processing pixel data ED.

The error diffusion processing circuit 330 with such a configuration interprets the upper 6 bits of the converted pixel data $HD_P$ as display data, and the remaining lower 2 bits as error data. The circuit also allows for adding the error data of the surrounding pixels {G (j, k−1), G (j−1, k+1), G (j−1, k), G (j−1, k−1)} by assigning weights thereto and the result is to be reflected to the aforementioned display data. This operation allows the brightness of the lower 2 bits at the original pixel {G (j, k)} to be expressed by the aforementioned surrounding pixels in an apparent manner. Therefore, this allows the display data of the number of bits less than 8 bits, that is, equal to 6 bits to express the levels of gray scale of brightness equivalent to those expressed by the aforementioned 8-bit pixel data.

Incidentally, an even addition of these coefficients of error diffusion to respective pixels would cause the noise resulting from error diffusion patterns to be visually noticed and thus produce an adverse effect on display quality. Accordingly, like the case of the dither coefficients to be described later, the coefficients $K_1$ to $K_4$ for error diffusion that should be assigned to the respective four pixels may be changed at each field.

The dither processing circuit 350 applies the dither processing to the error diffusion processing pixel data ED supplied by the error diffusion processing circuit 330. This allows for generating the multi-level gray scale processing pixel data Ds whose number of bits is reduced further to 4 bits. Meanwhile, the dither processing circuit 350 maintains the level of gray scale of the same brightness as the 6-bit error diffusion processing pixel data ED. Incidentally, the dither processing allows a plurality of adjacent pixels to express one intermediate display level. Take as an example the case of display of a halftone corresponding to 8 bits by using the display data of the upper 6 bits out of an 8-bit pixel data. Four pixels to adjacent to each other at the left and right, and above and below are taken as one set. Four dither coefficients a to d having values different from each other are assigned to respective pixel data corresponding to each of the pixels in the set for addition. The dither processing is to produce four different combinations of intermediate display levels with four pixels. Therefore, even with the number of bits of the pixel data equal to 6 bits, the brightness levels of the gray scale available for display are 4 times, that is, a halftone display corresponding to 8 bits becomes available.

However, an even addition of the dither patterns with the coefficients a to d to respective pixels would cause the noise resulting from the dither patterns to be visually noticed and thus produce an adverse effect of display quality. Accordingly, a dither processing circuit 350 changes the dither coefficients a to d that should be assigned to the respective four pixels at each field.

Figure 17:
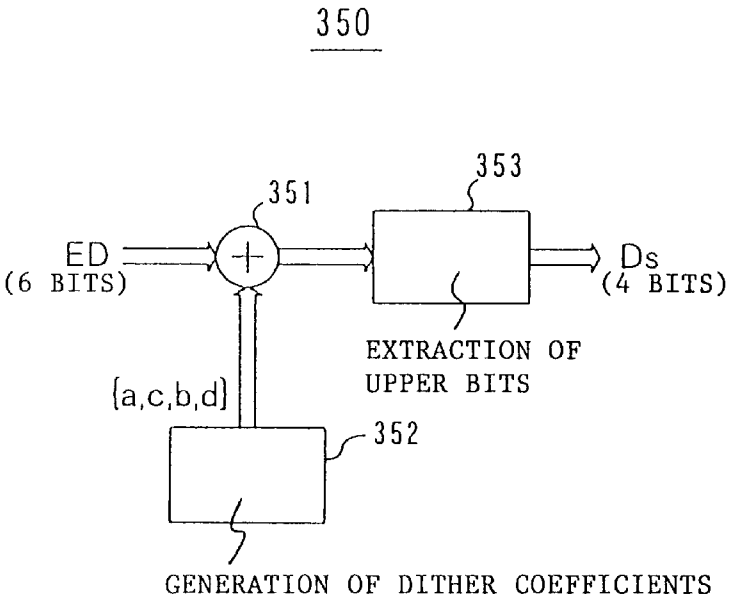
FIG. 17 is a view showing the internal configuration of a dither processing circuit 350.

FIG. 17 is a view showing the internal configuration of the dither processing circuit 350.

Referring to FIG. 17, a dither coefficient generation circuit 352 generates four dither coefficients a, b, c, and d for each of the four pixels adjacent to each other and supplies these coefficients in sequence to the adder 351.

Figure 18:
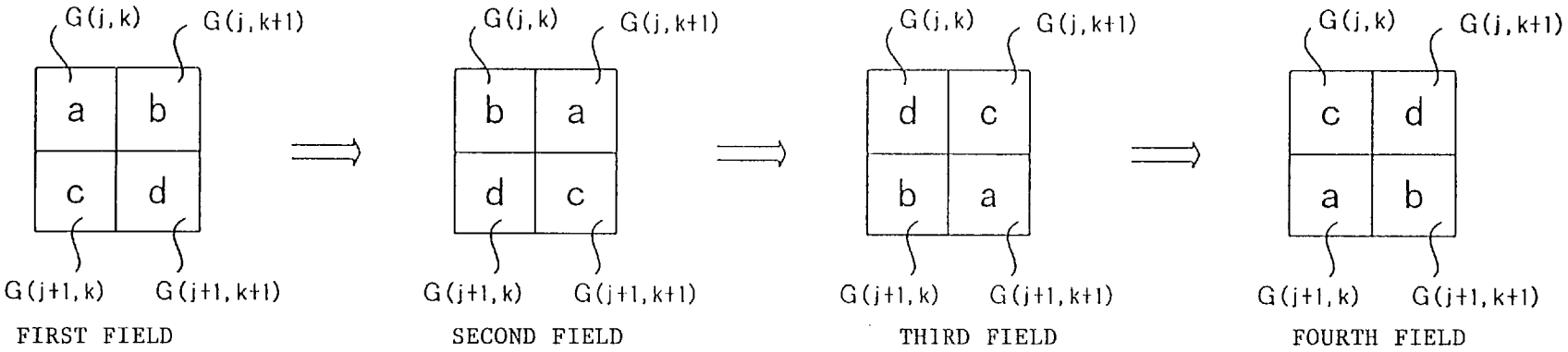
FIG. 18 is an explanatory view showing the operation of the dither processing circuit 350.

For example, as shown in FIG. 18, four dither coefficients a, b, c, and d are generated corresponding to four pixels, respectively. The four pixels are pixel G (j, k) and pixel G (j, k+1) corresponding to row j, and pixel G (j+1, k) and pixel G (j+1, k+1) corresponding to row (j+1). At this time, the dither coefficient generation circuit 352 changes, for each field as shown in FIG. 18, the aforementioned dither coefficients a, b, c, and d that should be assigned to the respective four pixels.

That is, dither coefficients a to d are assigned to the pixels at each field and generated repeatedly in a cyclic manner as shown below and supplied to the adder 351.

At the starting first field, pixel G (j, k), dither coefficient a,
pixel G (j, k+1), dither coefficient b,
pixel G (j+1, k) dither coefficient c, and
pixel G (j+1, k+1), dither coefficient d;

at the subsequent second field, pixel G (j, k), dither coefficient b,
pixel G (j, k+1), dither coefficient a,
pixel G (j+1, k), dither coefficient d, and
pixel G (j+1, k+1), dither coefficient c;

at the subsequent third field, pixel G (j, k), dither coefficient d,
pixel G (j, k+1), dither coefficient c,
pixel G (j+1, k), dither coefficient b, and
pixel G (j+1, k+1), dither coefficient a;

and, at the fourth field, pixel G (j, k), dither coefficient c, pixel G (j, k+1), dither coefficient d, pixel G (j+1, k), dither coefficient a, and pixel G (j+1, k+1), dither coefficient b;

The dither coefficient generation circuit 352 repeatedly executes the operation of the first to fourth fields mentioned above. That is, upon completion of generating the dither coefficients at the fourth field, the above-mentioned operation is repeated all over again from the aforementioned first field. The adder 351 adds the dither coefficients a to d which are assigned to respective fields as mentioned above to the error diffusion processing pixel data ED, respectively. Hereupon, the error diffusion processing pixel data ED corresponds to the aforementioned pixel G (j, k), pixel G (j, k+1), pixel G (j+1, k), and pixel G (j+1, k+1), respectively, which are supplied by the aforementioned error diffusion processing circuit 330. The adder 351 then supplies the dither additional pixel data thus obtained to the upper bit extracting circuit 353.

For example, at the first field shown in FIG. 18, each of the following data is supplied sequentially as the dither additional pixel data to the upper bit extracting circuit 353. That is, error diffusion processing pixel data ED corresponding to pixel G (j, k)+dither coefficient a, error diffusion processing pixel data ED corresponding to pixel G (j, k+1)+dither coefficient b, error diffusion processing pixel data ED corresponding to pixel G (j+1, k)+dither coefficient c, and error diffusion processing pixel data ED corresponding to pixel G (j+1, k+1)+dither coefficient d.

The upper bit extracting circuit 353 extracts the bits up to the upper four bits of the dither additional pixel data for output as multi-level gray scale pixel data $D_s$.

As mentioned above, the dither processing circuit 350 shown in FIG. 17 changes the aforementioned dither coefficients a to d that should be associated with and assigned to each of the four pixels. This allows for determining the multi-level gray-scale pixel data $D_s$ of 4 bits (0 to 7) having a visually multi-level gray scale while reducing visual noise caused by dither patterns, which is then supplied to the second data converter 34.

The second data converter 34 converts the multi-level gray-scale pixel data Ds into the converted pixel data (display pixel data) HD of bits 1 to 8 corresponding to respective sub-fields SF1 to SF8 in accordance with the conversion table shown in FIG. 19. Incidentally, in FIG. 19, the bits with logic level "1" among the bits 1 to 8 of the converted pixel data HD indicate the selective erase discharge to be carried out in the pixel data writing step Wc at the sub-fields SF corresponding to the bits (indicated by black circles).

In the foregoing, the aforementioned converted pixel data HD is supplied to the address driver 6 via the memory 4 as shown in FIG. 2. At this time, the format of the converted pixel data HD is to take one of the 9 patterns shown in FIG. 19. The address driver 6 assigns each of bits 1 to 8 in the aforementioned converted pixel data HD to the respective sub-fields SF1 to SF8. Then, only when the bit logic is logic level "1", the address driver 6 generates a high-tension pixel data pulse at the pixel data writing step Wc in the associated sub-field and supplies the pulse to the column electrodes D of the PDP 10. This allows for generating the aforementioned selective erase discharge. This allows each of the discharge cells to become a light-emitting cell for a period until the aforementioned selective erase discharge is carried out in the sub-fields indicated by the black circles of FIG. 19. Thus, each discharge cell emits light at light-emission period ratio shown in FIGS. 4A and 4B in each sustaining light-emission process Ic of each of the successive sub-fields which are present during the period.

This allows for carrying out the light-emission drive with the following 9 levels of halftone during an even field (frame) display period as shown by the light-emission brightness $L_A$ of FIG. 19. That is,

{0: 3: 14: 34: 64: 104: 155: 218: 255}.

This also allows for carrying out the light-emission drive with the following 9 levels of halftone during an odd field (frame) display period as shown by the light-emission brightness $L_B$ of FIG. 19. That is,

{0: 1: 7: 23: 47: 82: 128: 185: 255}.

Figure 20:
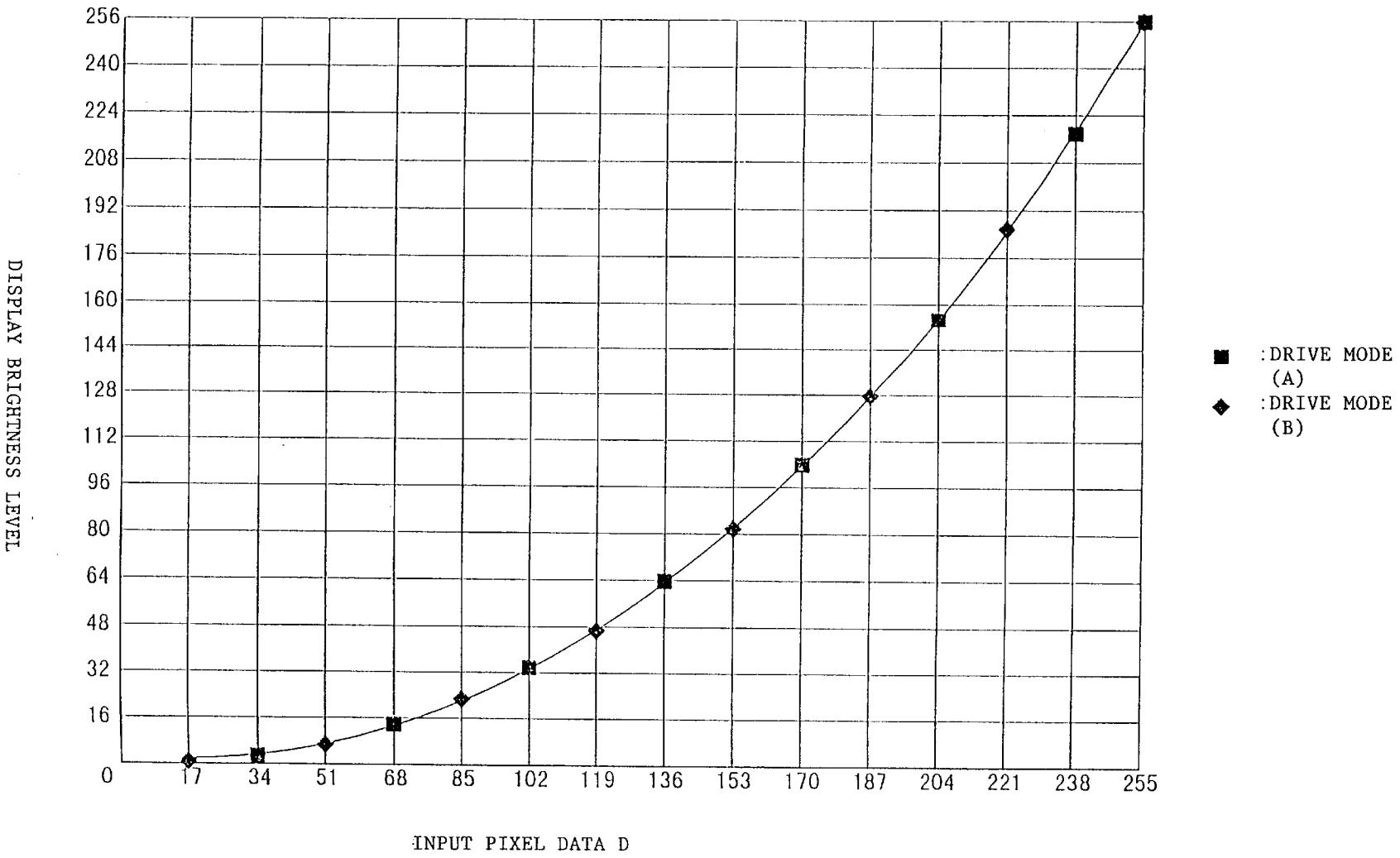
FIG. 20 is a view showing the relationship between two types of light-emission brightness for 9 levels of halftone (display brightness levels) and the input pixel data D.

FIG. 20 shows the relationship between the aforementioned two types of light-emission brightness (display brightness level) of 9 levels of halftone and the input pixel data D.

Referring to FIG. 20, symbols "-■-" and "-◆-" show the relationship between the input pixel data D and display brightness level in the drive mode (A) and the drive mode (B), respectively. The drive pattern, that is, the number of times of light-emission (the number of sustaining pulses) may be changes for each field (frame) in the light-emission sustaining step Ic of each sub-field. The figure shows that this allows the levels of halftone expressed by one drive mode to be interposed in between the levels of halftone expressed by the other drive mode. Thus, the effect of an integral with respect to time will provide the number of visual display levels of halftone greater than 9 levels of halftone and an improved gray-scale expression as such.

Furthermore, a value between adjacent levels of halftone, for example, a value between light-emission brightness "3" and "14" in the drive mode (A) is expressed by the multi-level gray-scale processing such as the aforementioned error diffusion processing and dither processing. (The value is a level corresponding to the lower 4 bits of the input pixel data D.)

Incidentally, in the case where the multi-level gray-scale processing such as the error diffusion processing and dither processing is performed, a fewer number of original display levels of halftone causes patterns of the multi-level gray-scale processing to become conspicuous, providing a deteriorated S/N ratio. However, the light-emission drive pattern for each field (frame), as mentioned above, can be changed to increase the number of visual display levels of halftone. Consequently, this will not allow patterns caused by the multi-level gray-scale processing to become conspicuous and thus provide an improved S/N ratio.

Furthermore, FIG. 20 shows that the input pixel data D is inverse-gamma corrected by setting the ratio of the number of times of light-emission in the light-emission sustaining step Ic of each sub-field to the inverse gamma ratio.

As mentioned above, the drive modes (A) and (B) have 9 levels of halftone. However, the aforementioned combination of changing the light-emission drive pattern at each field (frame) and the multi-level gray-scale processing provides visual levels of halftone equivalent to 256 levels of halftone.

At this time, as shown in FIG. 19, a discharge cell is to be changed from the light-emitting state to a non-light-emitting state once or less in one field period. Accordingly, the aforementioned simultaneous reset operation that accompanies intense light-emission irrespective of whether no involvement in displaying picture images may be performed once in one field period is as shown in FIGS. 4A and 4B. This allows for preventing degradation in contrast and reducing power consumption.

Furthermore, as shown in FIG. 19, no such light-emitting pattern exists that allows a period of the light-emitting state (shown by white circles) and a period of a non-light-emitting state to be inverted to each other in one field period, so that a quasi-contour can be prevented.

Incidentally, the aforementioned embodiment described the case where the so-called selective erase addressing method was employed as a pixel data write method. The method allows for forming wall charges on each discharge cell in advance at the head of a field to set all discharge cells to light-emitting cells. Then, the wall charges are selectively erased in response to pixel data for writing the pixel data.

However, the present invention is also applicable to the case where the so-called selective write addressing method is employed as the pixel data write method which allows for forming wall charges selectively in response to pixel data.

Figures 21A, 21B:
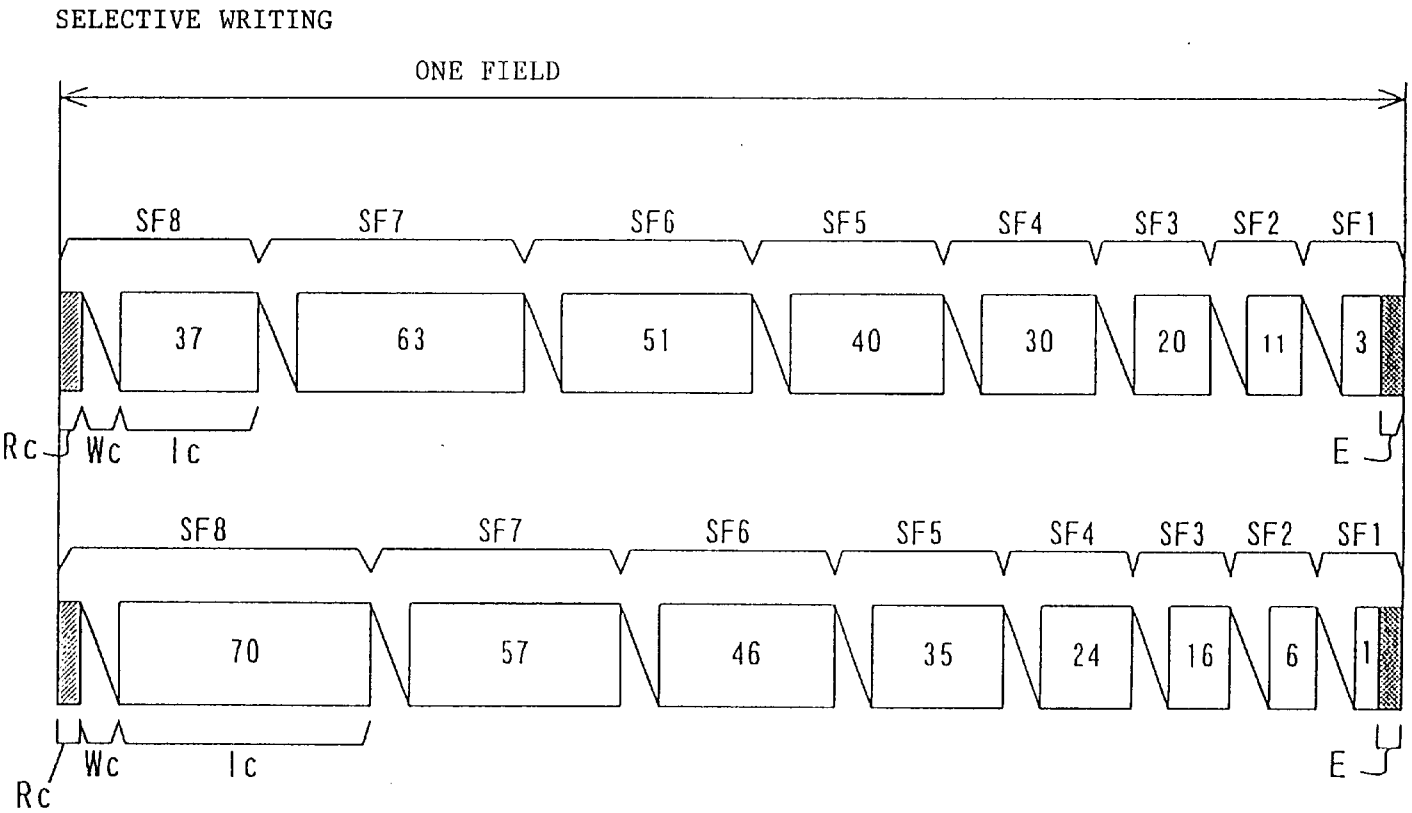
FIGS. 21A and 21B are views showing a light-emission drive format used when a selective write addressing method is employed.

FIGS. 21A and 21B are views showing the light-emission drive format for the case where this selective write addressing method is employed.

Figure 22:
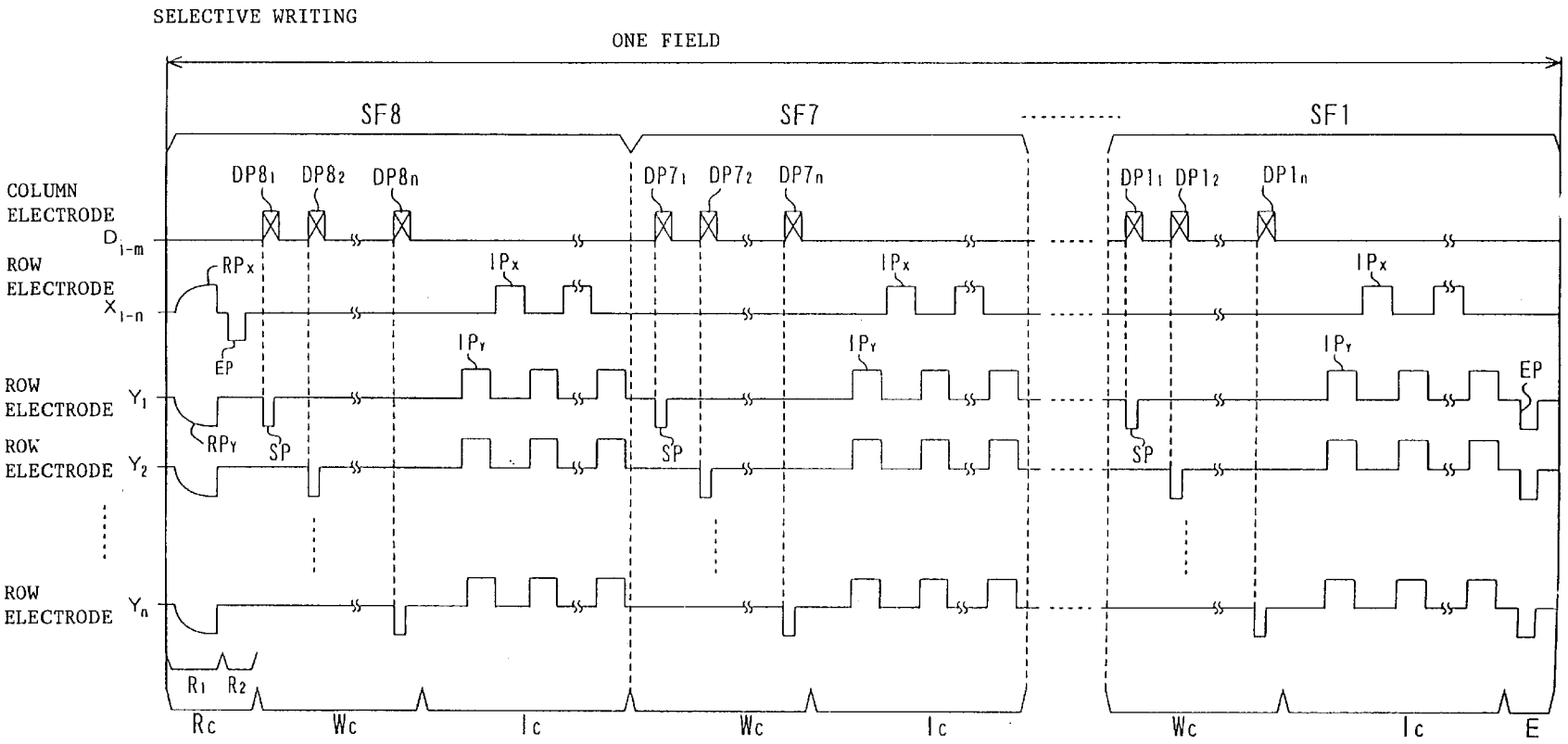
FIG. 22 is a view showing an example of an application timing of various drive pulses to be applied to PDP 10 when the selective write addressing method is employed.

In addition, FIG. 22 shows the application timing of various types of drive pulses to be applied to the column electrodes $D_1$ to $D_m$, and the row electrodes $X_1$ to $X_n$, $Y_1$ to $Y_n$ of the PDP 10 in accordance with the light-emission drive formats shown in FIG. 21A and 21B.

Furthermore, FIG. 23 shows the conversion table for use in the second data converter 34 for the case where the selective write addressing method is employed, and all patterns of the light-emission drive to be carried out in one field period.

As shown in FIG. 22, the aforementioned selective write addressing method when employed initially allows the first and second sustain drivers 7 and 8 to apply the reset pulses $RP_x$ and $RP_y$ simultaneously to row electrodes X and Y, respectively, at the simultaneous reset process Rc of the head sub-field SF8. This causes all discharge cells of the PDP 10 to carry out reset discharge and thus forces wall charges to be built up within each of the discharge cells ($R_1$). Immediately thereafter, the first sustain driver 7 applies simultaneously the erase pulse EP to the row electrodes $X_1$ to $X_n$ of the PDP 10, thereby erasing the aforementioned wall charges formed in all discharge cells ($R_2$). That is, the simultaneous reset process Rc shown in FIG. 22 is carried out to reset all discharge cells of the PDP 10 to the state of non-light-emitting cells.

The pixel data writing step Wc allows only those discharge cells located at the intersections of the "rows" to which the scan pulse SP is applied and the "columns" to which a high-tension pixel data pulse is applied to produce discharge (selective write discharge). This results in selectively building up wall charges in the discharge cells. The selective write discharge causes the discharge cells that have been reset to the state of non-light-emitting cells at the aforementioned simultaneous reset process Rc to change into the state of light-emitting cells. Incidentally, no discharge is generated at the discharge cells disposed at the "columns" to which the aforementioned high-tension pixel data pulse has not been applied and thus the state of non-light-emitting cells, that is, the state of having been reset at the simultaneous reset process Rc is sustained.

That is, the pixel data writing step Wc is carried out for selectively setting to either the light-emitting cell of which the light-emitting state is sustained during the light-emission sustaining step to be described later or the non-light-emitting cell remaining in an "off" state. Thus, the so-called writing of pixel data to each discharge cell is performed.

In the foregoing, the light-emission drive by the selective write addressing method will cause the selective write discharge to be carried out only at those sub-fields SF corresponding to the bits of logic level "1" of the converted pixel data HD as shown in FIG. 23 (indicated by black circles). At this time, the non-light-emitting state is sustained at the sub-fields present during a period until the selective write discharge is carried out from the head sub-field SF8. On the other hand, the light-emitting state is sustained at the sub-fields SF (indicated by white circles) except for the sub-fields SF (indicated by black circles) for which the selective write discharge has been carried out and the sub-fields present thereafter.

As mentioned above, the drive methods shown in FIG. 3 through FIG. 23 allow for resetting all discharge cells to either one of a light-emitting cell or non-light-emitting cell only at the head sub-field of one field period. Thus, in only one sub-field, pixel data is written to set each discharge cell to a light-emitting or non-light-emitting cell in response to the pixel data. When the selective erase addressing method is employed, the drive method allows the sub-fields of a field to enter the light-emitting state from the head sub-field in sequence with increasing brightness to be displayed. On the other hand, the selective write addressing method allows the sub-fields of a field to enter the light-emitting state from the last sub-field in sequence with increasing brightness to be displayed. At this time, the present invention allows for performing, in alternate fields (frames), two types of light-emission drives having different periods of light-emission (the number of times) at each sub-field, for example, the drive modes (A) and (B) shown in FIGS. 4A and 4B. Thus, this allows for increasing the number of visual brightness levels of halftone.

Figure 24:
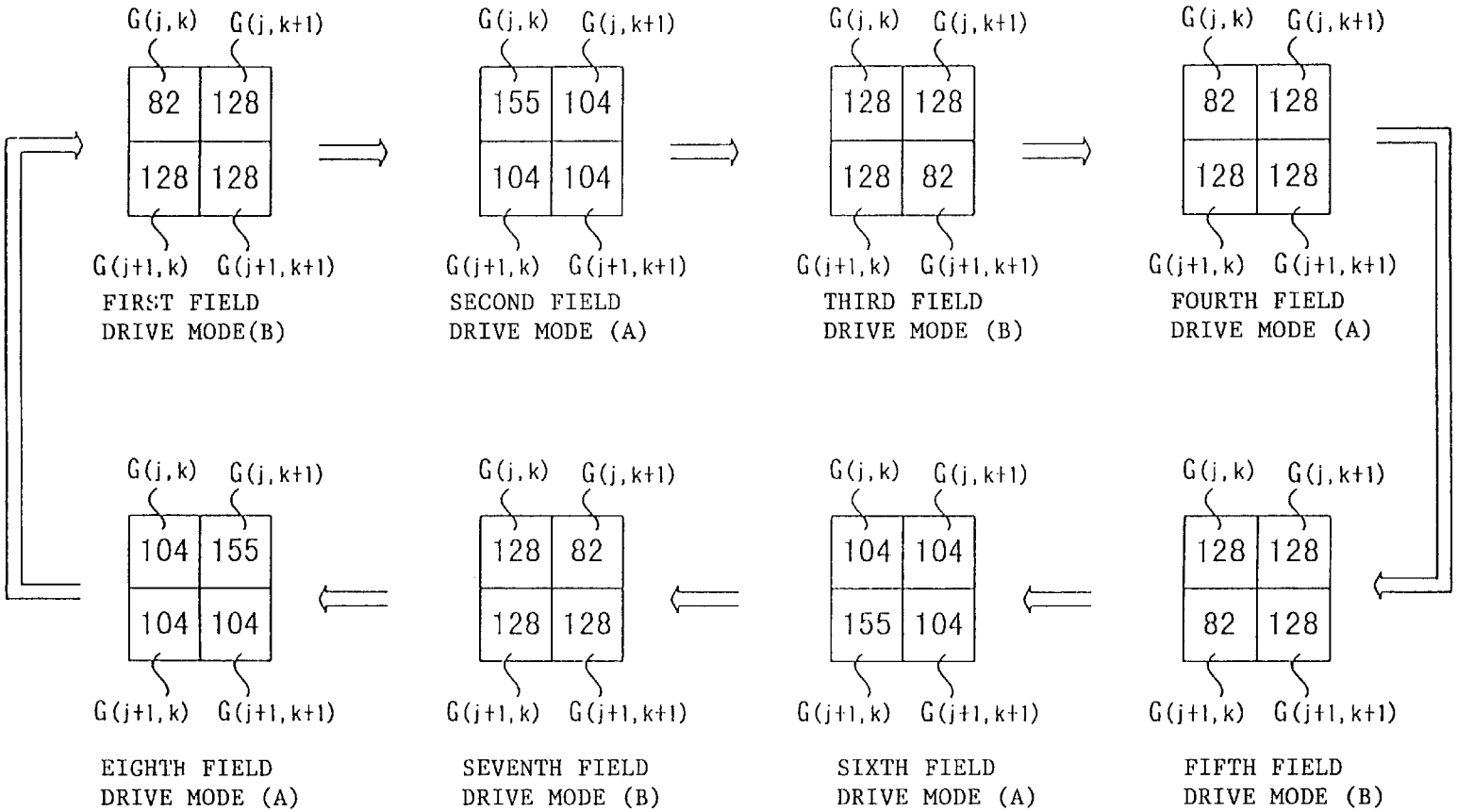
FIG. 24 is a view showing a specific operation of the drive method shown in FIG. 3 through FIG. 23.

FIG. 24 is a view showing a specific operation of the aforementioned drive methods shown in FIG. 3 through FIG. 23.

For example, when the input pixel data is "178", then the inverse Gamma compensation provides the display brightness of approximately "116".

That is, the drive mode (B) of FIG. 4B and the conversion characteristics of FIG. 11 are selected in the first field (an odd field), and the multi-level gray-scale processing provides the following display brightness. That is, for example, display brightness "82" at which the sub-fields SF1 to SF5 with five pixels of G (j, k) are in the light-emitting state, display brightness "128" at which the sub-fields SF1 to SF6 with six pixels of G (j, k+1) are in the light-emitting state, display brightness "128" at which the sub-fields SF1 to SF6 with six pixels of G (j+1, k) are in the light-emitting state, and display brightness "128" at which the sub-fields SF1 to SF6 with six pixels of G (j+1, k+1) are in the light-emitting state.

Thus, display brightness "116" is expressed by the average brightness of four pixels adjacent up and down and the left and right.

Now, the drive mode (A) of FIG. 4A and the conversion characteristics of FIG. 12 are selected in the second field (an even field), and multi-level gray-scale processing provides the following display brightness. That is, for example, display brightness "155" at which the sub-fields SF1 to SF6 with six pixels of G (j, k) are in the light-emitting state, display brightness "104" at which the sub-fields SF1 to SF5 with five pixels of G (j, k+1) are in the light-emitting state, display brightness "104" at which the sub-fields SF1 to SF5 with five pixels of G (j+1, k) are in the light-emitting state, and display brightness "104" at which the sub-fields SF1 to SF5 with five pixels of G (j+1, k+1) are in the light-emitting state.

Thus, display brightness "116" is expressed by the average brightness of four pixels adjacent up and down and the left and right.

Then, in odd fields such as fields 1, 3, 5, and 7, the drive mode (B) of FIG. 4B and the conversion characteristics of FIG. 11 are selected. Meanwhile, the error diffusion or the values of dither coefficients to be assigned to respective four pixels are changed in each field, whereby the display brightness of each pixel varies as shown in FIG. 24.

Likewise, in even fields such as fields 2, 4, 6, and 8, the drive mode (A) of FIG. 4A and the conversion characteristics of FIG. 12 are selected. Meanwhile, the error diffusion or the values of dither coefficients to be assigned to the respective four pixels are changed in each field, whereby the display brightness of each pixel varies as shown in FIG. 24.

The aforementioned combination of the method of changing the light-emission drive pattern at each field (frame) and the multi-level gray-scale processing provides improved capability of the expression of visual levels of halftone and improved display quality.

However, the two types of light-emission drives having light-emission periods different from each other are performed alternately at each field (frame) as mentioned above. This may cause the center of gravity of the light-emission in one field period to be displaced, resulting in and the occurrence of flicker.

This is caused by the light-emission period (the number of times of light-emission) set to a different value at the light-emission sustaining step of each sub-field in the drive modes (A) and (B) as shown in FIGS. 4A and 4B. In the drive modes (A) and (B) shown in FIGS. 4A and 4B, the center of gravity provided by the drive mode (B) is always located at the back of that provided by the drive mode (A) for the same input pixel data D.

In the foregoing, the center of gravity of light-emission is determined based on the length of the pixel data writing step of a sub-field in the light-emitting state during one field period, the length of the light-emission sustaining step, and the weight assigned to the light-emission period.

FIGS. 25A and 25B show diagrammatically the displacement of the center of gravity of light-emission at even and odd fields.

For example, in even fields (drive mode (A)) of FIG. 24, the brightness of a plurality of pixels is averaged as shown in FIG. 25A. Thus, this allows the whole period of the light-emission sustaining step of the sub-fields SF1 to SF5 in the drive mode (A) and the approximately ¼ of the period of the light-emission sustaining step of the sub-field SF6 to enter the light-emitting state. At this time, the center of gravity of light-emission is located at $T_1$.

Furthermore, in odd fields (drive mode (B)) of FIG. 24, the brightness of a plurality of pixels is averaged as shown in FIG. 25B. Thus, this allows the whole period of the light-emission sustaining step of the sub-fields SF1 to SF5 in the drive mode (B) and approximately ¾ of the period of the light-emission sustaining step of the sub-field SF6 to enter the light-emitting state. At this time, the center of gravity of light-emission is located at $T_2$.

As such, both even fields of the drive mode (A) and odd fields of the drive mode (B) have approximately the same average display brightness, however, the displacement of the center of gravity of light-emission causes flicker to be produced.

FIGS. 26A, 26B and FIGS. 27A, 27B show an example of the light-emission drive format provided to prevent the flickering, respectively.

Figures 26A, 26B:
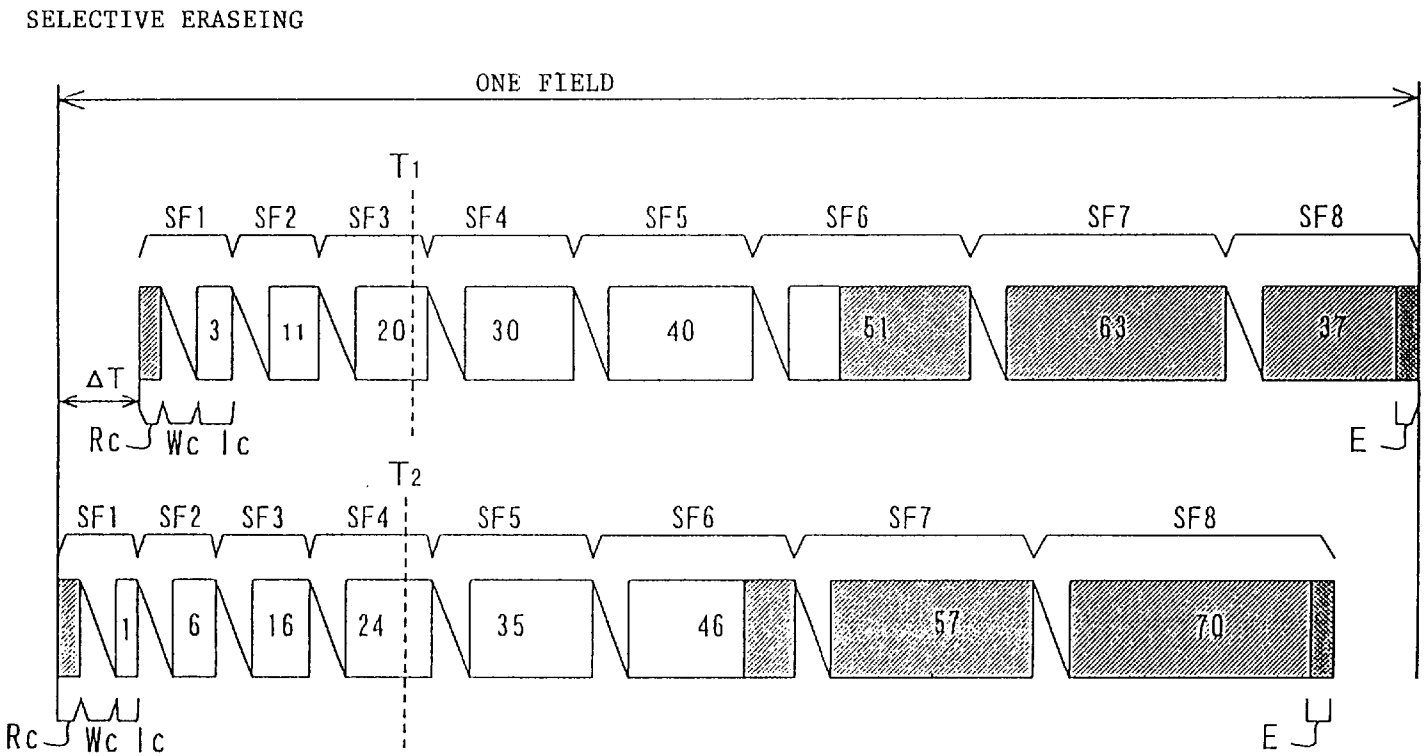
FIGS. 26A and 26B are views showing an example of a light-emission drive format for preventing flickering caused by a displacement of the center of gravity of light-emission caused by the light-emission drive in respective drive modes (A) and (B).

First, the light-emission drive formats shown in FIGS. 26A and 26B allow the start-up timing of the light-emission drive shown in the drive mode (A) to be delayed by a predetermined period AT relative to the start-up timing of the light-emission drive shown in the drive mode (B). This provides less displacement between both centers of gravity of light-emission $T_1$ and $T_2$ and thus reduces flicker.

In the foregoing, the flicker is more conspicuous at a higher display brightness. Thus, the aforementioned predetermined period ΔT is set to such a constant value that allows the center of gravity of light-emission $T_1$ in the drive mode (A) to correspond with the center of gravity of light-emission $T_2$ in the drive mode (B), at the maximum display brightness level "255".

Incidentally, the displacement between the center of gravity of light-emission $T_1$ in the drive mode (A) and the center of gravity of light-emission $T_2$ in the drive mode (B) varies with the display brightness level. That is, the displacement takes the maximum value at the maximum display brightness level, while the displacement becomes less with a decreasing display brightness level. The variation in the displacement caused by this display brightness level is small and small level of display brightness allows flickering to be less conspicuous. Thus, even setting the aforementioned predetermined period ΔT to a constant value as mentioned above provides a sufficient effect for preventing flicker. However, for the purpose of further prevention of flickering, the aforementioned predetermined period ΔT may be varied so that the centers of gravity of light-emission always coincides with each other.

Figures 27A, 27B:
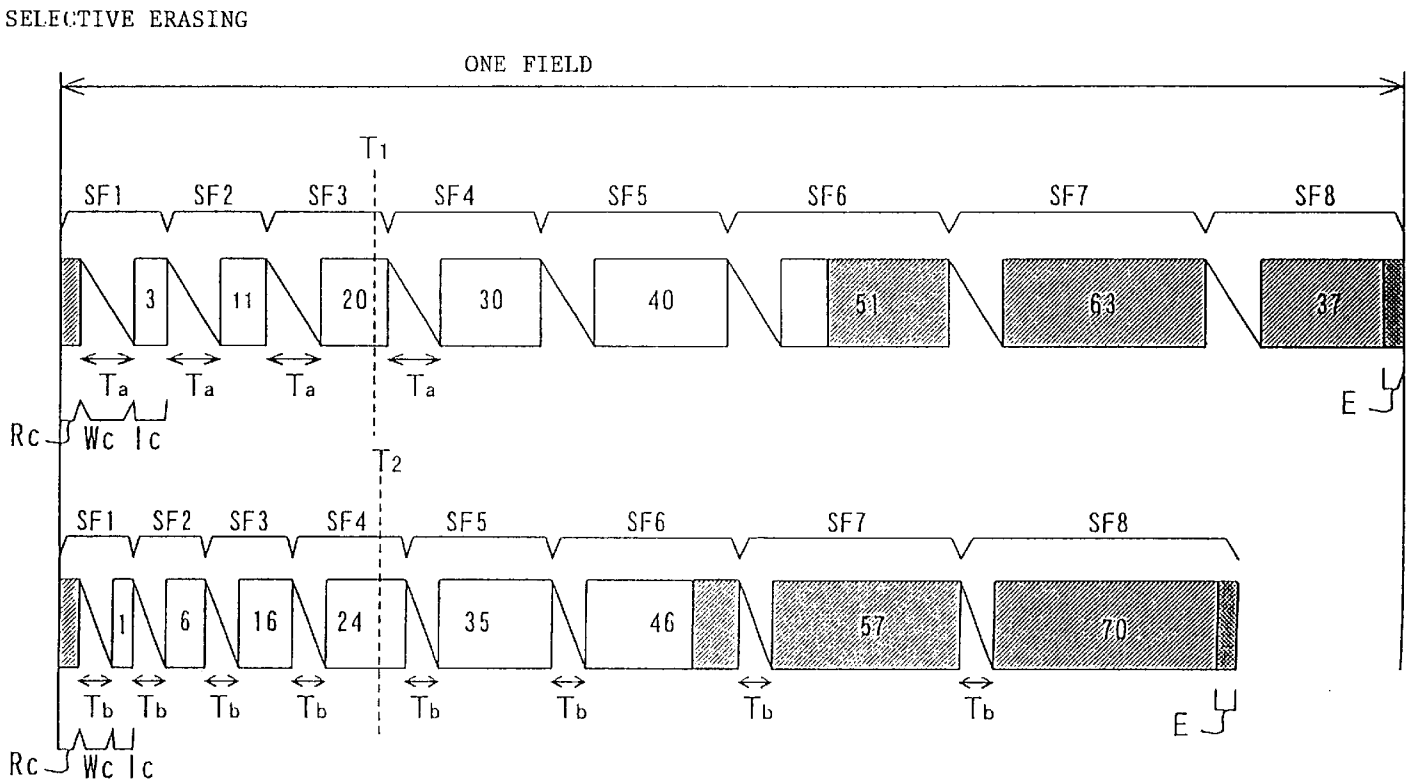
FIGS. 27A and 27B are views showing another example of a light-emission drive format for preventing flickering caused by a displacement of the center of gravity of light-emission caused by the light-emission drive in respective drive modes (A) and (B).

On the other hand, the light-emission drive formats shown in FIGS. 27A and 27B allow the execution period Ta of the pixel data writing step Wc of each of the sub-fields SF1 to SF4 in the drive mode (A) to be longer than the execution period Tb of the pixel data writing step Wc in the drive mode (B). This allows for providing less displacement between the centers of gravity of light-emission $T_1$ and $T_2$ to reduce flicker. For example, the pulse width of the scan pulse SP to be applied to the row electrodes of the PDP 10 is widened in the pixel data writing step Wc of each of the sub-fields SF1 to SF4 in the drive mode (A). This allows for making the execution period Ta longer than the execution period Tb.

Incidentally, in the aforementioned embodiment, the two types of light-emission drives of which light-emission periods are different for each other at each sub-field are to be switched at alternate fields (frames). However, the switching may be carried out at alternate lines of the PDP 10.

Figures 28A, 28B:
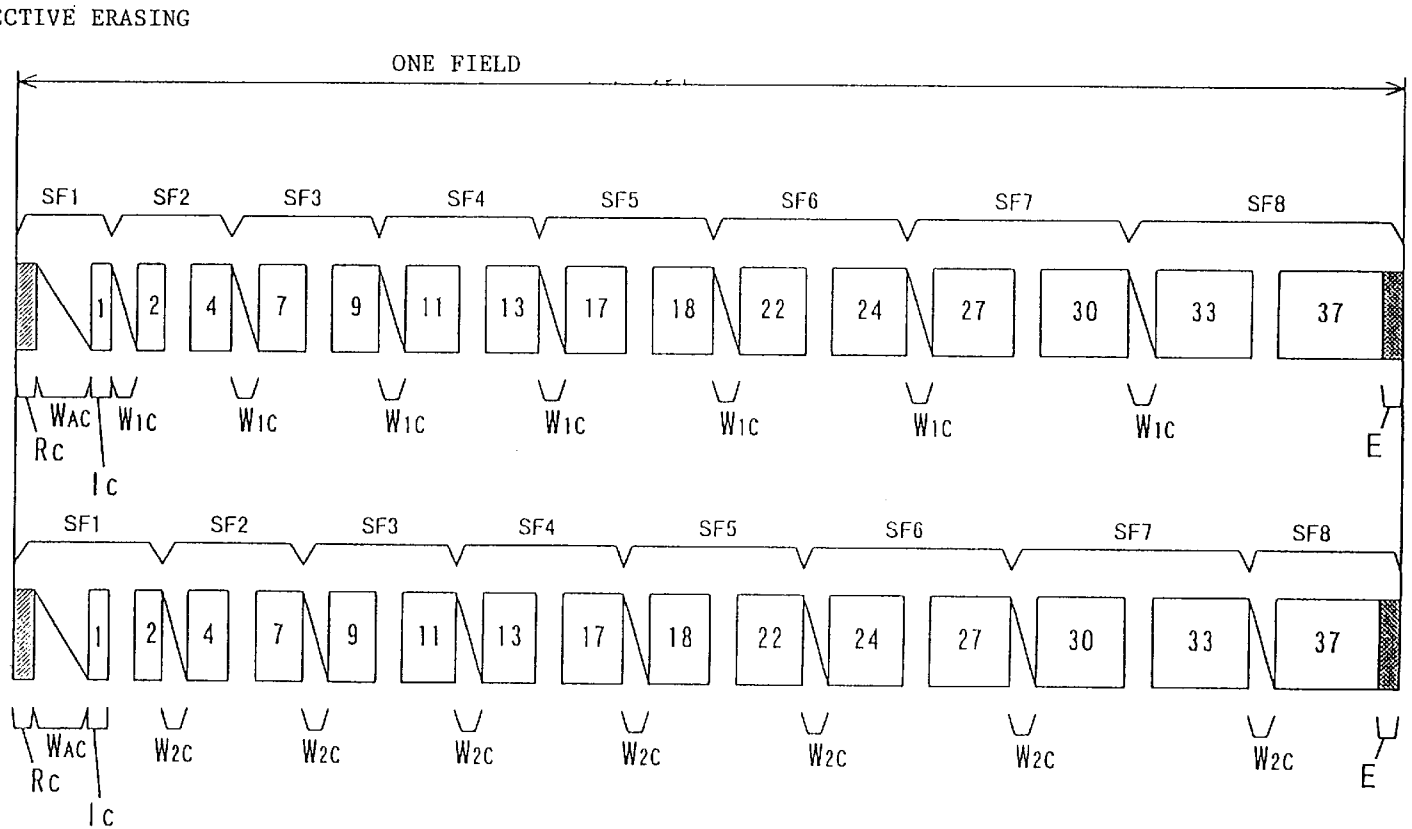
FIGS. 28A and 28B are views showing light-emission drive formats for use in the light-emission drive to be performed by switching the drive modes (A) and (B) for each row, or each row and field (frame).

FIGS. 28A and 28B show an example of the light-emission drive formats developed in view of the aforementioned point.

In FIGS. 28A and 28B, the selective erase discharge is carried out at all lines of the PDP 10 in the pixel data writing step $W_{AC}$. On the other hand, the selective erase discharge is carried out only at even lines of the PDP 10 in the pixel data writing step $W_{1C}$, while the selective erase discharge is carried out only at the odd lines in the pixel data writing step $W_{2C}$.

That is, at the discharge cells in the even lines of the discharge cells formed in respective lines 1 to n of the PDP 10, the light-emission drive is carried out in each sub-field at the following light-emission period ratio according to the drive mode (A) of FIG. 28A. That is, SF1: 1
SF2: 6
SF3: 16
SF4: 24
SF5: 35
SF6: 46
SF7: 57
SF8: 70

At the odd discharge cells, the light-emission drive is carried out in each sub-field at the following light-emission period ratio according to the drive mode (B) of FIG. 28B. That is, SF1: 3
SF2: 11
SF3: 20
SF4: 30
SF5: 40
SF6: 51
SF7: 63
SF8: 37

Furthermore, the two types of light-emission drives having light-emission periods different from each other at each sub-field, shown in drive modes (A) and (B) of FIGS. 28A and 28B, may be carried out at alternative fields (frames) and at alternative lines of the PDP 10.

At this time, in the pixel data writing step $W_{1C}$ shown in FIGS. 28A and 28B, the selective erase discharge is carried out only at the discharge cells of the even lines of the PDP 10 during the display period of odd frames. Additionally, the selective erase discharge is carried out only at the discharge cells of the odd lines during the display period of even frames. On the other hand, in the pixel data writing step $W_{2C}$, the selective erase discharge is carried out only at the discharge cells of the odd lines of the PDP 10 during the display period of odd frames. Additionally, the selective erase discharge is carried out only at the discharge cells of the even lines during the display period of even frames.

Figure 29:
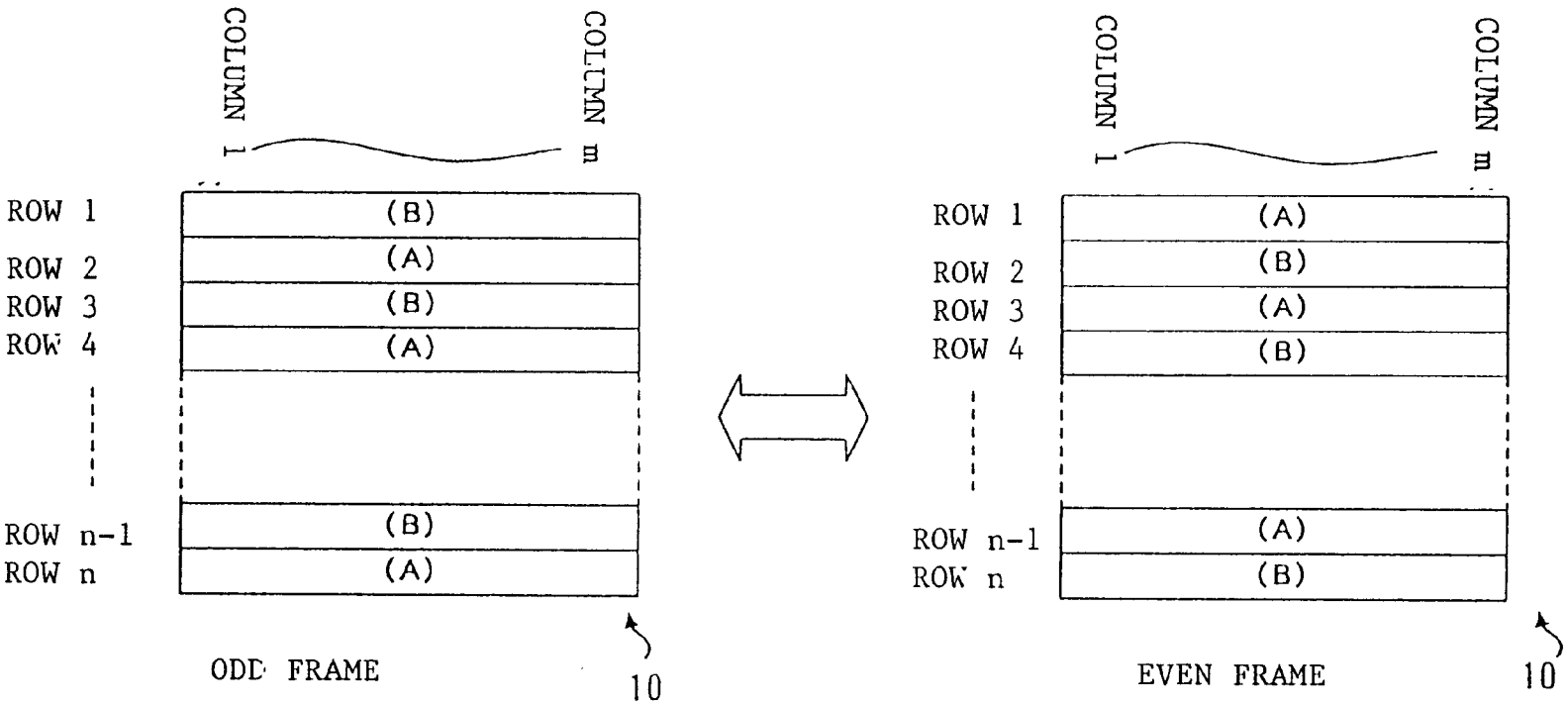
FIG. 29 is an explanatory view showing the operation when the drive modes (A) and (B) are switched for each row and each field (frame) for light-emission drive.

FIG. 29 shows the format of light-emission drive that is carried out by the aforementioned drive.

As shown in FIG. 29, during the display period of odd frames, light-emission drive is carried out at the discharge cells of the even lines of the PDP 10 in accordance with the drive mode (A) of FIG. 25A. On the other hand, light-emission drive is carried out at the discharge cells of the odd lines in accordance with the drive mode (B) of FIG. 25B. Furthermore, during the display period of even frames, light-emission drive is carried out at the discharge cells of the even lines of the PDP 10 in accordance with the drive mode (B) of FIG. 25B. On the other hand, light-emission drive is carried out at the discharge cells of the odd lines in accordance with the drive mode (A) of FIG. 25A. This drive allows for preventing flicker caused by carrying out the two types of light-emission drive at alternate fields (frames) such as the drive modes (A) and (B), of which light-emission periods are different from each other.

Incidentally, the drive mode to be changed at each field (frame) or each line is not limited to the aforementioned two types. In other words, three or more types of drive modes having light-emission periods different from each other at respective sub-fields may be prepared and switched in sequence at each field (frame) or at each line for carrying out a light-emission drive.

Furthermore, in the aforementioned embodiment, the selective erase (write) discharge is to be generated by the simultaneous application of the scan pulse SP and the high-tension pixel data pulse in one of the pixel data writing stepes Wc of the sub-fields SF1 to SF8.

However, a lower amount of charged particles remaining in discharge cells may cause the selective erase (write) discharge to be generated in a normal manner regardless of the simultaneous application of the scan pulse SP and the high-tension pixel data pulse. This may cause the wall charges in the discharge cells not to be erased (built up) in a normal manner. At this time, even when the A/D-converted pixel data D shows low brightness, light-emission corresponding to the maximum brightness is carried out, thus presenting a problem in that the display quality is significantly lowered. For example, take a case where the converted pixel data HD has the following value at the time of employing the selective erase addressing method as the pixel data write method, that is,

[01000000].

In this case, as shown by the black circles of FIG. 19, the selective erase discharge is carried out only at the sub-field SF2, during which the discharge cells are changed to non-light-emitting cells. This should allow the sustaining light emission to be carried out only at SF1 among the sub-fields SF1 to SF8. However, when the selective erase fails at the sub-field SF2 to cause the wall charge to remain in the discharge cell, the sustaining light-emission is carried out not only at the sub-field SF1 but also at the subsequent sub-fields SF2 to SF8. Consequently, this leads to the maximum brightness display.

For this reason, the light-emission drive patterns shown in FIG. 30 and FIG. 31 are employed to prevent such accidental light-emission as above. Incidentally, FIG. 30 shows a light-emission drive format used when the selective erase addressing method is employed, while FIG. 31 shows a light-emission drive format used when the selective write addressing method is employed, respectively.

The "*" shown in FIG. 30 and FIG. 31 indicates that any one of logic level "1" or "0"may be selected, and the triangular mark indicates that the selective erase (write) discharge is carried out only when the "*" is logic level "1".

In other words, since the initial selective erase (write) discharge may fail to write pixel data, the selective erase (write) discharge is repeated at least in one of the subsequent sub-fields. This ensures pixel data writing and prevents accidental light-emission.

As described above, the method for driving a plasma display panel, according to the present invention, can provide improved expression of levels of halftone as well as improved display quality. Furthermore, the method can provide improved contrast as well as prevent quasi-contour and reduce power consumption.

The embodiments of the present invention will be explained below with reference to the drawings.

Figure 32:
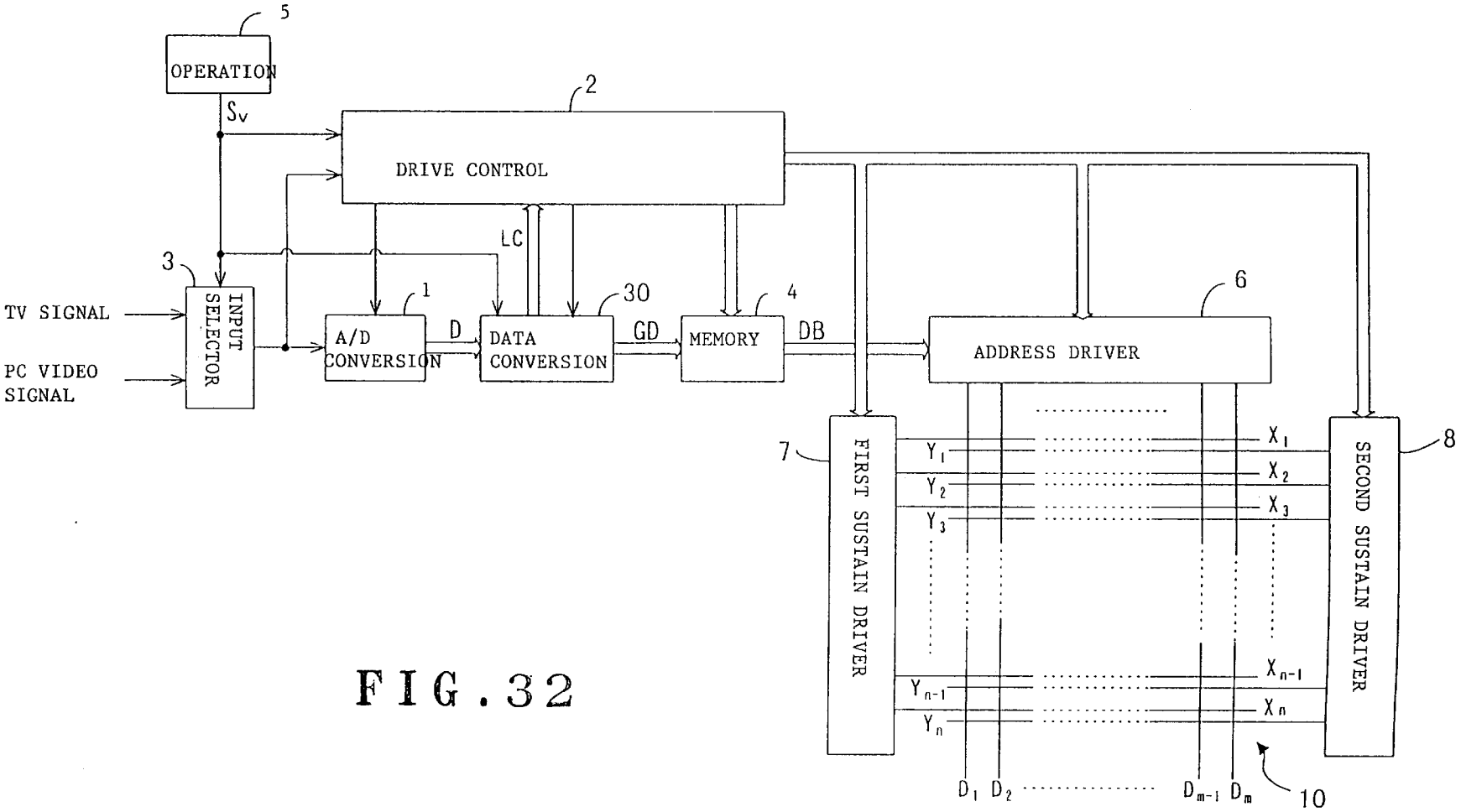
FIG. 32 is a view showing the general configuration of a plasma display device for driving a plasma display panel in accordance with the drive method of the present invention.

FIG. 32 is a view showing the general configuration of a plasma display device for driving a plasma display panel (hereinafter designated "PDP") to allow it to emit light in accordance with the drive method of a second aspect of the present invention.

The plasma display device comprises a drive portion having an operating unit 5, a drive control circuit 2, an input selector 3, an A/D converter 1, a data converter 300, a memory 4, an addressing driver 6, a first sustain driver 7, and a second sustain driver 8. The device also comprises a PDP 10 as a plasma display panel.

Incidentally, the plasma display device supports video signals from personal computers, that is, the PC video signal, as well as television signals of the NTSC scheme, and is provided with separate input terminals (not shown) specifically designed for inputting respective video signals of these different schemes.

Referring to FIG. 32, the operating unit 5 generates the input-designated video signal Sv corresponding to the video signal designated by the user for input, and then supplies the signal Sv to the drive control circuit 2, the input selector 3, and the data converter 300, respectively. The operating unit 5 generates, for example, the input-designated video signal Sv of logic level "0" when the user has designated the aforementioned PC video signal as the video signal to be displayed. On the other hand, the unit 5 generates the input-designated video signal Sv of logic level "1" when the user has designated the color television signal (hereinafter called the "TV signal").

The input selector 3 selects either the PC video signal supplied via the aforementioned input terminals or the TV signal, whichever one corresponds to the aforementioned input-designated video signal Sv and is in turn supplied to the A/D converter 1 as an input video signal. Incidentally, the PC video signal and the TV signal are Gamma-corrected in advance.

The A/D converter 1 samples the input video signal supplied from the aforementioned input selector 3 in response to the clock signal supplied from the drive control circuit 2 and then converts the input video signal, for example, into the pixel data D of 8 bits. That is, the A/D converter 1 converts the analog input video signal supplied from the input selector 3 into the 8-bit pixel data that is allowed for expressing brightness with 256 levels of half-tone.

The data converter 300 converts, corresponding to the 8-bit pixel data D, the data obtained through the brightness tuning and multi-level gray-scale processing, respectively, into the display drive pixel data GD for actually driving respective pixels of the PDP 10. Then, the data converter 300 supplies the display drive pixel data GD to the memory 4.

Figure 33:
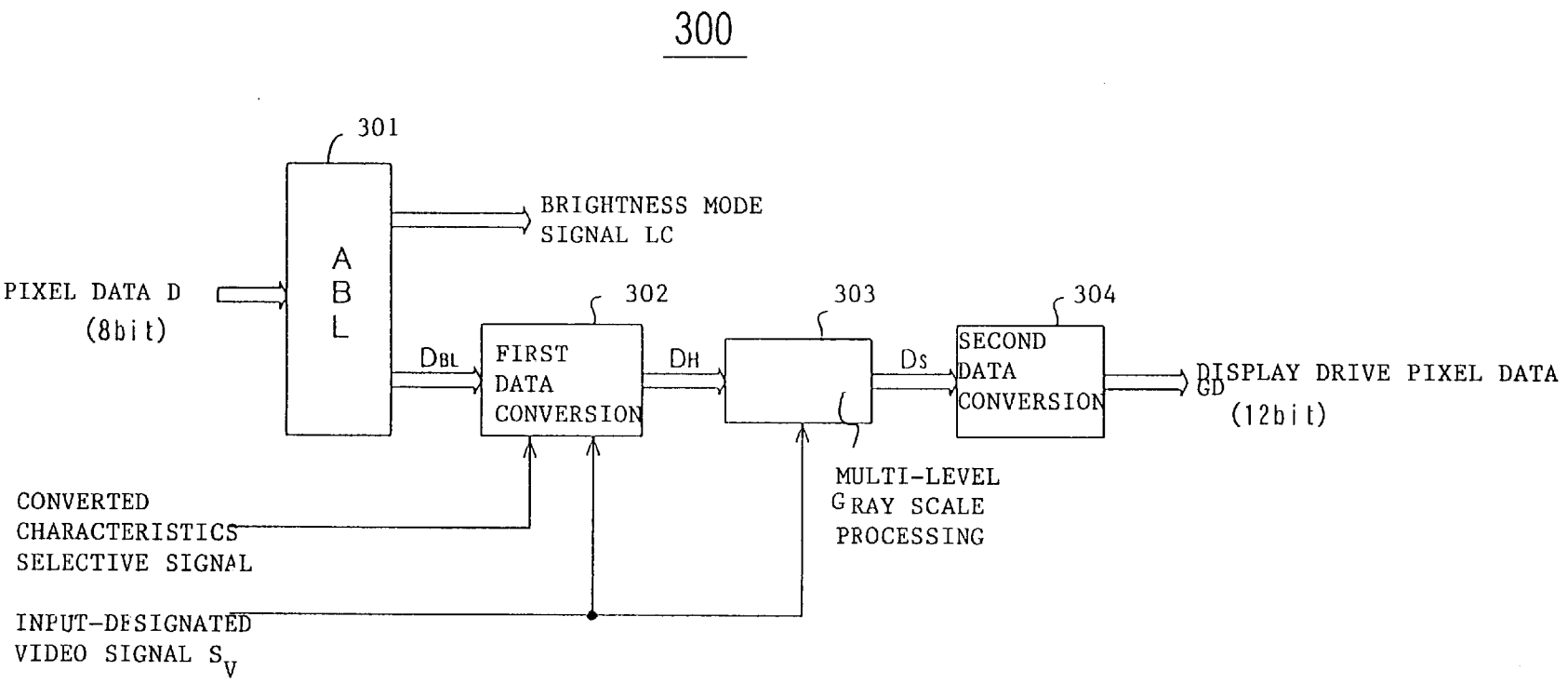
FIG. 33 is a view showing the internal configuration of a data converter 300.

FIG. 33 is a view showing the internal configuration of the data converter 300.

As shown in FIG. 33, the data converter 300 comprises an ABL (automatic brightness control) circuit 301, a first data converter 302, a multi-level gray-scale processing circuit 303, and a second data converter 304.

The ABL circuit 301 tunes the brightness level of the pixel data D of each pixel supplied in sequence from the A/D converter 1 so that the average brightness of a picture image displayed on the screen of the PDP 10 falls within an adequate brightness range. Then, the ABL circuit 301 supplies the brightness-tuning pixel data $D_{BL}$ thus obtained to the first data converter 302.

Figure 34:
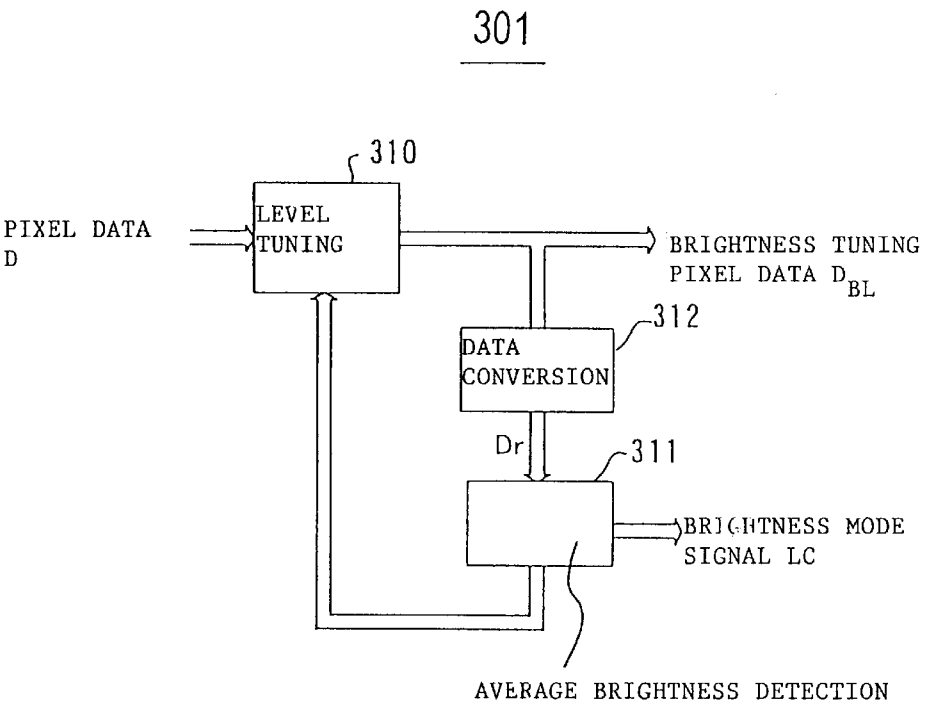
FIG. 34 is a view showing the internal configuration of an ABL circuit 301.

FIG. 34 is a view showing the internal configuration of the ABL circuit 301. Incidentally, the ABL circuit 301 has the same configuration as that of the ABL circuit 31 shown in FIG. 7.

Figure 35:
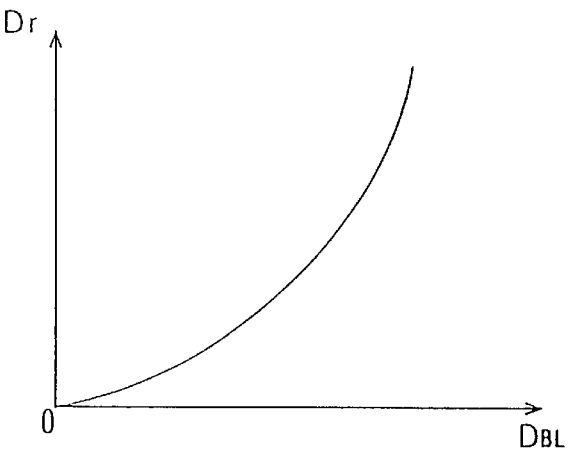
FIG. 35 is a view showing the conversion characteristics of the data converter 312.

Referring to FIG. 34, the level tuning circuit 310 outputs the brightness-tuning pixel data $D_{BL}$ obtained by tuning the level of the pixel data D based on the average brightness determined at an average brightness detection circuit 311 to be described later. The data converter 312 supplies the brightness-tuned pixel data $D_{BL}$ to the average brightness detection circuit 311 as the inverse-Gamma-converted pixel data Dr, the brightness-tuned pixel data $D_{BL}$ being converted so as to have the inverse Gamma characteristics ($Y=X^{2.2}$) with non-linear characteristics shown in FIG. 35. That is, applying the inverse Gamma compensation to the brightness-tuned pixel data $D_{BL}$ allows for restoring pixel data (inverse-Gamma-converted pixel data Dr) corresponding to the original Gamma-compensation-release video signal. The average brightness detection circuit 311 determines the inverse-Gamma-converted pixel data Dr first. At this stage, the average brightness detection circuit 311 determines which brightness mode the average brightness corresponds to among the brightness modes 1 to 4. The modes are the four levels into which the range between the maximum and the minimum brightness has been divided. The average brightness detection circuit 311 supplies the average brightness determined as mentioned above to the aforementioned level tuning circuit 310, while supplying the brightness mode signal LC that indicates the corresponding brightness mode to the drive control circuit 2. That is, the level tuning circuit 310 supplies the pixel data D to which level has been tuned according to the average brightness, as the aforementioned brightness-tuned pixel data $D_{BL}$, to the aforementioned data converter 312 and the subsequent first data converter 32.

Figure 36:
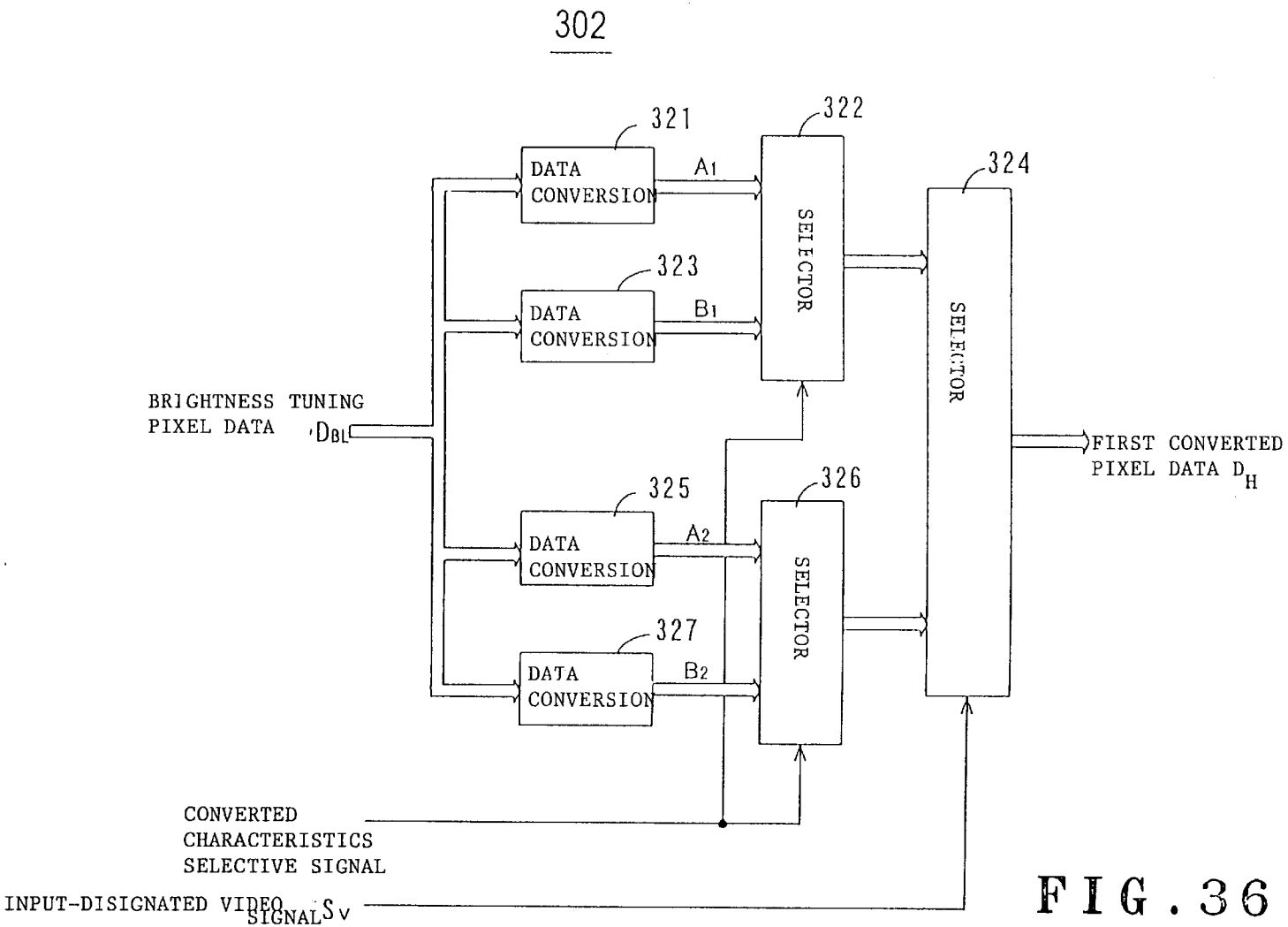
FIG. 36 is a view showing the internal configuration of a first data converter 302.

FIG. 36 is a view showing the internal configuration of the first data converter 302.

Figure 37A:
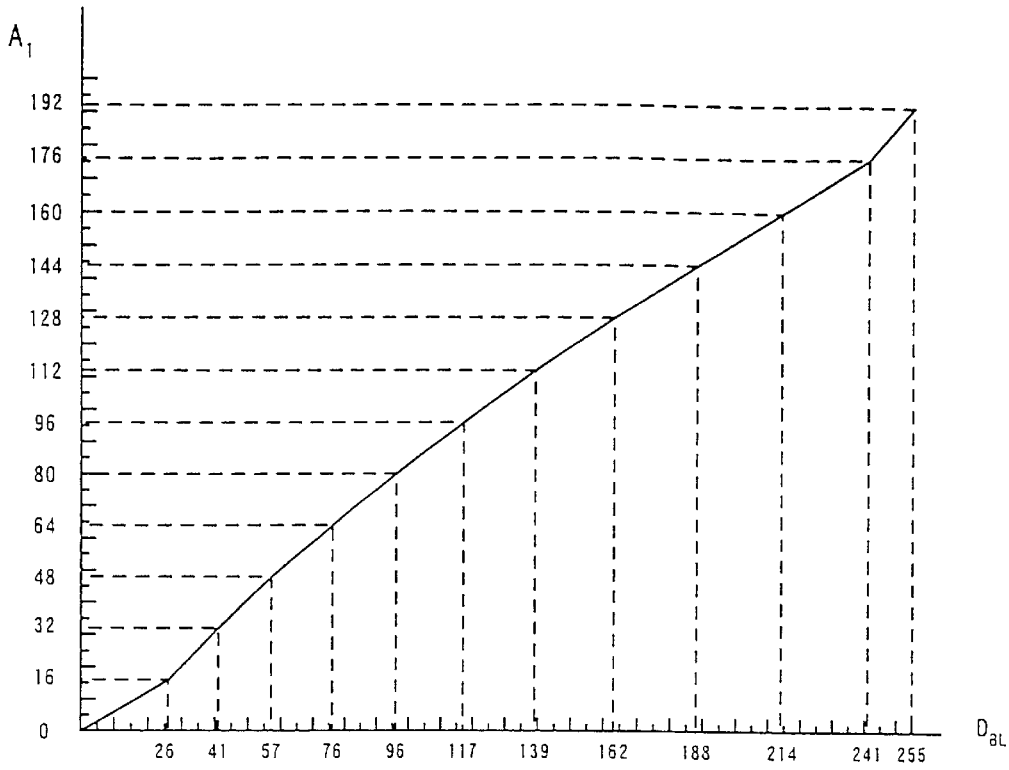
FIGS. 37A and 37B are views showing the data conversion characteristics for use in the first data converter 302 when TV signals are designated as input.

Referring to FIG. 36, the data converter 321' converts the aforementioned brightness-tuned pixel data $D_{BL}$ into 8-bit converted pixel data $A_1$ having "0" to "192" in accordance with the conversion characteristics shown in FIG. 37A, which is in turn supplied to the selector 322. The data converter 323' converts the aforementioned brightness-tuned pixel data $D_{BL}$ into 8-bit converted pixel data $B_1$ having "0" to "192" in accordance with the conversion characteristics shown in FIG. 37B, which is in turn supplied to the selector 322. The selector 322 selects in an alternative manner either one of the converted pixel data $A_1$ or $B_1$, whichever one that corresponds to the logic level of the conversion characteristics selective signal and is in turn supplied to a selector 324. Incidentally, the aforementioned conversion characteristics selective signal is a signal which is supplied from the aforementioned drive control circuit 2 and changes from logic level "1" to "0" or from "0" to 1" in response to the vertical synchronization timing of the input video signal. A data converter 325 converts the aforementioned brightness-tuned pixel data $D_{BL}$ into 9-bit converted pixel data $A_2$ having 0" to "384" in accordance with the conversion characteristics shown in FIG. 38A, which is in turn supplied to a selector 326. A data converter 327 converts the aforementioned brightness-tuned pixel data $D_{BL}$ into 9-bit converted pixel data $B_2$ having "0" to "384" in accordance with the conversion characteristics shown in FIG. 38B, which is in turn supplied to the selector 326. The selector 326 selects in an alternative manner either one of the converted pixel data $A_2$ or $B_2$, whichever one that corresponds to the logic level of the conversion characteristics selective signal and is in turn supplied to a selector 324. The selector 324 selects in an alternative manner either one of the converted pixel data $A_1$ (or $B_1$) supplied from the selector 322 or the converted pixel data $A_2$ (or $B_2$) supplied from the selector 326, whichever one that corresponds to the logic level of the input-designated video signal Sv. Then, the selector 324 supplies the data to the subsequent multi-level gray-scale processing circuit 33 as the first converted pixel data $D_H$.

Figure 37B:
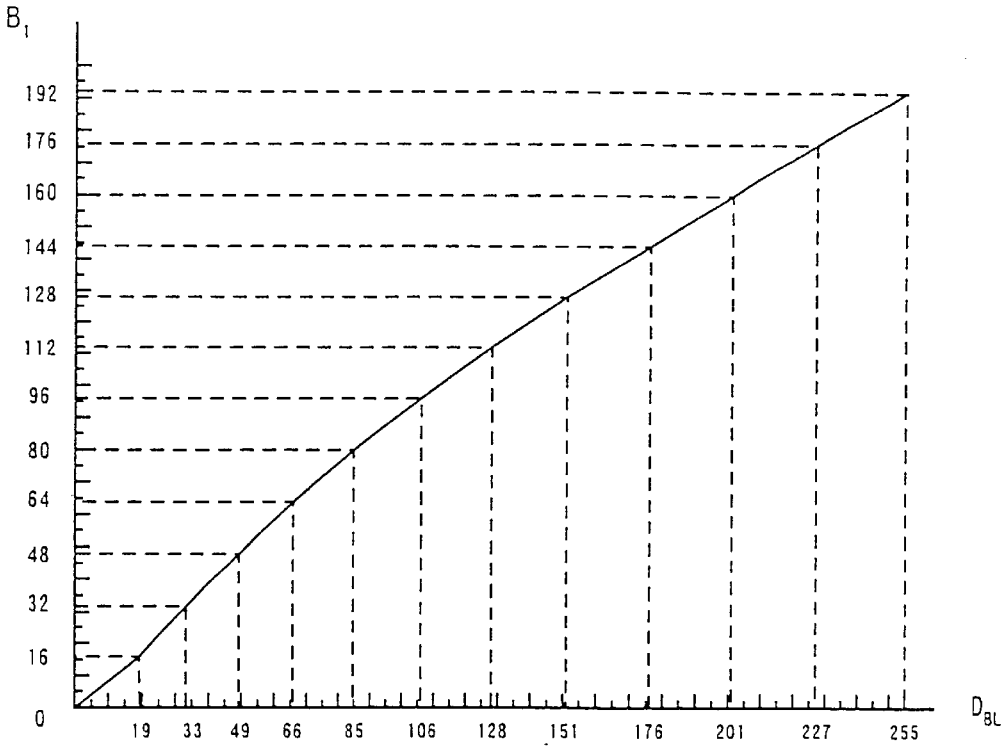
Figure 38A:
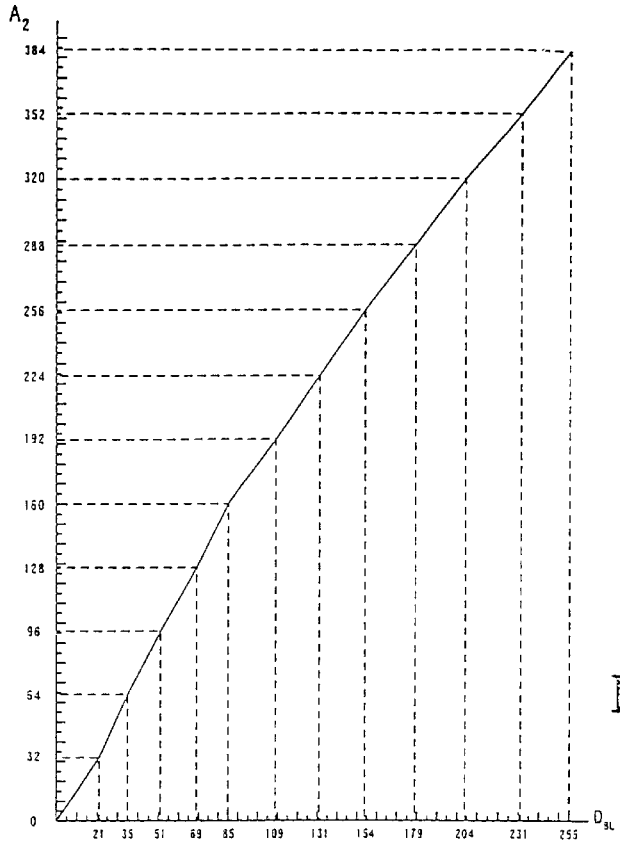
FIGS. 38A and 38B are views showing the data conversion characteristics for use in the first data converter 302 when PC video signals are designated as input.
Figure 38B:
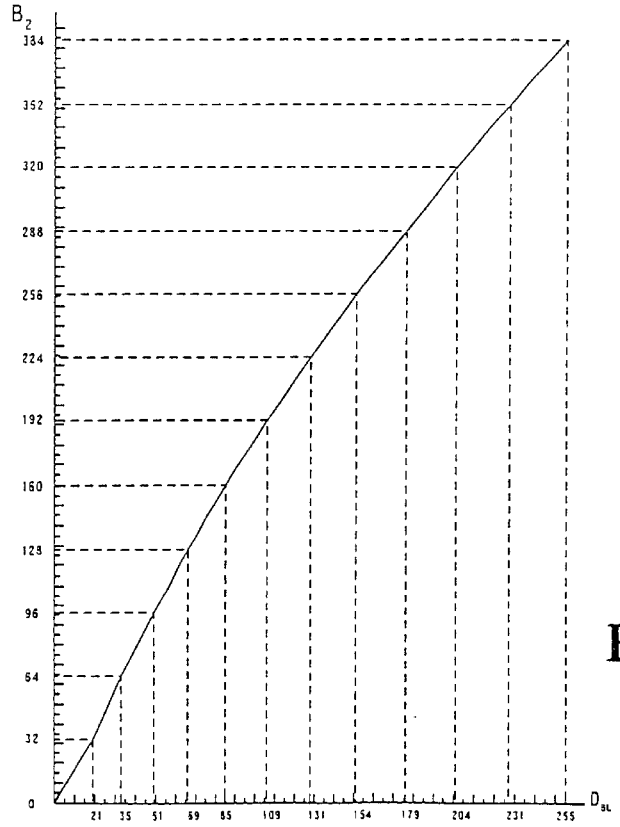

With the configuration shown in FIG. 36, when the operating unit 5 has the TV signal designated as input, the first data converter 302 converts the brightness-tuned pixel data $D_{BL}$ of 8 bits of "0" to "255" into the first converted pixel data DH of 8 bits of "0" to "192". The conversion is carried out based on the conversion characteristics shown in FIGS. 37A and 37B, and then the first converted pixel data DH is supplied to the multi-level gray-scale processing circuit 303. On the other hand, when the PC video signal is designated as input, the brightness-tuned pixel data $D_{BL}$ of 8 bits of "0" to "255" is converted into the first converted pixel data $D_H$ of 9 bits of "0" to "384". The conversion is carried out based on the conversion characteristics shown in FIGS. 38A and 38B, and then the first converted pixel data DH is supplied to the multi-level gray-scale processing circuit 303. Incidentally, FIG. 37A and FIG. 38A show the conversion characteristics used for displaying odd fields (odd frames), while FIG. 37B and FIG. 38B show the conversion characteristics used for displaying even fields (even frames). That is, when the TV signal is designated as an input, the first data converter 302 switches the conversion characteristics used for the conversion thereof at each field (frame) as shown in FIGS. 37A and 37B. On the other hand, when the PC video signal is designated as an input, the conversion characteristics used for the conversion thereof are switched at each field as shown in FIGS. 38A and 38B.

As mentioned above, the first data converter 302 is provided at the preceding stage of the multi-level gray-scale processing circuit 303 to be described later. Then, data conversion is carried out to the number of display levels of halftone and the number of compressed bits resulting from the operation of the multi-level gray scale. This prevents the occurrence of flat portions, caused by the occurrence of brightness saturation resulting from the multi-level gray scale processing and absence of display levels of gray scale at a bit boundary, in the display characteristics (that is, the occurrence of disorder in gray scale levels).

Figure 39:
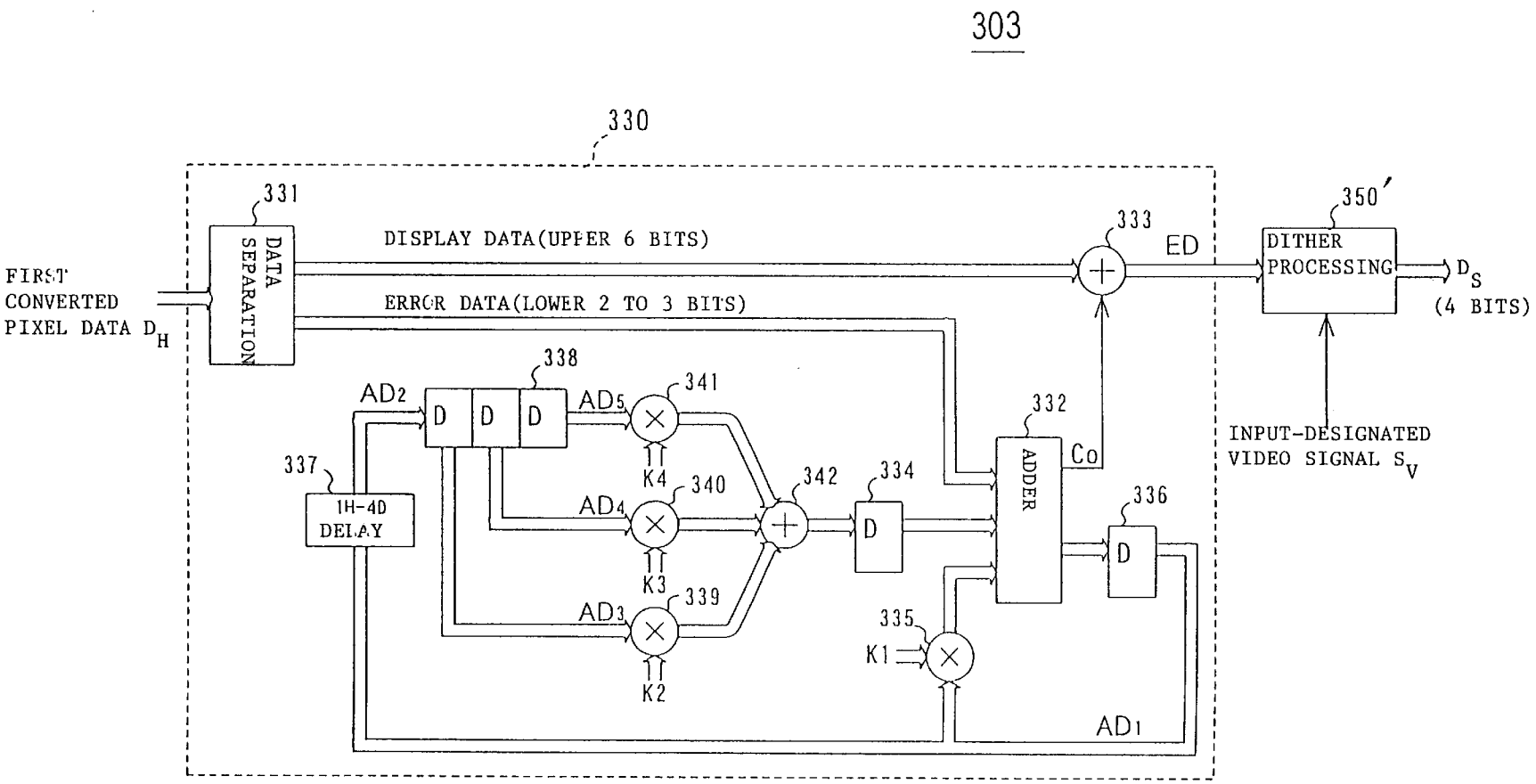
FIG. 39 is a view showing the internal configuration of a multi-level gray scale processing circuit 303.

FIG. 39 shows the internal configuration of the multi-level gray-scale processing circuit 303.

As shown in FIG. 39, the multi-level gray-scale processing circuit 303 comprises the error-diffusion processing circuit 330 and the dither processing circuit 350. Since the configuration of the error-diffusion-processing circuit 330 is the same as that shown in FIG. 15, explanation is not repeated.

P45

The dither processing circuit 350 applies dither processing to the error-diffusion processing pixel data ED supplied by the error-diffusion processing circuit 330. This allows for generating the multi-level gray-scale pixel data $D_S$ having the number of bits further reduced to four, while maintaining brightness levels of halftone equivalent to the error-diffusion processing pixel data ED of 6 bits. Incidentally, dither processing expresses one intermediate display level by means of a plurality of adjacent pixels. Take as an example the case where pixel data of an upper 6 bits among 8-bit pixel data is used to express a gray scale display equivalent to an 8-bit expression. In this case, four pixels adjacent on the left and right, above and below, are taken as one set. Then, four dither coefficients a to d, which have coefficient values different from each other, are assigned to the pixel data corresponding to the set of respective pixels and added, respectively. The dither processing generates four different combinations of intermediate display levels with four pixels. Therefore, even when the pixel data has 6 bits, it is allowed for expressing the intermediate display with four times the level of halftone, that is, 8-bit-equivalent intermediate display.

However, even the addition of dither patterns of dither coefficients a to d to respective pixels may cause noise resulting from the dither patterns being recognized visually, thus reducing the display quality.

For this reason, the dither processing circuit 350 changes, at each field, with the aforementioned dither coefficients a to d that should be assigned to the respective four pixels.

Figure 40:
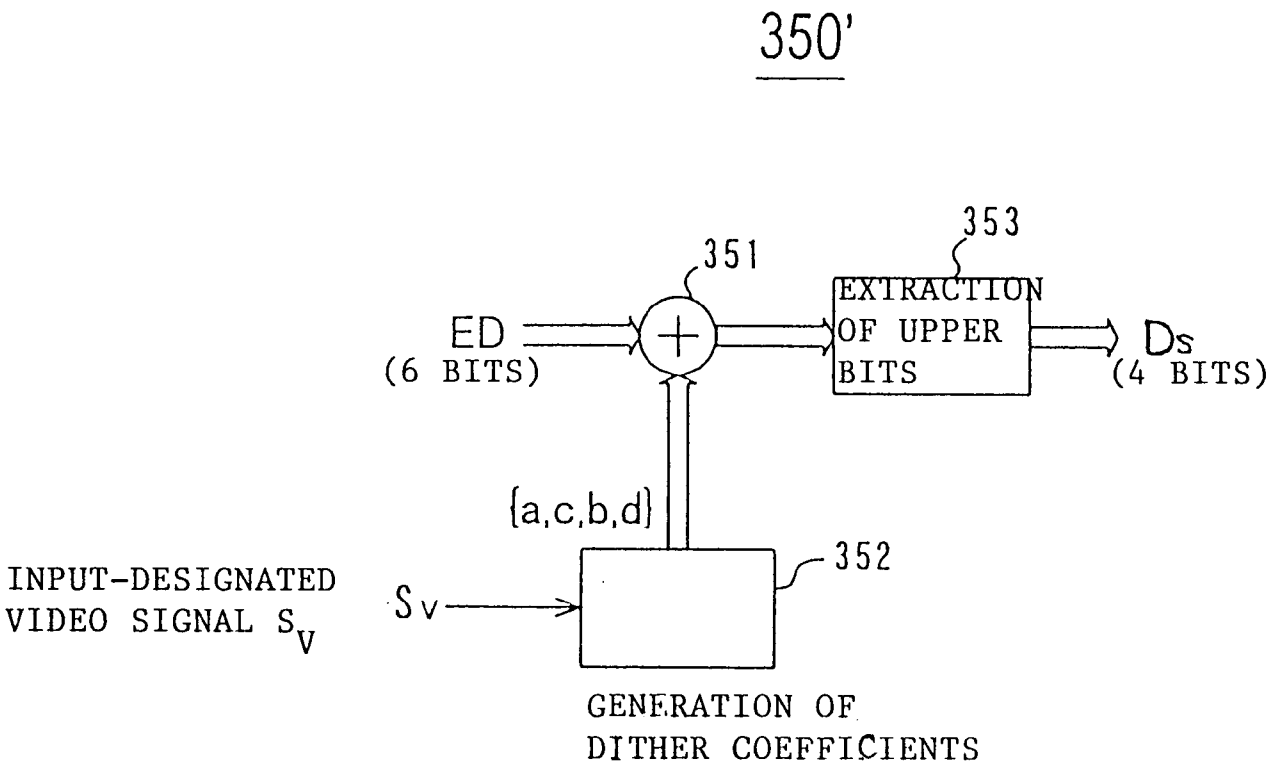
FIG. 40 is a view showing the internal configuration of a dither processing circuit 350.

FIG. 40 shows the internal configuration of the dither processing circuit 350.

Referring to FIG. 40, the dither coefficient generating circuit 352' generates four dither coefficients a, b, c, and d, for four respective pixels that are adjacent to each other, which are in turn supplied to the adder 351 in sequence. Incidentally, the dither coefficient generating circuit 352' generates dither coefficients with different values in response to the designated input video signal indicated by the aforementioned input-designated video signal Sv.

That is, when the video signal designated for input by the input-designated video signal Sv is the TV signal, the following dither coefficients a to d comprising two bits, respectively, are generated as shown in FIG. 41. That is, dither coefficient a: 0, dither coefficient b: 1, dither coefficient c: 2, and dither coefficient d: 3.

On the other hand, when the video signal designated for input is the PC video signal, the following dither coefficients a to d comprising three bits, respectively, are generated as shown in FIG. 41. That is, dither coefficient a: 0 (or 1), dither coefficient b: 2 (or 3), dither coefficient c: 4 (or 5), and dither coefficient d: 6 (or 7).

For example, as shown in FIG. 18, four dither coefficients a to d are generated corresponding to four pixels, respectively. The four pixels are pixel G (j, k) and pixel G (j, k+1) corresponding to row j, and pixel G (j+1, k) and pixel G (j+1, k+1) corresponding to row (j+1). The dither coefficient generating circuit 352 changes, for each field as shown in FIG. 18, the aforementioned dither coefficients a to d that should be assigned to the respective four pixels.

The dither coefficient generating circuit 352' generates the dither coefficients a to d repeatedly in a cyclic manner and supplies the coefficients to the adder 351.

The dither coefficient generating circuit 352' executes repeatedly the operation of the first to fourth fields mentioned above. That is, upon completion of generating the dither coefficients at the fourth field, the above-mentioned operation is repeated all over again from the aforementioned first field. The adder 351 adds the dither coefficients a to d which are assigned to respective fields as mentioned above to the error diffusion processing pixel data ED, respectively. Hereupon, the error diffusion processing pixel data ED correspond to the aforementioned pixel G (j, k), pixel G (j, k+1), pixel G (j+1, k), and pixel G (j+1, k+1), respectively, which are supplied by the aforementioned error diffusion processing circuit 330. The adder 351 then supplies the dither additional pixel data thus obtained to the upper bit extracting circuit 353.

For example, at the first field shown in FIGS. 45A and 45B, each of the following data is supplied sequentially as the dither additional pixel data to the upper bit extracting circuit 353. That is, error diffusion processing pixel data ED corresponding to pixel G (j, k)+dither coefficient a, error diffusion processing pixel data ED corresponding to pixel G (j, k+1)+dither coefficient b, error diffusion processing pixel data ED corresponding to pixel G (j+1, k)+dither coefficient c, and error diffusion processing pixel data ED corresponding to pixel G (j+1, k+1)+dither coefficient d.

The upper bit extracting circuit 353 extracts the bits up to the upper four bits of the dither additional pixel data for output as multi-level gray scale pixel data $D_S$.

As mentioned above, the dither processing circuit 350' shown in FIG. 39 changes the aforementioned dither coefficients a to d that should be associated with and assigned to each of the four pixels. This allows for determining the multi-level gray-scale pixel data $D_S$ of 4 bits having a visually multi-level gray scale while reducing visual noise caused by dither patterns, which is then supplied to the second data converter 34.

The second data converter 34 converts the multi-level gray-scale pixel data Ds into the display drive pixel data GD of bits 1 to 12 in accordance with the conversion table shown in FIG. 14. Incidentally, the respective bits 1 to 12 correspond to each of the sub-fields SF1 to SF12 to be described later.

As mentioned above, the data converter 30 comprises the ABL circuit 31, the first data converter 32, the multi-level gray-scale processing circuit 33, and the second data converter 34. By this data converter 30, the pixel data D that is capable of expressing 256 levels of halftone with 8 bits is converted into the display drive pixel data GD of 12 bits comprising 13 patterns in total as shown in FIG. 42.

The memory 4 of FIG. 32 writes and stores sequentially the aforementioned display drive pixel data GD in accordance with the write signal supplied by the drive control circuit 2. The write action allows for writing the display drive pixel data $GD_{11\text{-}nm}$ for one screen (with n rows and m columns). Then, in accordance with the read signal supplied by the drive control circuit 2, the memory 4 reads the display drive pixel data $GD_{11\text{-}nm}$ for each row by associating the same bit digit with each other, which is then supplied to the addressing driver 6. That is, the memory 4 regards the display drive pixel data $GD_{11\text{-}nm}$ of one screen comprising 12 bits, respectively, as the 12-way-split display drive pixel data $DB1_{11\text{-}nm}$ to $DB12_{11\text{-}nm}$ shown as follows. That is, $DB_{11\text{-}nm}$: the first bit of the display-drive pixel data $GD_{11\text{-}nm}$ $DB2_{11\text{-}nm}$: the second bit of the display-drive pixel data $GD_{11\text{-}nm}$ $DB3_{11\text{-}nm}$: the third bit of the display-drive pixel data $GD_{11\text{-}nm}$ $DB4_{11\text{-}nm}$: the fourth bit of the display-drive pixel data $GD_{11\text{-}nm}$ $DB5_{11\text{-}nm}$: the fifth bit of the display-drive pixel data $GD_{11\text{-}nm}$ $DB6_{11\text{-}nm}$: the sixth bit of the display-drive pixel data $GD_{11\text{-}nm}$ $DB7_{11\text{-}nm}$: the seventh bit of the display-drive pixel data $GD_{11\text{-}nm}$ $DB8_{11\text{-}nm}$: the eighth bit of the display-drive pixel data $GD_{11\text{-}nm}$ $DB9_{11\text{-}nm}$: the ninth bit of the display-drive pixel data $GD_{11\text{-}nm}$ $DB10_{11\text{-}nm}$: the tenth bit of the display-drive pixel data $GD_{11\text{-}nm}$ $DB11_{11\text{-}nm}$: the eleventh bit of the display-drive pixel data $GD_{11\text{-}nm}$ $DB12_{11\text{-}nm}$: the twelfth bit of the display-drive pixel data $GD_{11\text{-}nm}$ Then, the memory 4 reads the data $DB1_{11\text{-}nm}$, $DB2_{11\text{-}nm}$, . . . $DB12_{11\text{-}nm}$ in sequence line by line in accordance with the read signal supplied by the drive control circuit 2 and then supplies the data to the addressing driver 6.

The drive control circuit 2 generates clock signals for the aforementioned A/D converter 1 and write/read signals for the memory 4 in synchronization with the horizontal and vertical synchronizing signals included in the aforementioned input video signal. Furthermore, the drive control circuit 2 generates various timing signals for controllably driving each of an addressing driver 6, a first sustain driver 7, and a second sustain driver 8 in synchronization with the horizontal and vertical synchronizing signals.

The addressing driver 6 generates, in accordance with a timing signal supplied by the drive control circuit 2, m pulses of pixel data having voltages corresponding to respective logic levels of the display drive pixel data bits DB for a line which are read from the memory 4. These pulses are applied to column electrodes $D_1$ to $D_m$ of PDP 10, respectively.

The PDP 10 comprises the aforementioned column electrodes D1 to Dm as address electrodes, and row electrodes $X_1$ to $X_n$ and row electrodes $Y_1$ to $Y_n$, which are disposed orthogonal to the column electrodes. The PDP 10 allows a pair of a row electrode X and a row electrode Y to form a row electrode corresponding to one line. That is, in the PDP 10, the row electrode pair of the first line consists of row electrodes $X_1$ and $Y_1$ and the row electrode pair of the nth line consists of row electrodes $X_n$ and $Y_n$. The aforementioned pairs of row electrodes and column electrodes are coated with a dielectric layer exposed to a discharge space, and each row electrode pair and column electrode are configured so as to form a discharge cell corresponding to a pixel at their intersection.

In accordance with a timing signal supplied by the drive control circuit 2, the first and second sustain drivers 7 and 8 generate the various drive pulses, respectively, which are to be explained below. These pulses are in turn applied to the row electrodes $X_1$ to $X_n$ and $Y_1$ to $Y_n$ of the PDP 10.

Figure 43:
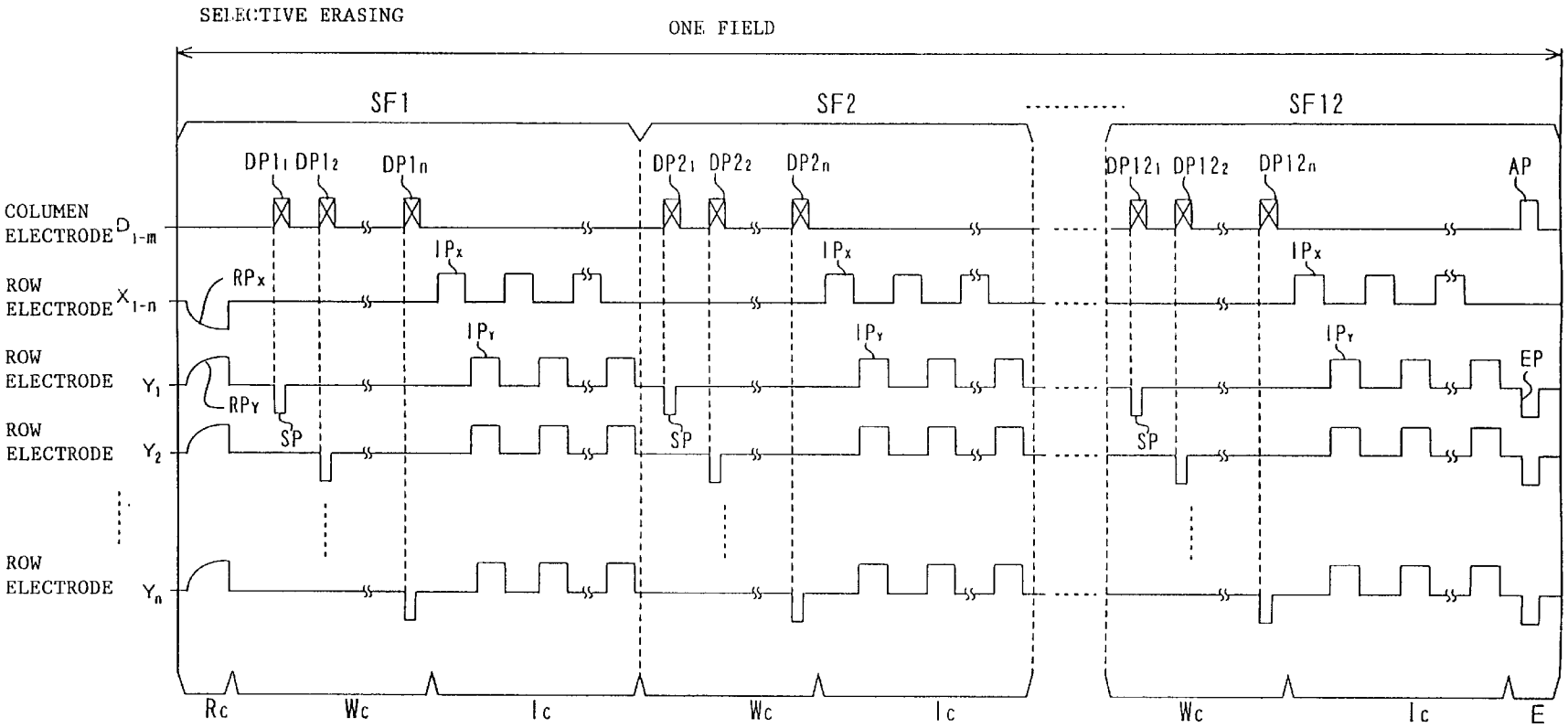
FIG. 43 is a view showing the application timing of various types of drive pulses to be applied to PDP 10 during one field display period during the selective erase addressing method.

FIG. 43 is a view showing the application timing of various drive pulses which are applied to the column electrodes $D_1$ to $D_m$, and the row electrodes $X_1$ to $X_n$ and $Y_1$ to $Y_n$ by the aforementioned addressing driver 6, and the first and second sustain drivers 7 and 8, respectively.

In the example shown in FIG. 43, a display period of one field is divided into 12 sub-fields SF1 to SF12 to drive the PDP 10. At this time, in each of the sub-fields, the pixel data writing step Wc is performed to write pixel data to each discharge cell of the PDP 10 for setting "light-emitting cells" and "non-light-emitting cells". The light-emission sustaining step Ic is also performed in each of the sub-fields to sustain light-emission of the only "light-emitting cells" mentioned above for a period (the number of times) corresponding to the weight assigned to each sub-field. However, only in the head sub-field SF1, is the simultaneous reset process Rc for initializing all discharge cells of the PDP 10 performed and the erase process E is executed only in the last sub-field SF12.

First, in the aforementioned simultaneous reset process Rc, the first and second sustain drivers 7 and 8 apply simultaneously the reset pulses $RP_X$ and $RP_Y$ shown in FIG. 43 to the row electrodes $X_1$ to $X_n$ and $Y_1$ to $Y_n$ of the PDP 10, respectively. The application of these reset pulses $RP_X$ and $RP_Y$ will cause all discharge cells of the PDP 10 to be reset and discharged, forming a predetermined uniform wall charge in each of the discharge cells. This will set all discharge cells of the PDP 10 to the aforementioned "light-emitting cells" for the time being.

Subsequently, in the pixel data writing step Wc, the addressing driver 6 generates a pixel data pulse having a voltage corresponding to the logic level of the display drive pixel data bit DB supplied by the aforementioned memory 4. The addressing driver 6 applies sequentially the data pulse to the column electrode $D_{1\text{-}m}$ line by line. That is, first, in the pixel data writing step Wc of the sub-field SF1, $DB1_{11\text{-}1m}$ which corresponds to the first line of the sub-field is extracted from the aforementioned display drive pixel data bit $DB1_{11\text{-}nm}$. Then, the pixel data pulse group $DP1_1$ comprising m pixel data pulses corresponding to the logic levels of the respective $DB1_{11\text{-}1m}$ is generated and applied to the column electrode $D_{1\text{-}m}$. Subsequently, $DB1_{21\text{-}2m}$ that corresponds to the second line of the sub-field is extracted from the display drive pixel data bit $DB1_{11\text{-}nm}$. Then, the pixel data pulse group $DP1_2$ comprising m pixel data pulses corresponding to the logic levels of the respective $DB1_{21-2m}$ is generated and applied to the column electrode $D_{1-m}$. Likewise, in the pixel data writing step Wc of the sub-field SF1, the pixel data pulse groups $DP1_3$ to $DP1_n$ for one line are applied to the column electrodes $D_{1-m}$ in sequence. Subsequently, in the pixel data writing step Wc of the sub-field SF2, $DB2_{11-1m}$ which corresponds to the first line of the sub-field is first extracted from the aforementioned display drive pixel data bit $DB2_{11-nm}$. Then, the pixel data pulse group $DP2_1$ comprising m pixel data pulses corresponding to the logic levels of the respective $DB2_{11-1m}$ is generated and applied to the column electrode $D_{1-m}$. Subsequently, $DB2_{21-2m}$ that corresponds to the second line of the sub-field is extracted from the display drive pixel data bit $DB2_{11-nm}$. Then, the pixel data pulse group $DP2_2$ comprising m pixel data pulses corresponding to the logic levels of the respective $DB2_{21-2m}$ is generated and applied to the column electrode $D_{1-m}$. Likewise, in the pixel data writing step Wc of the sub-field SF2, the pixel data pulse groups $DP2_3$ to $DP2_n$ for one line are applied to the column electrodes $D_{1-m}$ in sequence. Likewise, in the pixel data writing step Wc of the sub-fields SF3 to SF12, the addressing driver 6 assigns the pixel data pulse groups $DP3_{1-n}$ to $DP12_{1-n}$ generated based on the respective display drive pixel data bits $DB3_{11-nm}$ to $DB12_{11-nm}$ to the sub-fields SF3 to SF12, respectively. Then, the addressing driver 6 applies the pixel data pulse groups $DP3_{1-n}$ to $DP12_{1-n}$ to the column electrodes $D_{1-m}$. Incidentally, it is assumed that the addressing driver 6 generates a high-tension pixel data pulse when the display drive pixel data bit DB has a logic level of "1", while generating a low-voltage (0 volt) pixel data pulse when the logic level is "0".

Furthermore, in the pixel data writing step Wc, the second sustain driver 8 generates the scan pulses SP of negative polarity shown in FIG. 43 at the same time as the application timing of each of the pixel data pulse groups DP as aforementioned. Then, the second sustain driver 8 applies the scan pulses SP in sequence to the row electrodes $Y_1$ to $Y_n$. At this time, discharge (selective erase discharge) is caused only at the discharge cells located at the intersections of the "lines" to which the scan pulse SP is applied and the "columns" to which a high-tension pixel data pulse is applied. The wall charges remaining within the discharge cells are selectively erased. That is, the respective $1^{st}$ to $12^{th}$ bits of the display drive pixel data GD determines whether the selective erase discharge should be generated in the pixel data writing step Wc of respective sub-fields SF1 to SF12. The selective erasing discharge causes the discharge cells that have been reset to the "light-emitting cell" at the aforementioned simultaneous reset process Rc to change to the "non-light-emitting cell". On the other hand, no discharge is generated in the discharge cells that are formed in the "columns" to which a low-voltage pixel data pulse is applied, and thus the preset state is sustained. That is, discharge cells of "non-light-emitting cells" remain as "non-light-emitting cells", while discharge cells of "light-emitting cells" remain as "light-emitting cells". Thus, the immediately subsequent light-emission sustaining step Ic allows for setting "light-emitting cells" in which sustaining discharge is generated and "non-light-emitting cells" in which sustaining discharge is not generated owing to the pixel data writing step Wc for each sub-field.

Subsequently, in the light-emission sustaining step Ic of each sub-field, the first and second sustain drivers 7 and 8 apply the sustaining pulses $IP_X$ and $IP_Y$ of positive polarity alternately as shown in FIG. 43 to the row electrodes $X_1$ to $X_n$ and $Y_1$ to $Y_n$, respectively.

The number of times of application of the sustain pulses IP applied in the light-emission sustaining step Ic is set in accordance with the weight assigned to each sub-field. In addition, the number of times differs according to the type of brightness mode signal LC supplied from the data converter 30 shown in FIG. 32, and the video signal selected as the input video signal at the aforementioned input selector 3.

FIG. 16 shows the number of times of application of the sustain pulses IP to be applied at the light-emission sustaining step Ic of respective sub-fields SF1 to SF12 when the TV signal is selected as an input video signal. Incidentally, FIGS. 44A and 44B show the number of times of application of the sustain pulses IP to be applied when odd fields (odd frames) are displayed and when even fields (even frames) are displayed, respectively, for each mode according to the brightness mode signal LC.

On the other hand, FIG. 45A shows the number of times of application of the sustain pulses IP to be applied at the light-emission sustaining step Ic of respective sub-fields SF1 to SF12 when the PC video signal is selected as an input video signal. Incidentally, FIGS. 45A and 45B show the number of times of application of the sustain pulses IP to be applied when odd fields (odd frames) are displayed and when even fields (even frames) are displayed, respectively, for each mode according to the brightness mode signal LC.

Take as an example the case where each of the input-designated video signals Sv that specify the TV signal as an input video signal and the brightness mode signal LC that indicates the brightness mode 1 is supplied. In this case, the drive control circuit 2 supplies various timing signals to the addressing driver 6, the first sustain driver 7, and the second sustain driver 8 in order to carry out actions according to the light-emission drive sequences shown in FIGS. 46A and 46B.

Figure 46A:
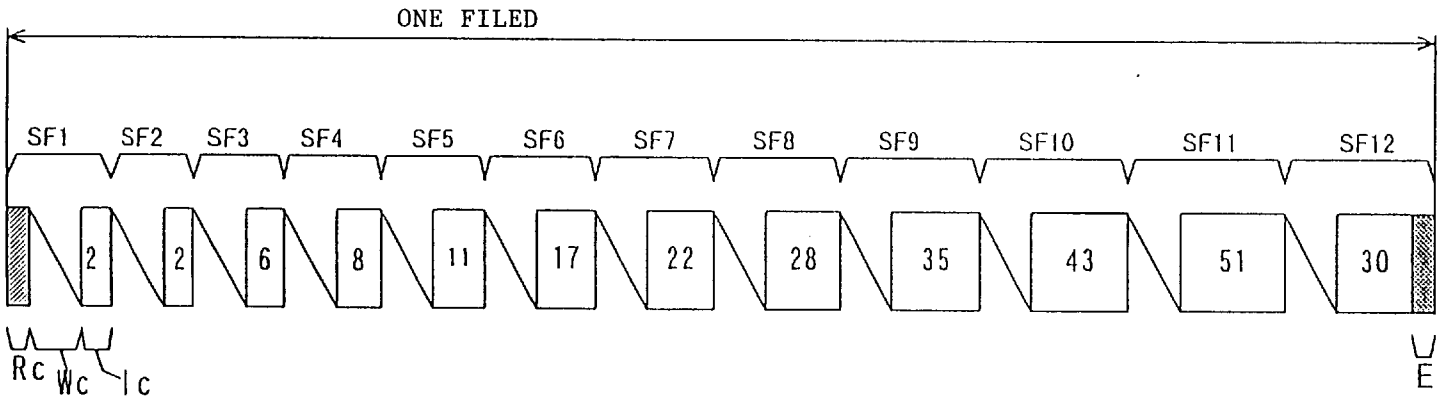
FIGS. 46A and 46B are views showing an example of the light-emission drive sequence to be performed when TV signals are designated as input.
Figure 46B:
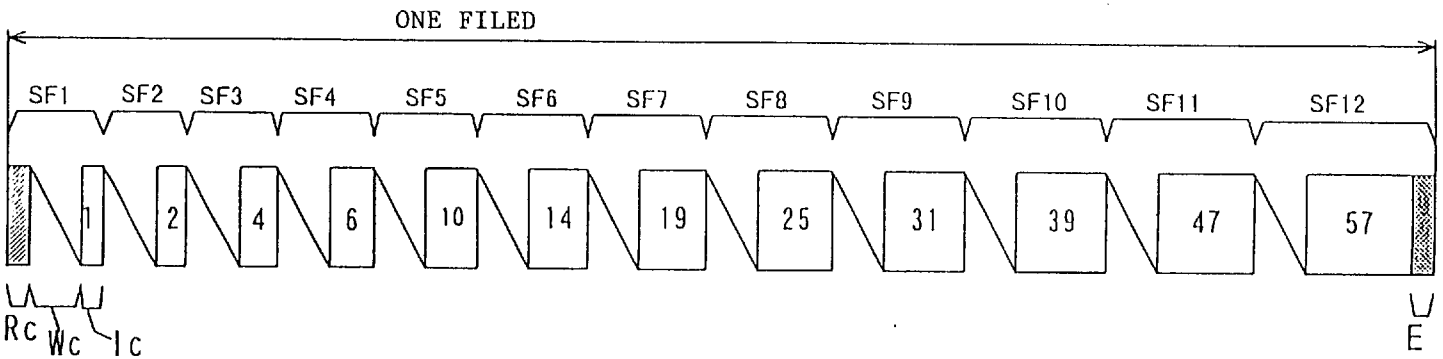

Incidentally, FIGS. 46A and 46B show the light-emission drive sequences to be carried out for displaying odd fields (odd frames) and for displaying even fields (even frames), respectively.

That is, when the input-designated video signal is the TV signal and has the brightness mode 1, the ratio of the number of times of application of the sustain pulses IP at the light-emission sustaining step Ic of respective sub-fields SF1 to SF12 is as follows.

That is, as shown in FIG. 46A, when odd fields (odd frames) are displayed,

SF1: 2
SF2: 2
SF3: 6
SF4: 8
SF5: 11
SF6: 17
SF7: 22
SF8: 28
SF9: 35
SF10: 43
SF11: 51
SF12: 30

On the other hand, as shown in FIG. 46B, when even fields (even frames) are displayed,

SF1: 1
SF2: 2
SF3: 4
SF4: 6
SF5: 10

SF6: 14

SF7: 19

SF8: 25

SF9: 31

SF10: 39

SF11: 47

SF12: 57

On the other hand, take as an example the case where each of the input-designated video signals Sv that specify the PC video signal as an input video signal and the brightness mode signal LC that indicates the brightness mode 1 is supplied. In this case, the drive control circuit 2 supplies various timing signals to the addressing driver 6, the first sustain driver 7, and the second sustain driver 8 in order to carry out actions according to the light-emission drive sequences as shown in FIGS. 47A and 47B.

Figure 47A:
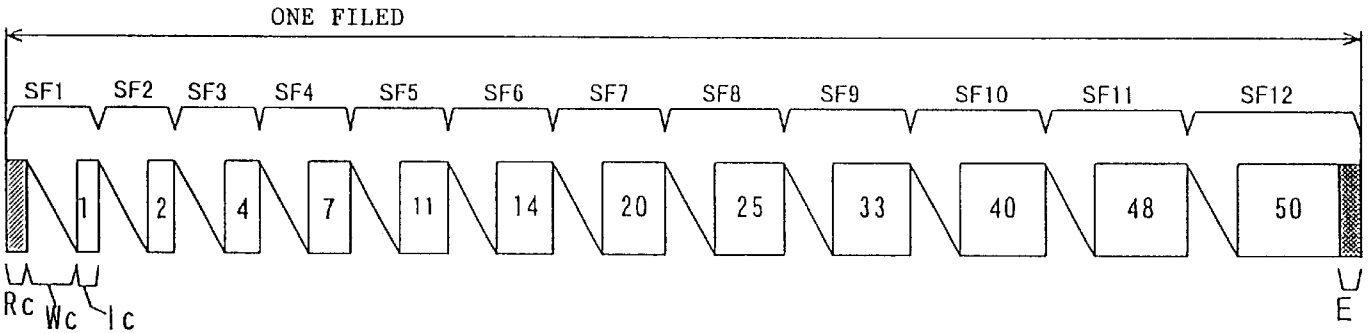
FIGS. 47A and 47B are views showing an example of the light-emission drive sequence to be performed when PC video signals are designated as input.
Figure 47B:
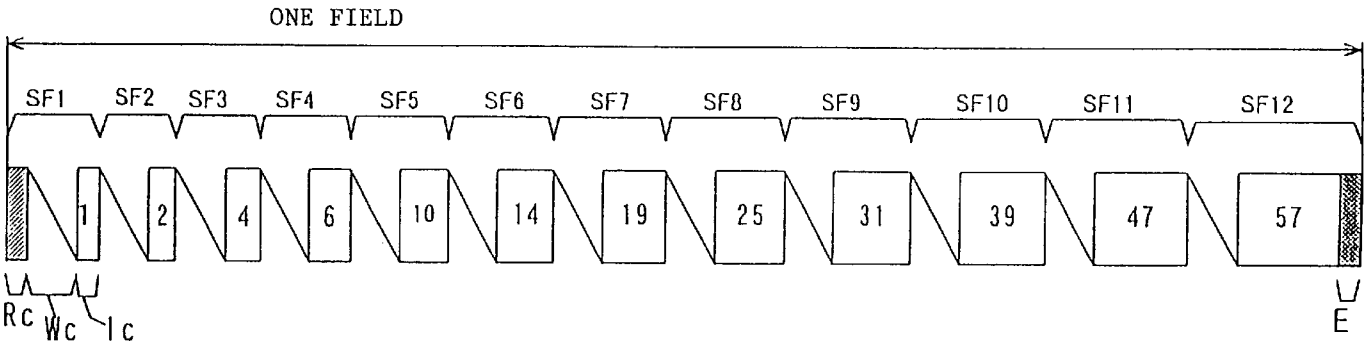

Incidentally, FIGS. 47A and 47B show the light-emission drive sequences to be carried out for displaying odd fields (odd frames) and for displaying even fields (even frames), respectively.

That is, when the input video signal is the PC video signal and has the brightness mode 1, the ratio of the number of times of application of the sustain pulses IP at the light-emission sustaining step Ic of respective sub-fields SF1 to SF12 is as follows.

That is, as shown in FIG. 47A, when odd fields (odd frames) are displayed,

SF1: 1

SF2: 2

SF3: 4

SF4: 7

SF5: 11

SF6: 14

SF7: 20

SF8: 25

SF9: 33

SF10: 40

SF11: 48

SF12: 50

On the other hand, as shown in FIG. 47B, when even fields (even frames) are displayed,

SF1: 1

SF2: 2

SF3: 4

SF4: 6

SF5: 10

SF6: 14

SF7: 19

SF8: 25

SF9: 31

SF10: 39

SF11: 47

SF12: 57

At this time, the ratio of the number of times of application of the sustain pulses IP to be applied at respective sub-fields SF1 to SF12 is non-linear (that is, the inverse Gamma ratio, $Y=X^{2.2}$). This allows for compensating for the non-linear characteristics (the Gamma characteristics) applied in advance to the input video signal. Incidentally, the number of sub-fields responsible for low-brightness light-emission among the aforementioned respective sub-fields SF1 to SF12 is made larger than that of the sub-fields responsible for high-brightness light-emission. That is, the sub-fields responsible for relatively low brightness light-emission for which the sustain pulse IP is applied 25 times or less are 8 sub-fields, from SF1 to SF8, and are greater in number than the sub-fields SF9 to SF12 that are responsible for high-brightness light-emission.

Then, the erase process E is carried out only at the last sub-field SF12.

In the erase process E, the address driver 6 generates an erase pulse AP having positive polarity as shown in FIG. 43 to apply it to column electrodes $D_{1-m}$. Furthermore, the second sustain driver 8 generates the erase pulse EP having positive polarity simultaneously at the application timing of the erase pulse AP to apply it to respective row electrodes $Y_1$ to $Y_n$. This simultaneous application of the erase pulses AP and EP causes erase discharge to be generated in all discharge cells of the PDP 10, allowing wall charges remaining within all discharge cells to disappear. That is, executing the erase discharge causes all discharge cells of the PDP 10 to be changed to "non-light-emitting cells".

In the foregoing, in the respective sub-fields shown in FIGS. 46A, 46B and FIGS. 47A, 47B, only the discharge cells that have been set to "light-emitting cells" at the pixel data writing step Wc repeat sustaining discharge to sustain the light-emission state by the number of times according to the aforementioned ratio of the number of times at the light-emission sustaining step Ic performed immediately thereafter.

At this time, it is determined by the display drive pixel data GD as shown in FIG. 42 that each discharge cell at each sub-field is set to a "light-emitting cell" or "non-light-emitting cell". That is, each bit 1 to 12 of the display drive pixel data GD corresponds to sub-fields SF1 to SF12, respectively. Thus, only when a bit has, for example, logic level "1", the selective erase discharge is generated in the pixel data writing step Wc of the sub-field corresponding to the digit of the bit and thus the discharge cell is set to the "non-light-emitting cell". On the other hand, when the bit has logic level "0", the aforementioned selective erase discharge is not generated and thus the present state is sustained. That is, the discharge cell of a "non-light-emitting cell" remains as a "non-light-emitting cell", while the discharge cell of a "light-emitting cell" remains as a "light-emitting cell". At this time, only the simultaneous reset process Rc only at the head sub-field SF1 can have a chance of changing a discharge cell from the "non-light-emitting cell" to the "light-emitting cell" in the sub-field SF1 to SF12. Therefore, the discharge cell that has been changed to a "non-light-emitting cell" by the selective erase discharge generated in the pixel data writing step Wc of any one of the sub-fields SF1 to SF12 after the completion of the simultaneous reset process Rc will never change again to a "light-emitting cell" in this field. Therefore, according to the data patterns of the display drive pixel data GD as shown in FIG. 42, each discharge cell remains as a "light-emitting cell" for a period until the selective erase discharge is generated at the sub-fields shown by the black circles of FIG. 42. The discharge cell carries out sustaining discharge by the aforementioned number of times at the light-emission sustaining step Ic of each sub-field, present during the period, indicated by the white circles.

As shown in FIG. 42, this allows gray scale drive having the following brightness expression of 13 levels of halftone when odd fields (odd frames) are displayed with the TV signal as the input video signal in brightness mode 1. That is,

{0: 2: 4: 10: 18: 29: 46: 68: 96: 131: 174: 225: 255}

The gray scale drive with the following brightness expression of 13 levels of halftone is carried out when even fields (even frames) are displayed. That is,

{0: 1: 3: 7: 13: 23: 37: 56: 81: 112: 151: 198: 255}

Figure 48:
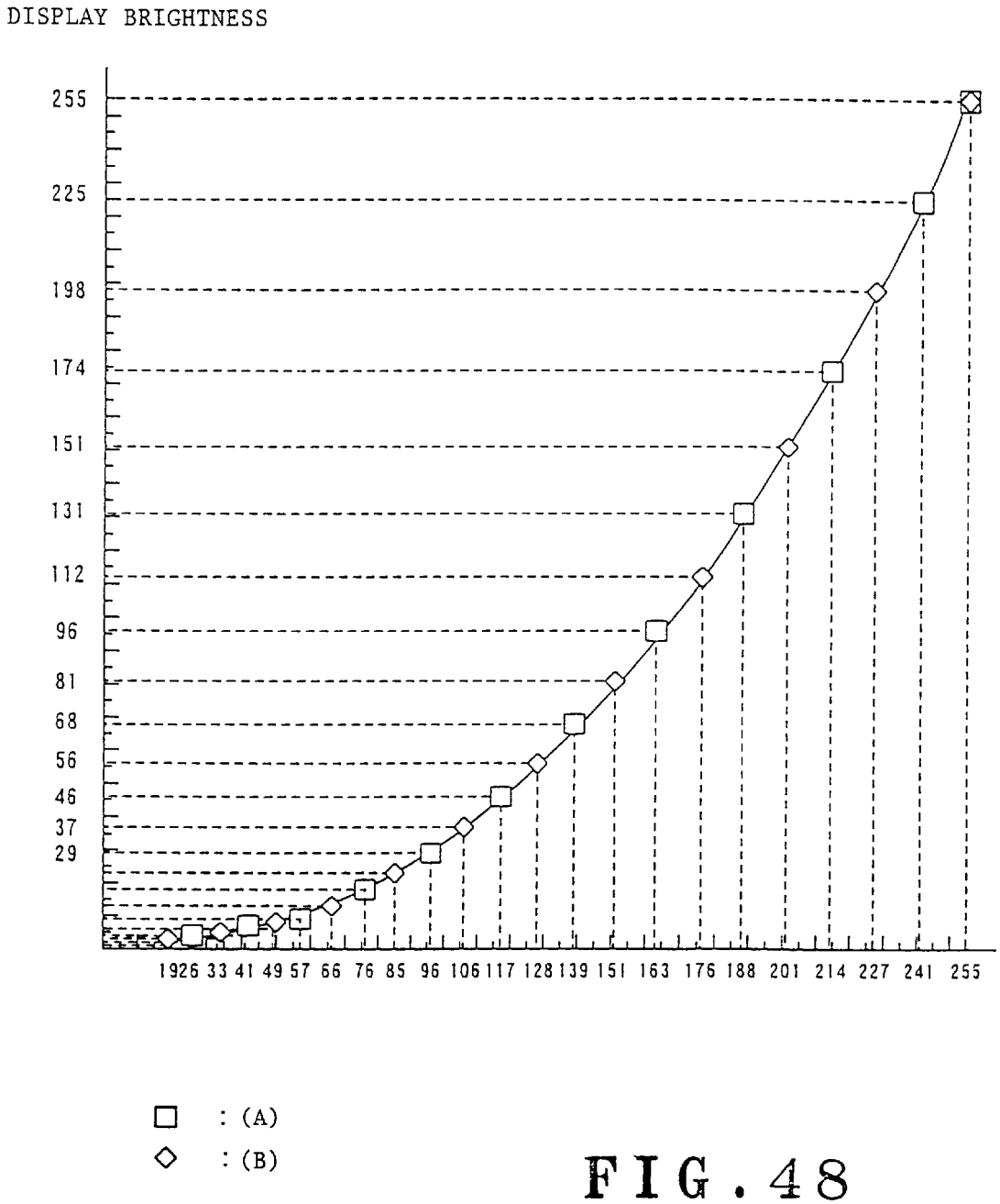
FIG. 48 is a view showing the display brightness characteristics corresponding to input video signals when TV signals are designated as input.

FIG. 48 shows the correspondence between the input video signal and the display brightness of a picture image to be actually displayed on the PDP 10 in response to the input video signal and the respective input video signals when the input video signal is the TV signal.

Referring to FIG. 48, "□" is the gray-scale brightness point obtained by the gray-scale drive according to the light-emission drive sequence as shown in FIG. 46A, while "◇" is the gray-scale brightness point obtained by the gray-scale drive according to the light-emission drive sequence as shown in FIG. 46B.

As shown in FIG. 48, when the input video signal is the TV signal, the light-emission drive sequences as shown in FIGS. 46A and 46B are carried out by switching at alternate fields (frames). According to the drive, to a position in between two gray-scale brightness points obtained by one of the light-emission drive sequences, the gray-scale brightness point obtained by the other light-emission drive sequence is to be added.

Incidentally, in FIG. 48, the brightness between gray-scale brightness points adjacent to each other, that is, between a "□" and a "◇" is obtained by the aforementioned error diffusion processing and multi-level gray-scale processing such as dither processing.

Figure 49:
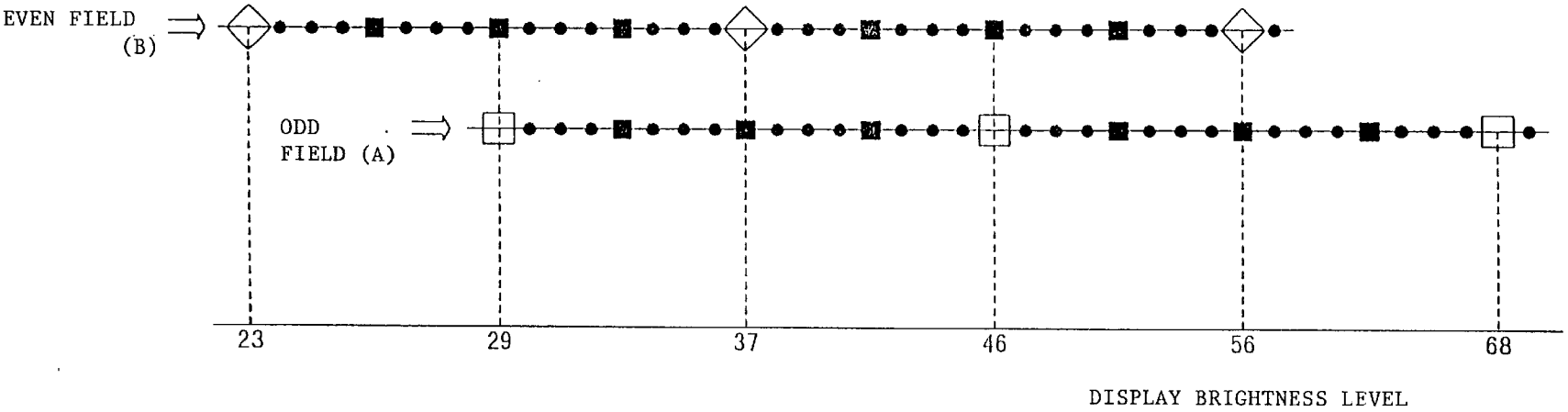
FIG. 49 is a view showing the positional relationship between each of the gray scale brightness points obtained by the light-emission drive sequence shown in FIGS. 46A and 46B, and each of the gray scale brightness points obtained by the error diffusion and dither processing in region E1 of FIG. 48.

FIG. 49 shows the positional relationship, in region E1 of FIG. 48, between the gray-scale brightness point ("□") obtained by the light-emission drive sequence shown in FIG. 46A, the gray-scale brightness point ("◇") obtained by the light-emission drive sequence as shown in FIG. 46B, the gray-scale brightness point ("●") obtained by error diffusion processing, and the gray-scale brightness point ("■") obtained by dither processing.

At this time, as shown in FIG. 49, part of respective gray-scale brightness points ("■") obtained apparently by the aforementioned dither processing have the same brightness level as the gray-scale brightness points ("□") obtained by performing the light-emission drive sequences shown in FIGS. 46A and 46B.

Therefore, in the case of employing an input video signal like a TV signal that has a relatively lower S/N, flicker is suppressed and dither noise is reduced by means of the effects of an integral with respect to time. Meanwhile, the number of levels of halftone is apparently increased by means of the aforementioned error diffusion processing and the dither processing.

On the other hand, as shown in FIG. 14, when the input video signal is the PC video signal that has a relatively higher S/N, the following brightness expression of 13 levels of halftone is carried out to display odd fields (odd frames). That is,

{0: 1: 3: 7:14: 25: 39: 59: 84: 117: 157: 205: 255}

The gray scale drive with the following brightness expression of 13 levels of halftone is carried out when even fields (even frames) are displayed. That is,

{0: 1: 3: 7:13: 23: 37: 56: 81: 112: 151: 198: 255}

Figure 50:
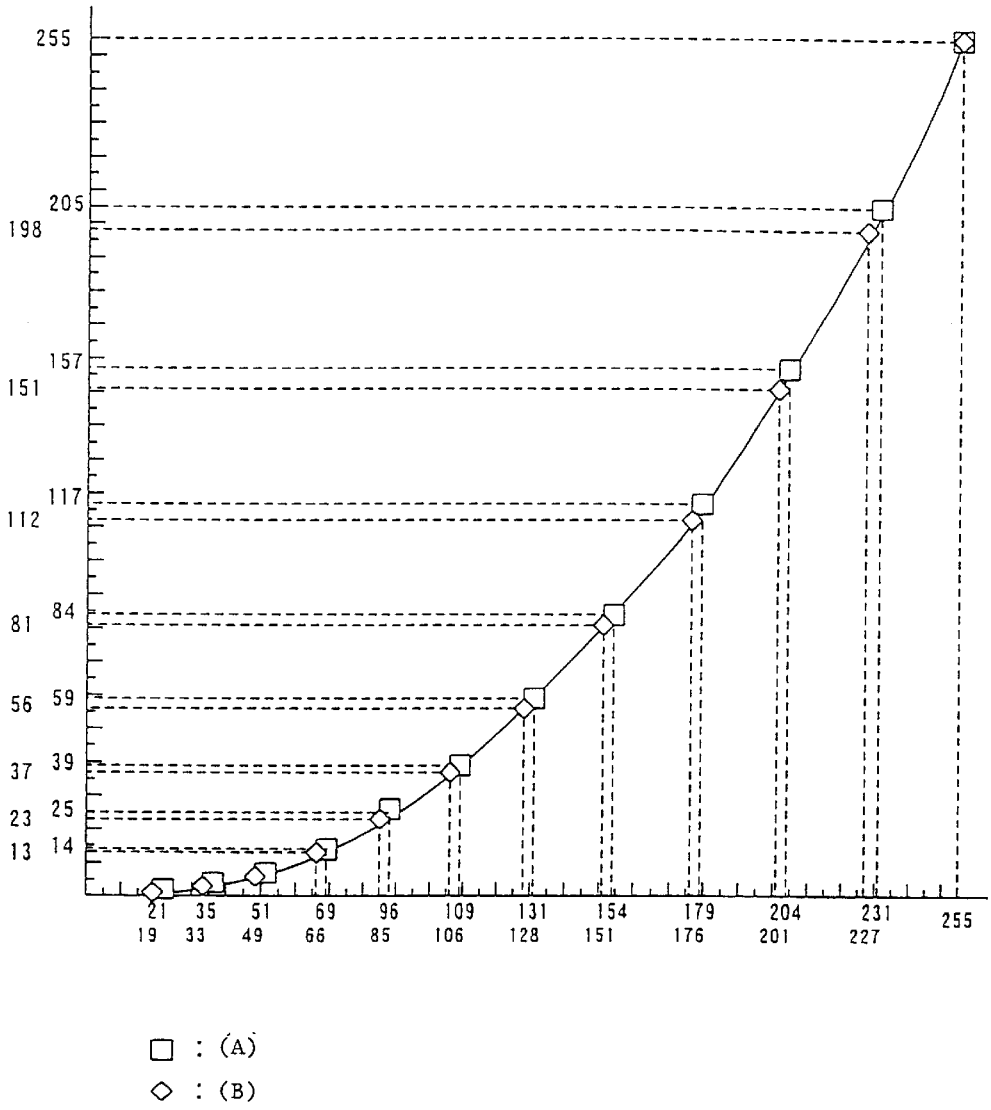
FIG. 50 is a view showing the display brightness characteristics corresponding to input video signals when PC video signals are designated as input.

FIG. 50 shows the correspondence between the input video signal and the display brightness of a picture image to be actually displayed on the PDP 10 in response to the input video signal when the input video signal is the PC video signal.

Referring to FIG. 50, "□" is the gray-scale brightness point obtained by the gray-scale drive according to the light-emission drive sequence shown in FIG. 47A, while "◇" is the gray-scale brightness point obtained by the gray-scale drive according to the light-emission drive sequence shown in FIG. 47B.

As shown in FIG. 50, when the input video signal is the PC video signal, the light-emission drive sequences, of which gray-scale brightness points are slightly displaced to each other, shown in FIG. 47A and 47B are switched alternately at each field (frame). According to the drive, to a position near one of the gray-scale brightness points between the two gray-scale brightness points obtained by one of the light-emission drive sequences, the gray-scale brightness point obtained by the other light-emission drive sequence is to be added.

Incidentally, in FIG. 50, brightness other than the brightness indicated by the gray-scale brightness points of the "□" and "◇" is obtained by the aforementioned error diffusion processing and the multi-level gray-scale processing such as the dither processing.

Figure 51:
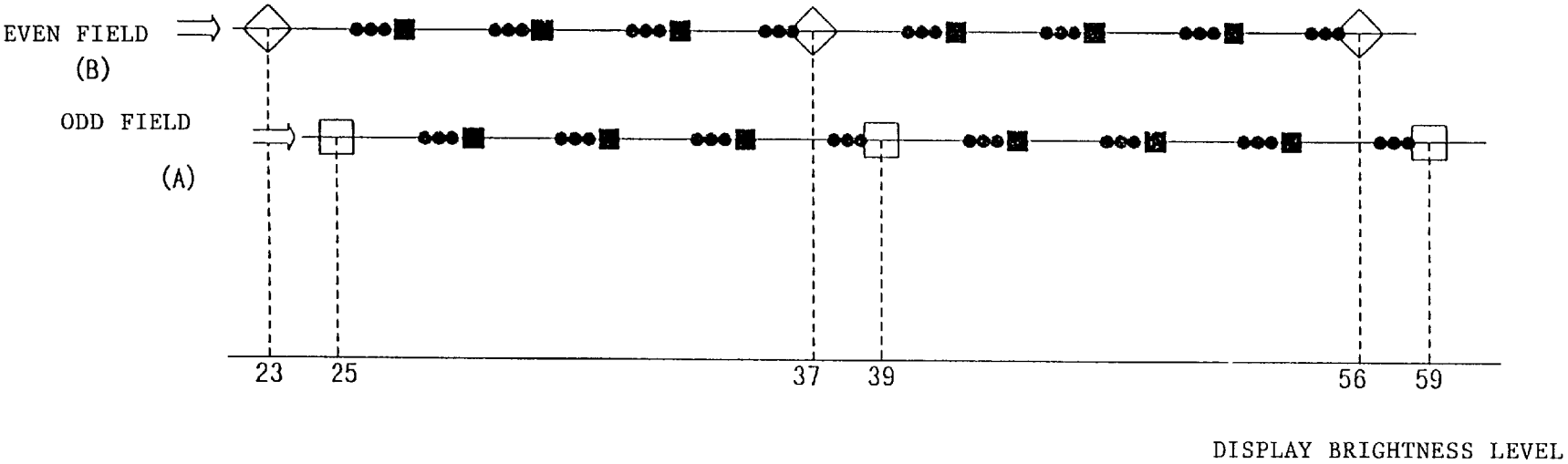
FIG. 51 is a view showing the positional relationship between each of the gray scale brightness points obtained by the light-emission drive sequence shown in FIGS. 47A and 47B, and each of the gray scale brightness points obtained by the error diffusion and dither processing in region E2 of FIG. 50.

FIG. 51 shows the positional relationship, in region E2 of FIG. 50, between the gray-scale brightness point ("□") obtained by the light-emission drive sequence shown in FIG. 47A, the gray-scale brightness point ("◇") obtained by the light-emission drive sequence shown in FIG. 47B, the gray-scale brightness point ("●") obtained by the error diffusion processing, and the gray-scale brightness point ("■") obtained by the dither processing.

As mentioned above, when the PC video signal is specified as an input, the dither coefficients a to d of three bits (a=0, b=2, c=4, and d=6) shown in FIG. 41 are used in the dither processing thereof. For this reason, as shown in FIG. 51, crude density is produced in the respective distributions of gray-scale brightness points obtained by the error diffusion processing.

Therefore, as shown in FIG. 51, the respective gray-scale brightness points obtained apparently by the aforementioned error diffusion processing and dither processing are different in brightness level from the respective gray-scale brightness points obtained by the light-emission drive sequences shown in FIGS. 47A and 47B.

Therefore, due to the effects of an integral with respect to time, the number of visual display levels of halftone increases approximately two times compared with the case where the light-emission drive sequence (which is used when the TV signal is designated as the input video signal) shown in FIGS. 46A and 47B.

That is, when a video signal with a relatively high S/N ratio such as the PC video signal is designated as an input, an apparent gray-scale brightness point obtained by the error diffusion processing and the dither processing is displaced relative to the gray-scale brightness point obtained by carrying out the light-emission drive sequences shown in FIGS. 47A and 47B. This allows for significantly increasing in an apparent manner the number of levels of halftone to be expressed.

Incidentally, the aforementioned embodiment described a case where a method which allows wall charges to be built up in respective discharge cells in advance to set all discharge cells to the light-emitting cell and then pixel data is written by erasing the wall charges selectively in response to pixel data, that is, the so-called selective erase addressing method was employed as the pixel data write method.

However, the present invention is also similarly applicable even to the case where a method which allows wall charges to be built up selectively in response to pixel data, that is, the so-called selective write addressing method is employed as the pixel data write method.

Figure 52:
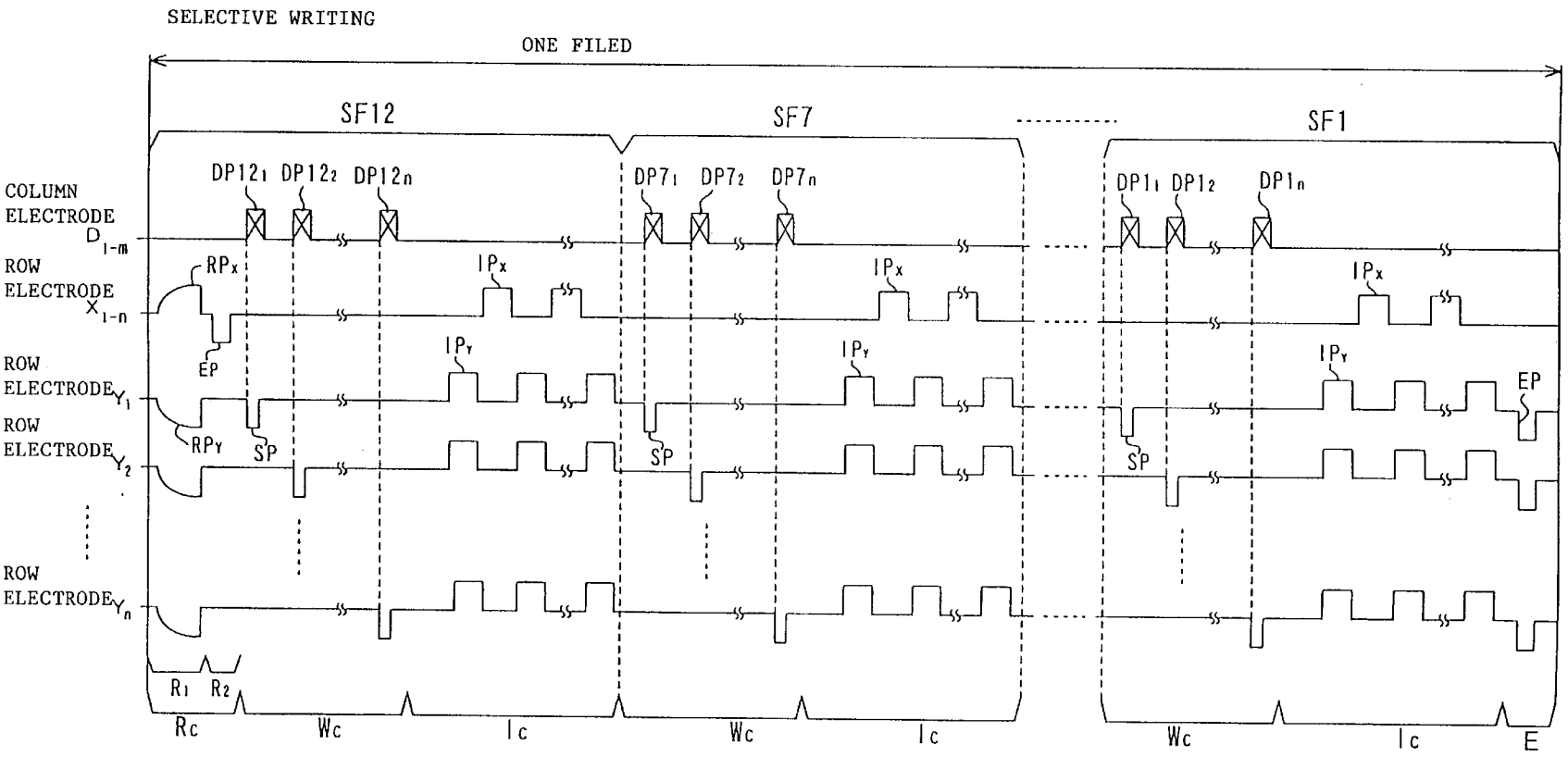
FIG. 52 is a view showing the application timing of various types of drive pulses to be applied to PDP 10 during one field display period during the selective write addressing method.

FIG. 52 shows an example of the application timing of respective various drive pulses that are applied to the column electrodes $D_1$ to $D_m$ and the row electrodes $X_1$ to $X_n$ and $Y_1$ to $Y_n$ by the aforementioned addressing driver 6, and the first and second sustain drivers 7 and 8.

Figure 53A:
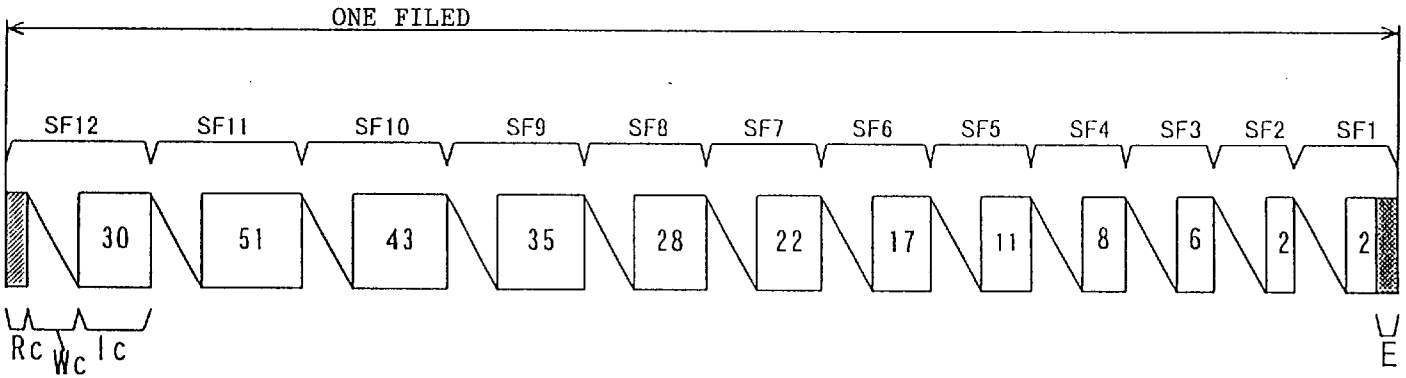
FIGS. 53A and 53B are views showing the light-emission drive sequence (when the selective write addressing method is employed) to be performed when signals designated as input are TV signals.
Figure 53B:
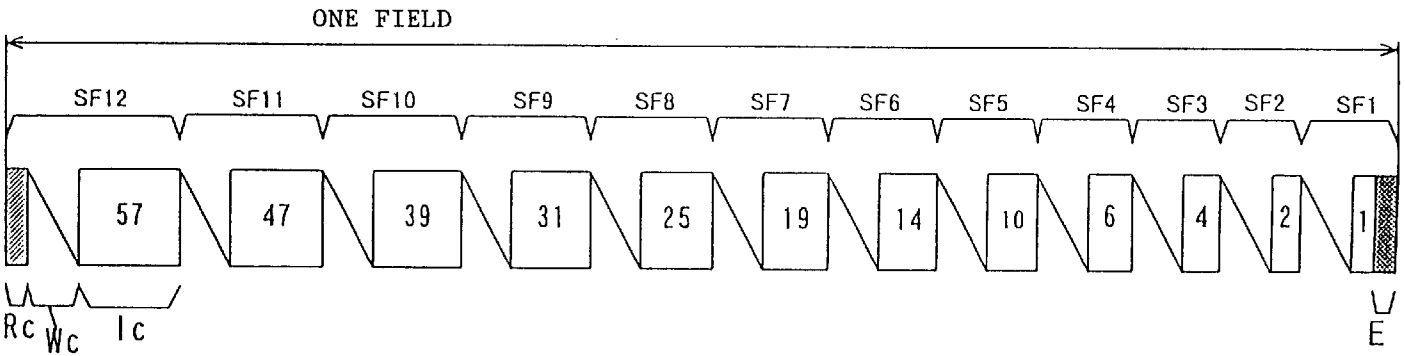
Figure 54A:
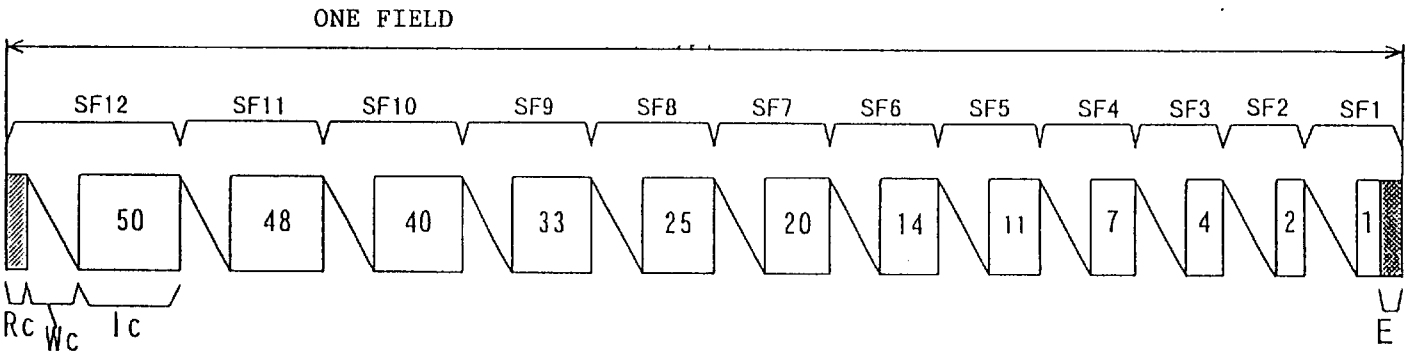
FIGS. 54A and 54B are views showing the light-emission drive sequence (when the selective write addressing method is employed) to be performed when signals designated as input are TV signals.
Figure 54B:
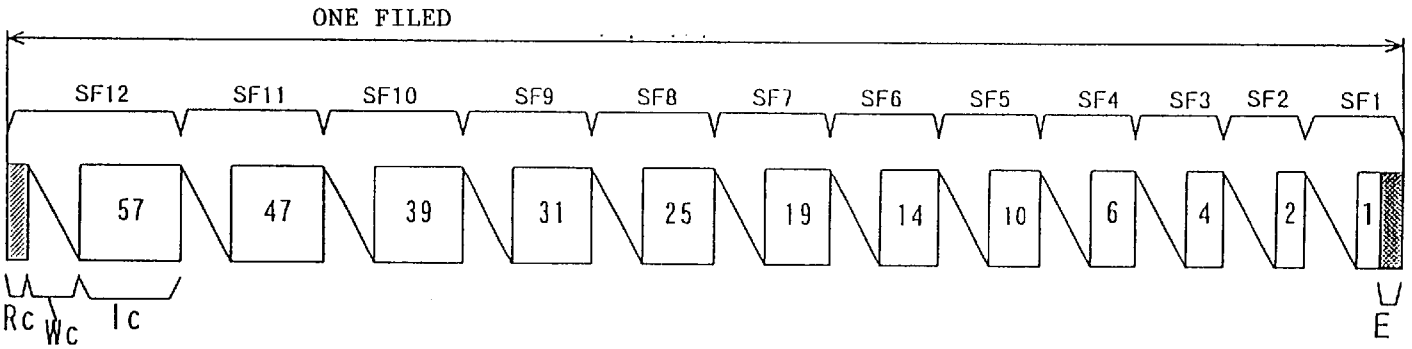

Furthermore, FIGS. 53A and 53B show the light-emission drive sequences to be carried out when the TV signal is designated as an input video signal when the selective write addressing method is employed. FIGS. 54A and 54B shows the light-emission drive sequence to be carried out when the PC video signal is designated. Incidentally, FIG. 53A and FIG. 54A show the light-emission drive sequences to be carried out when odd fields (odd frames) are displayed, and FIG. 53B and FIG. 54B show the light-emission drive sequences to be carried out when even fields (even frames) are displayed.

Furthermore, FIG. 55 shows the conversion table used in the second data converter 34 shown in FIG. 36 and all light-emission patterns to be carried out in one field period when the selective write addressing method is employed.

In the foregoing, as shown in FIG. 52 mentioned above, when the selective write addressing method is employed, the first and second sustain drivers 7 and 8 first apply, simultaneously, the reset pulses $RP_X$ and $RP_Y$ to the row electrodes X and Y of the PDP 10, respectively, in the simultaneous reset process Rc of the head sub-fields SF12. This allows reset discharge in all discharge cells of the PDP 10 and causes compulsory build-up of wall charges in respective discharge cells ($R_1$). Immediately thereafter, the first sustain driver 7 applies the erase pulse EP to the row electrodes $X_1$ to $X_n$ of the PDP 10, simultaneously, thereby erasing the aforementioned wall charges built up in all discharge cells ($R_2$). That is, executing the simultaneous reset process Rc shown in FIG. 52 causes all discharge cells of the PDP 10 to be reset to "non-light-emitting cells" for the time being.

Subsequently, in the pixel data writing step Wc, the addressing driver 6 generates a pixel data pulse having a voltage corresponding to the logic level of the display drive pixel data bit DB supplied by the aforementioned memory 5. The addressing driver 6 applies sequentially the data pulse to the column electrode $D_{1\text{-}m}$ line by line. That is, first, in the pixel data writing step Wc of the sub-field SF12, $DB12_{11\text{-}1m}$ which corresponds to the first line of the sub-field is extracted from the aforementioned display drive pixel data bit $DB12_{11\text{-}nm}$. Then, the pixel data pulse group $DP12_1$ comprising m pixel data pulses corresponding to the logic levels of the respective $DB12_{11\text{-}1m}$ is generated and applied to the column electrode $D_{1\text{-}m}$. Subsequently, $DB12_{21\text{-}2m}$ that corresponds to the second line of the sub-field is extracted from the display drive pixel data bit $DB12_{11\text{-}nm}$. Then, the pixel data pulse group $DP12_2$ comprising m pixel data pulses corresponding to the logic levels of the respective $DB12_{21\text{-}2m}$ is generated and applied to the column electrode $D_{1\text{-}m}$. Likewise, in the pixel data writing step Wc of the sub-field SF12, the pixel data pulse groups $DP12_3$ to $DP12_n$ for one line are applied to the column electrodes $D_{1\text{-}m}$ in sequence. Subsequently, in the pixel data writing step Wc of the sub-field SF11, $DB11_{11\text{-}1m}$ which corresponds to the first line of the sub-field is first extracted from the aforementioned display drive pixel data bit $DB11_{11\text{-}nm}$. Then, the pixel data pulse group $DP11_1$ comprising m pixel data pulses corresponding to the logic levels of the respective $DB11_{11\text{-}1m}$ is generated and applied to the column electrode $D_{1\text{-}m}$. Subsequently, $DB11_{21\text{-}2m}$ that corresponds to the second line of the sub-field is extracted from the display drive pixel data bit $DB11_{11\text{-}nm}$. Then, the pixel data pulse group $DP11_2$ comprising m pixel data pulses corresponding to the logic levels of the respective $DB11_{21\text{-}2m}$ is generated and applied to the column electrode $D_{1\text{-}m}$. Likewise, in the pixel data writing step Wc of the sub-field SF11, the pixel data pulse groups $DP11_3$ to $DP11_n$ for one line are applied to the column electrodes $D_{1\text{-}m}$ in sequence. Likewise, in the pixel data writing step Wc of the sub-fields SF10 to SF1, the addressing driver 6 assigns the pixel data pulse groups $DP10_{1\text{-}n}$ to $DP1_{1\text{-}n}$ generated based on the respective display drive pixel data bits $DB10_{11\text{-}nm}$ to $DB1_{11\text{-}nm}$ to the sub-fields SF10 to SF1, respectively. Then, the addressing driver 6 applies the pixel data pulse groups $DP3_{1\text{-}n}$ to $DP12_{1\text{-}n}$ to the column electrodes $D_{1\text{-}m}$. Incidentally, it is assumed that the addressing driver 6 generates a high-tension pixel data pulse when the display drive pixel data bit DB has a logic level of "1", while generating a low-voltage (0 volt) pixel data pulse when the logic level is "0".

Furthermore, in the pixel data writing step Wc, the second sustain driver 8 generates the scan pulses SP of negative polarity shown in FIG. 52 at the same time as the application timing of each of the pixel data pulse groups DP. Then, the second sustain driver 8 applies the scan pulses SP in sequence to the row electrodes $Y_1$ to $Y_n$. At this time, discharge (selective write discharge) is caused only at the discharge cells located at the intersections of the "lines" to which the scan pulse SP is applied and the "columns" to which a high-tension pixel data pulse is applied. Wall charges are selectively built up in the discharge cells. The selective write discharge causes the discharge cells that have been reset to the "non-light-emitting cell" at the aforementioned simultaneous reset process Rc to change to the "light-emitting cell". On the other hand, no discharge is produced in the discharge cells that are formed in the "columns" to which a low-voltage pixel data pulse is applied, and thus the preset state is sustained. That is, discharge cells of "non-light-emitting cells" remain as "non-light-emitting cells", while discharge cells of "light-emitting cells" remain as "light-emitting cells". Thus, the immediately subsequent light-emission sustaining step Ic allows for setting "light-emitting cells" in which sustaining discharge is generated and "non-light-emitting cells" in which sustaining discharge is not generated.

Subsequently, in the light-emission sustaining step Ic of each sub-field, the first and second sustain drivers 7 and 8 apply the sustain pulses $IP_X$ and $IP_Y$ of positive polarity alternately as shown in FIG. 52 to the row electrodes $X_1$ to $X_n$ and $Y_1$ to $Y_n$, respectively. The number of times of the sustain pulses IP that should be applied then in the light-emission sustaining step Ic of each sub-field varies depending on the type of video signal selected as an input video signal as shown in FIGS. 53A and 53B or FIGS. 54A and 54B.

As shown in FIG. 52, when the selective write addressing method is employed, the erase process E is carried out only at the last sub-field SF1.

In the erase process E, the addressing driver 6 generates the erase pulse EP with negative polarity shown in FIG. 52 and applies the pulse EP simultaneously to respective row electrodes $Y_1$ to $Y_n$. The simultaneous application of the erase pulse EP causes the erasing discharge to be generated in all discharge cells of the PDP 10 and thus the wall charges remaining within all discharge cells to disappear. That is, the erasing discharge causes all discharge cells of the PDP 10 to change to "non-light-emitting cells".

In the foregoing, in the pixel data writing step Wc of each sub-field shown in FIGS. 53A and 53B or FIGS. 54A and 54B, only the discharge cells that have been set to "light-emitting cells" repeat the sustaining discharge by the number of times described in the figures to sustain the light-emission state in the light-emission sustaining step Ic to be carried out thereafter.

At this time, it is determined by the display drive pixel data GD shown in FIG. 27 that discharge cells at the pixel data writing step Wc of each sub-field are set to a "light-emitting cell" or "non-light-emitting cell". That is, each bit 1 to 12 of the display drive pixel data GD corresponds to sub-fields SF1 to SF12, respectively. Thus, only when a bit has, for example, logic level "1", the aforementioned selective write discharge is generated in the pixel data writing step Wc of the sub-field corresponding to the digit of the bit and thus the discharge cell is set to the "light-emitting cell". On the other hand, when the bit has logic level "0", the aforementioned selective write discharge is not generated and thus the present state is sustained. That is, the discharge cell of a "non-light-emitting cell" remains as a "non-light-emitting cell", while the discharge cell of a "light-emitting cell" remains as a "light-emitting cell" At this time, only the simultaneous reset process Rc at the head sub-field SF12 can have a chance of changing a discharge cell from the "light-emitting cell" to the "non-light-emitting cell". Therefore, the discharge cell that has been changed to a "light-emitting cell" by the selective write discharge generated in the pixel data writing step Wc of any one of the sub-fields SF12 to SF1 after completion of the simultaneous reset process Rc will never change again to a "non-light-emitting cell" in this field. Therefore, according to the data patterns of the display drive pixel data GD shown in FIG. 55, each discharge cell remains as a "non-light-emitting cell" for a period until the selective write discharge is generated at the sub-fields shown by the black circles of FIG. 27. The discharge cell repeats sustaining discharge by the number of times described in FIGS. 53A and 53B or FIGS. 54A and 54B at the light-emission sustaining stepes Ic of the respective sub-fields after the black circles to sustain the discharge light-emission states.

As shown in FIG. 55, this allows gray scale drive having the following brightness expression of 13 levels of halftone when odd fields (odd frames) are displayed with the TV signal as the input video signal in brightness mode 1. That is, {0: 2: 4: 10: 18: 29: 46: 68: 96: 131: 174: 225: 255}

The gray scale drive with the following brightness expression of 13 levels of halftone is carried out when even fields (even frames) are displayed. That is, {0: 1: 3: 7:13: 23: 37: 56: 81: 112: 151: 198: 255}

On the other hand, as shown in FIG. 27, gray scale drive having the following brightness expression of 13 levels of halftone is carried out when odd fields (odd frames) are displayed with the PC video signal as the input video signal. That is, {0: 1: 3: 7:14: 25: 39: 59: 84: 117: 157: 205: 255}

The gray scale drive with the following brightness expression of 13 levels of halftone is carried out when even fields (even frames) are displayed. That is, {0: 1: 3: 7:13: 23: 37: 56: 81: 112: 151: 198: 255}

At this time, the brightness expression by means of the gray-scale drive is the same as that in the case where the selective erase addressing method is employed as the pixel data write method.

Therefore, even when the selective write addressing method is employed, the number of apparent levels of halftone can be increased appropriately according to the type of the video signal designated as an input in the same way as the case where the aforementioned selective erase addressing method is employed.

Furthermore, in the aforementioned embodiment, the selective erase (write) discharge is to be generated by the simultaneous application of the scan pulse SP and the high-tension pixel data pulse in one of the pixel data writing stepes Wc of the sub-fields SF1 to SF12. However, a reduced amount of charged particles remaining in discharge cells may cause the selective erase (write) discharge to be generated in a normal manner. This may cause the wall charges in the discharge cells not to be erased (built up) in a normal manner. At this time, even when the A/D-converted pixel data D shows low brightness, light-emission corresponding to the maximum brightness is carried out, thus presenting a problem in that the display quality is significantly lowered.

For this reason, the conversion table used in the second data converter 34 is changed from the one shown in FIG. 42 and FIG. 55 to the one shown in FIG. 56 and FIG. 57 for carrying out gray-scale drive. Incidentally, FIG. 56 shows the conversion table used in the second data converter 34 when the selective erase addressing method is employed, and the light-emission drive pattern to be carried out in one field period. FIG. 57 shows the aforementioned conversion table and the light-emission drive pattern when the selective write addressing method is employed. In the foregoing, the "*" shown in FIG. 56 and FIG. 57 indicates that any one of either logic level "1" or "0" may be selected, and the triangular mark indicates that the selective erase (write) discharge is carried out only when the "*" is logic level "1".

According to the display drive pixel data GD shown in FIG. 56 and FIG. 57, the "selective erase (write) discharge" is carried out successively at least twice. In other words, since the initial selective erase (write) discharge may fail to write pixel data, the selective erase (write) discharge is repeated at least in one of the subsequent sub-fields. This ensures pixel data writing and prevents accidental light-emission.

As described in detail in the foregoing, the drive method, according to the present invention, allows for carrying out selectively either a first drive pattern or a second pattern, depending on the type of input video signal. The first drive pattern is allowed to be carried out by switching alternately between first and second light-emission drive sequences field by field (frame by frame), which have different ratios of the number of times of light-emission performed at each light-emission sustaining step during one field (one frame) period. The second drive pattern is allowed to be carried out by switching alternately between third and fourth light-emission drive sequences field by field (frame by frame), which have different ratios of the number of times of light-emission performed at each light-emission sustaining step.

At this time, when the type of input video signal is the TV signal and the aforementioned first drive pattern is selectively carried out, the gray-scale brightness point obtained by the aforementioned first light-emission sequence is designed to have the same brightness level as that obtained apparently by the multi-level gray-scale processing such as error diffusion and dither processing by performing the aforementioned second light-emission drive sequence. On the other hand, when the type of input video signal is the PC video signal and the aforementioned second drive pattern is selectively carried out, the gray-scale brightness point obtained by the aforementioned third light-emission sequence is designed to have a different brightness level from that obtained apparently by the multi-level gray-scale processing such as error diffusion and dither processing by performing the aforementioned fourth light-emission drive sequence.

Accordingly, when display is provided according to video signals with a relatively low S/N ratio such as a TV signal, the number of apparent levels of halftone can be increased by means of the multi-level gray-scale processing such as error diffusion and dither processing. Meanwhile, flicker and noise due to dither are prevented from being produced. On the other hand, when display is provided according to video signals with a relatively high S/N ratio such as the PC video signal, the number of apparent levels of halftone can be increased up to approximately two times by means of the multi-level gray-scale processing such as the aforementioned error diffusion and dither processing.

What is claimed is:

1. A method for driving a plasma display panel wherein discharge cells are formed corresponding to pixels at respective intersections between a plurality of row electrodes disposed in an array for respective scan lines and a plurality of column electrodes disposed in an array crossing said row electrodes, comprising the steps of:

executing, in each of N (N being a natural number) subfields forming a display period of one field, a pixel data writing step for setting each of said discharge cells to either one of a non-light-emitting cell or a light-emitting cell respectively in response to pixel data, and a light-emission sustaining step for allowing only discharge cells set to said light-emitting cell to emit light during a light-emission period corresponding to each of weights assigned to said sub-fields respectively, whereby allowing the plasma display panel to produce a plurality of grayscale levels, wherein in said light-emission sustaining step the light-emission period of a subfield of the subfields which would be at a predetermined place if the subfields are arranged in order of weight is changed field by field or frame by frame and wherein a luminance of a K (K being a natural number) th grayscale level of a field or frame is set inbetween a luminance of a K−1 th grayscale level and a luminance of a K th grayscale level in another field or frame which has different weights of the light emission periods of the subfields.

2. The method for driving a plasma display panel according to claim 1, wherein said light-emission period in said light-emission sustaining step of each of said sub-fields is changed between respective lines of said plasma display panel.

3. The method for driving a plasma display panel according to claim 1, further comprising the steps of:

executing a reset process for resetting all said discharge cells to either one state of light-emitting cells or non-light-emitting cells only in the head portion of said sub-fields during said display period of one field, and applying to said column electrodes a first pixel data pulse which generates a discharge for setting said discharge cells to said non-light-emitting cells or said light-emitting cells in said pixel data writing step of any one of the sub-fields of said sub-fields, and, in said pixel data writing step of said sub-field present immediately thereafter, applying to said column electrodes a second pixel data pulse which is the same as said pixel data pulse.

4. The method for driving a plasma display panel according to claim 1, further comprising the step of:

erase processes for changing all discharge cells to non-light-emitting cells only in said last sub-field during said display period of one field.

5. The method for driving a plasma display panel according to claim 1, wherein, only in said light-emission sustaining step of said n (n=0 to N) respective sub-fields successive from the head of said display period of one field, said light-emitting cells are allowed for emitting light to perform a drive of N+1 levels of halftone.

6. The method for driving a plasma display panel according to claim 1, wherein, only in said light-emission sustaining step of said n (n=0 to N) respective sub-fields successive from the last of said display period of one field, said light-emitting cells are allowed for emitting light to perform drive of N+1 levels of halftone.

7. The method for driving a plasma display panel according to claim 1, wherein the start-up timing of light-emission drive in said one field differs in a field having said different light-emission period in said light-emission sustaining step of respective said sub-fields.

8. The method for driving a plasma display panel according to claim 1, wherein the length of time of said pixel data writing step of said sub-field differs in a field having said different light-emission period in said light-emission sustaining step of respective said sub-fields.

9. The method for driving a plasma display panel according to claim 1, wherein the ratio of said light-emission periods of said light-emission sustaining step of said respective sub-fields is set non-linearly, thereby compensating for the non-linear display characteristics of input pixel data.

10. The method for driving a plasma display panel according to claim 9, wherein said non-linear display characteristics are the Gamma characteristics.

11. The method for driving a plasma display panel according to claim 1, further comprising the steps of:

executing a reset process for resetting all said discharge cells to either one state of light-emitting cells or non-light-emitting cells only in the head portion of said sub-fields during said display period of one field, and setting said discharge cells to either non-light-emitting cells or light-emitting cells in response to pixel data only in said pixel data writing step of any one of said sub-fields.

12. The method for driving a plasma display panel according to claim 11, further comprising the steps of:

resetting said all discharge cells to the state of said light-emitting cells in said reset process, and setting said discharge cells to said non-light-emitting cells by erase-discharging said discharge cells selectively in response to said pixel data in said pixel data writing step.

13. The method for driving a plasma display panel according to claim 13, wherein, only in said light-emission sustaining step of said n (n=0 to N) respective sub-fields successive from the head of said display period of one field, said light-emitting cells are allowed for emitting light to perform a drive of N+1 levels of halftone.

14. The method for driving a plasma display panel according to claim 13, wherein, among said respective sub-fields disposed in said one field, the number of sub-fields responsible for low-brightness light-emission is greater than the number of sub-fields responsible for high-brightness light-emission.

15. The method for driving a plasma display panel according to claim 11, further comprising the steps of:

resetting said all discharge cells to the state of said light-emitting cells in said reset process, and setting said discharge cells to said light-emitting cells by write-discharging said discharge cells selectively in response to said pixel data in said pixel data writing step.

16. The method for driving a plasma display panel according to claim 15, wherein, only in said light-emission sustaining step of said n (n=0 to N) respective sub-fields successive from the last of said display period of one field, said light-emitting cells are allowed for emitting light to perform drive of N+1 levels of halftone.

17. The method for driving a plasma display panel according to claim 16, wherein, among said respective sub-fields disposed in said one field, the number of sub-fields responsible for low-brightness light-emission is greater than the number of sub-fields responsible for high-brightness light-emission.

18. The method for driving a plasma display panel according to claim 1, wherein multi-level gray-scale processing is applied to said input pixel data.

19. The method for driving a plasma display panel according to claim 18, wherein said multi-level gray-scale processing is an error diffusion processing and/or dither processing.

20. The method for driving a plasma display panel according to claim 18, wherein said input pixel data is converted to be separated, at a bit boundary, to an upper bit group and a lower bit group required for said multi-level gray-scale processing before said multi-level gray-scale processing is carried out.

21. A method for driving a plasma display panel wherein discharge cells are formed corresponding to pixels at respective intersections between a plurality of row electrodes disposed in an array for respective scan lines and plurality of column electrodes disposed in an array crossing said row electrodes, comprising the steps of:

executing, in each of N (N being a natural number) subfields forming a display period of one field, a pixel data writing step for setting each of said discharge cells to either one of a non-light-emitting cell or a light-emitting cell respectively in response to pixel data, and a light-emission sustaining step for allowing only discharge cells set to said light-emitting cell to emit light during a light-emission period corresponding to each of weights assigned to said sub-fields respectively, wherein in said light-emission sustaining step the light-emission period of a subfield of the subfields which would be at a predetermined place if the subfields are arranged in order of weight is changed field by field or frame by frame wherein the ratio of the light-emission period in each of the subfields is non-linear.

22. A method for driving a plasma display panel wherein discharge cells are formed corresponding to pixels at respective intersections between a plurality of row electrodes disposed in an array for respective scan lines and a plurality of column electrodes disposed in an array crossing said row electrodes, comprising the steps of:

executing, in each of N (N being a natural number) subfields forming a display period of one field, a pixel data writing step for setting each of said discharge cells to either one of a non-light-emitting cell or a light-emitting cell respectively in response to pixel data, and a light-emission sustaining step for allowing only discharge cells set to said light-emitting cell to emit light during a light-emission period corresponding to each of weights assigned to said sub-fields respectively, whereby allowing the plasma display panel to produce a plurality of grayscale levels, wherein the light-emission period in said light-emission sustaining step is determined such that a difference between two adjacent light-emission periods of the subfields when arranged in order of weight is changed field by field or frame by frame and wherein a luminance of a K (K being a natural number) th grayscale level of a field or frame is set inbetween a luminance of a K−1 th grayscale level and a luminance in displaying a K th grayscale level in another field or frame which has different weights of the light emission periods of subfields.

* * * * *